US010449115B2

(12) United States Patent
Sakakibara

(10) Patent No.: US 10,449,115 B2
(45) Date of Patent: Oct. 22, 2019

(54) ACUPRESSURE TOOL, ACUPRESSURE TOOL SET COMPRISING SAME, AND METHOD FOR ARRANGING SAME

(71) Applicant: Masao Sakakibara, Handa (JP)

(72) Inventor: Masao Sakakibara, Handa (JP)

( * ) Notice: Subject to any disclaimer, the term of this patent is extended or adjusted under 35 U.S.C. 154(b) by 339 days.

(21) Appl. No.: 15/038,206

(22) PCT Filed: Sep. 19, 2014

(86) PCT No.: PCT/JP2014/074966

§ 371 (c)(1),
(2) Date: May 20, 2016

(87) PCT Pub. No.: WO2015/076011

PCT Pub. Date: May 28, 2015

(65) Prior Publication Data

US 2016/0287473 A1 Oct. 6, 2016

(30) Foreign Application Priority Data

Nov. 22, 2013 (JP) ..... 2013-242172
Jul. 2, 2014 (JP) ..... 2014-137222

(51) Int. Cl.
*A61H 39/04* (2006.01)

(52) U.S. Cl.
CPC ..... *A61H 39/04* (2013.01); *A61H 2201/1284* (2013.01); *A61H 2203/0456* (2013.01);
(Continued)

(58) Field of Classification Search
CPC ..... A61H 39/00–06; A61H 7/00–007; A61H 2201/1253–1284; A61H 2203/0043–0475; A61F 5/30–34
See application file for complete search history.

(56) References Cited

U.S. PATENT DOCUMENTS 5,070,865 A * 12/1991 Iams ..... A47G 9/10
128/DIG. 20
6,419,650 B1 * 7/2002 Ryan ..... A61H 15/00
601/122

(Continued)

FOREIGN PATENT DOCUMENTS

JP S53-114409 U 2/1977
JP 3063299 U 10/1999

(Continued)

OTHER PUBLICATIONS

International Search Report for WO2012036136 dated Dec. 20, 2011, 4 pages.

(Continued)

*Primary Examiner* — Jonathan A Hollm

(74) *Attorney, Agent, or Firm* — Hilde M.L. Coeckx; Apex Jurls, PLLC.

(57) ABSTRACT

An acupressure tool including a core rod and a pair of long elastic bodies which are attached to the core rod, with the elastic bodies being attached to the core rod by being arranged intersecting an axial direction of the core rod and bent along an outer face of the core rod. The elastic bodies include a first pressure part arranged on an upper face side of the core rod, and a first tapered face is formed on a rear face side of the first pressure part, the first tapered face lying obliquely to a direction of extension of the first pressure part and abutting the outer face of the core rod.

17 Claims, 45 Drawing Sheets

(52) U.S. Cl.
CPC ..... *A61H 2203/0468* (2013.01); *A61H 2203/0475* (2013.01); *A61H 2205/04* (2013.01); *A61H 2205/06* (2013.01); *A61H 2205/081* (2013.01); *A61H 2205/083* (2013.01); *A61H 2205/086* (2013.01); *A61H 2205/106* (2013.01)

(56) References Cited

U.S. PATENT DOCUMENTS

| | | | | |
|---|---|---|---|---|
| 2010/0145244 | A1* | 6/2010 | Schwartz | A61H 39/04 601/134 |
| 2013/0085426 | A1* | 4/2013 | Brodsky | A61H 15/00 601/128 |
| 2013/0204293 | A1* | 8/2013 | Sakakibara | A61H 39/04 606/204 |

FOREIGN PATENT DOCUMENTS

| | | | | |
|---|---|---|---|---|
| JP | 2005-81084 | A | 3/2005 | |
| JP | 2008-119493 | A | 5/2008 | |
| JP | WO2012/036136 | A1 | 3/2012 | |
| JP | WO 2012036136 | A1 * | 3/2012 | A61H 39/04 |

OTHER PUBLICATIONS

Japanese Office Action for JP Patent No. 2015-549025, dated Apr. 11, 2018, Total of 4 pages.

* cited by examiner (a)

(b)

(a)

(b)

(a)

(b)

(a)

(b)

(c)

(a)

(b)

(a)

(b)

(c)

(a)

(b)

(a)

(b)

ACUPRESSURE TOOL, ACUPRESSURE TOOL SET COMPRISING SAME, AND METHOD FOR ARRANGING SAME

BACKGROUND OF THE INVENTION

Field of the Invention

The present invention relates to an acupressure tool, an acupressure tool set comprising the same, and a method for arranging the same, and more specifically to an acupressure tool capable of accurately identifying and applying pressure to a local area near a mastoid, an acupressure tool set comprising the same, and a method for arranging the same.

Description of the Background Art

Acupressure treatment has been generally widely practiced by chiropractors as a treatment for stiff shoulders. This acupressure treatment refers to a treatment in which the chiropractor places his/her fingers on a local area of the patient's body and leans his/her weight thereon, applying pressure thereto. In this acupressure treatment, acupressure along an interscapular region between a scapula and a spine, an upper scapular region above the scapula on an upper shoulder surface, and neck muscles is considered effective. Nevertheless, it is difficult to always receive acupressure treatment by a chiropractor whenever or soon after shoulders become stiff.

Thus, various kinds of acupressure tools have been proposed which allow a user to apply acupressure treatment on his/her own (refer to Patent Document 1, for example). For example, Patent Document 1 discloses an acupressure tool 101 comprising a core rod 102, and a pair of long elastic bodies 103. Each of the elastic bodies 103 is disposed so as to intersect an axial direction of this core rod 102, bends along an outer face of the core rod 102, and is attached to the core rod 102, as illustrated in FIG. 56. Further, Patent Document 1 described above discloses formation of a concave part 107 on a rear face side of the elastic body 103 for lightly applying pressure to a head region, as illustrated in FIG. 57. According to the acupressure tool 101 of this Patent Document 1, when the head region and shoulder regions are placed on front face sides of the elastic bodies 103, the resulting elastic deformation of the elastic bodies 103 caused by gravity and the softness of the elastic bodies 103 themselves loosen the muscles and improve circulation, achieving effects similar to those of acupressure.

part of neck muscles), lower scapular regions, lumbar regions, and the like along with effective pressure points (so-called acupressure points) as acupressure areas disclosed in Non-Patent Document 1 (refer to pp. 23 and 72). FIG. 54 also illustrates the upper scapular regions as pressure points. In FIG. 54, 200 denotes the scapula, 202 denotes the interscapular region between the scapula and the spine, and 202a denotes a pressure point in the interscapular region. Further, in FIG. 54, 204 denotes the rear neck region, and 204a denotes a pressure point in the rear neck region. Furthermore, 206 denotes the upper scapular region positioned above the scapula in an upper shoulder region as a pressure point. Further, in FIG. 54, 302 denotes the lower scapular region, and 302a denotes a pressure point in the lower scapular region. Further, in FIG. 54, 303 denotes the lumbar region, and 303a denotes a pressure point in the lumbar region. Furthermore, in FIG. 54, 304 denotes a Namikoshi pressure point. Further, in FIG. 54, 305 denotes an upper iliac crest region, and 305a denotes a pressure point in the upper iliac crest region. Further, in FIG. 54, 306 denotes a gluteal region, and 306a denotes a pressure point in the gluteal region. Furthermore, in FIG. 54, 307 denotes a sacrum region, and 307a denotes a pressure point in the sacrum region. Further, FIG. 55A illustrates a side neck region along with effective pressure points as an acupressure area disclosed in the same Non-Patent Document (refer to pp. 48 and 22). In FIG. 55A, 208 denotes the side neck region, and 208a denotes a pressure point in the side neck region. It should be noted that, in FIG. 55A, 210 denotes the mastoid. Furthermore, FIG. 55B illustrates a lower leg outside region along with effective pressure points as an acupressure area disclosed in the same Non-Patent Document (refer to p. 38). In FIG. 55B, 309 denotes the lower leg outside region, and 309a denotes a pressure point in the lower leg outside region.

PATENT DOCUMENTS

Patent Document 1: WO 2012/036136

NON-PATENT DOCUMENTS

Non-Patent Document 1: Toru Namikoshi; "Kenkou no izumi shiatsu kyoushitsu (Fountain of Health: A Lesson in Acupressure)"; 1979; pp. 22, 23, 48, and 72

Non-Patent Document 2: Emi Ishikura, Eiichi Fujisawa; "Kubi no ushiro wo osu dake! Shinkei no nagare wo yokushite manbyou wo naosu!! (Just Press the Back of Your Neck! Improving Nerve Flow Is the Cure-All!!)"; Jan. 16, 2012; pp. 12-14, and 29

Non-Patent Document 3: Noritoshi Wakiya; "Tsubo wo tadashiku oseru hon (Pressing Acupressure Points Correctly)"; May 22, 2012; pp. 50, 81, and 99

SUMMARY OF THE INVENTION

Problems to be Solved by the Invention

Here, Non-Patent Document 2 (refer to pp. 12 to 14) discloses that applying acupressure to a local area P (specifically, the section P that is 1 mm downward and 1 mm frontward from a tip of the mastoid 210; refer to FIG. 55C) near the mastoid 210 of the head region makes it possible to effectively remove or alleviate stiff shoulders. This is presumably because the local area P near the mastoid 210 is positioned in the topmost area of nerve flow, and applying acupressure to this local area P immediately revitalizes the nerve flow. It should be noted that applying pressure to the local area P near the mastoid 210 described above instantly stabilizes a person's mental state, quickly shifting a person's mood and bringing a sense of relief from unpleasant stiff shoulders (then a drowsy feeling).

Nevertheless, in the acupressure tool 101 of Patent Document 1 described above, the elastic bodies 103 are each formed so as to include a pressure part 103a (refer to FIGS. 56 and 57) arranged on an upper face side of the core rod 102. This pressure part 103a has a constant thickness along a direction of extension, making it difficult to accurately identify the local area near the mastoid, which is in a location recessed from a section normally contacted.

Further, in the acupressure tool 101 of Patent Document 1 described above, the elastic bodies 103 each further comprise a pressure part 103b (refer to FIGS. 56 and 57) arranged near one end side thereof in a longitudinal direction, and a front face edge of a vertical cross section of this pressure part 103b is substantially linear in shape. As a result, pressure is applied to a curved surface area of the body by the linear pressure part, merely allowing pressure to be applied to a specific area of the interscapular region, for example. Furthermore, such a configuration does not allow pressure to be effectively applied to the upper scapular region.

The known mechanism that causes stiff shoulders is as follows. When fatigue and stiffness in the lumbar region of the body are left untreated, stiffness then builds in the muscles along the spine. When stiffness in the muscles along the spine is left untreated, stiffness then builds in the shoulder regions. When stiffness in the shoulder regions is left untreated, stiffness then ultimately develops in the neck region. In other words, stiffness starts in the lumbar region, and rises to the upper regions of the body. Thus, by relieving stiffness in the head region, shoulder regions, as well as other sections of the body, it is possible to more reliably remove or alleviate stiff shoulders. Accordingly, development of an acupressure tool set capable of achieving such relief is needed.

The present invention was achieved in light of the above, and therefore an object of the present invention is to provide an acupressure tool capable of accurately identifying and applying pressure to a local area near a mastoid. Further, another object of the present invention, in addition to the above-described object, is to provide an acupressure tool capable of effectively applying pressure to a shoulder region having a curved surface shape. Furthermore, another object of the present invention is to provide an acupressure tool set capable of more reliably removing or alleviating stiff shoulders, and a method for arranging the acupressure tool set.

Means for Solving the Problems

To solve the above-described problems, the present invention according to claim 1 is an acupressure tool comprising a core rod and a pair of long elastic bodies which are attached to the core rod, the elastic bodies being attached to the core rod by being arranged intersecting an axial direction of the core rod and bent along an outer face of the core rod. The elastic bodies comprise a first pressure part arranged on an upper face side of the core rod, and a first tapered face is formed on a rear face side of the first pressure part, the first tapered face lying obliquely to a direction of extension of the first pressure part and abutting the outer face of the core rod.

The present invention according to claim 2 is the acupressure tool according to claim 1, wherein the elastic bodies further comprise a second pressure part arranged near one end side in a longitudinal direction of the elastic bodies, a front face edge of a vertical cross section of the second pressure part having a substantially curved shape.

The present invention according to claim 3 is the acupressure tool according to claim 2, wherein the elastic bodies further comprise a third pressure part arranged between the first pressure part and the second pressure part, a front face edge of a vertical cross section of the third pressure part having a substantially linear shape.

The present invention according to claim 4 is the acupressure tool according to any one of claims 1 to 3, wherein the elastic bodies further comprise a support part that supports an outer face of the core rod in an upright state, and a second tapered face is formed on a rear face side of the support part, the second tapered face lying obliquely to a direction of extension of the support part and abutting the outer face of the core rod.

The present invention according to claim 5 is the acupressure tool according to claim 4, wherein the elastic bodies further comprise a fourth pressure part arranged on an upper face side of the core rod between the first pressure part and the support part, a thickness of the fourth pressure part being 2 to 5 mm.

The present invention according to claim 6 is the acupressure tool according to any one of claims 1 to 5, wherein a rib that extends in the direction of extension of the first pressure part is provided on the rear face side of the first pressure part, the first tapered face being formed by a lower face of the rib.

The present invention according to claim 7 is the acupressure tool according to any one of claims 1 to 6, wherein the first tapered face is arranged in a concave part that is indented toward an upper face side and formed on a lower face side of the elastic bodies.

To solve the above-described problems, the present invention according to claim 8 is an acupressure tool set comprising the first acupressure tool according to any one of claims 1 to 7 for applying pressure to a head region and/or shoulder regions of the body, and another acupressure tool for applying pressure to a section of the body different from the section having pressure applied thereto by the first acupressure tool. The other acupressure tool comprises a core rod and a pair of long elastic bodies which are attached to the core rod, the elastic bodies being attached to the core rod by being arranged intersecting an axial direction of the core rod and bent along an outer face of the core rod, and an upper face of each of the elastic bodies being formed into a convex curved surface that is upwardly convex in a horizontal cross section.

The present invention according to claim 9 is the acupressure tool set according to claim 8, wherein the other acupressure tool comprises a second acupressure tool for applying pressure to muscles along the spine of the body.

The present invention according to claim 10 is the acupressure tool set according to claim 8 or 9, wherein the other acupressure tool comprises a third acupressure tool for applying pressure to a lumbar region and/or a gluteal region of the body.

The present invention according to claim 11 is the acupressure tool set according to claim 10, wherein the third acupressure tool comprises left and right lateral acupressure tools, the lateral acupressure tools having an axial center of the core rod arranged obliquely to an axial center of the core rod of the first acupressure tool.

The present invention according to claim 12 is the acupressure tool set according to claim 11, wherein the third acupressure tool comprises a center acupressure tool, the center acupressure tool having an axial center of the core rod arranged parallel to the axial center of the core rod of the first acupressure tool.

The present invention according to claim 13 is the acupressure tool set according to any one of claims 8 to 12, wherein the other acupressure tool further comprises a fourth acupressure tool for applying pressure to a calf region of a leg region of the body, and a fifth acupressure tool for applying pressure to an Achilles tendon region of the leg region of the body.

The present invention according to claim 14 is the acupressure tool set according to any one of claims 8 to 13, wherein the other acupressure tool further comprises a sixth acupressure tool for applying pressure to a left arm region of the body, and a seventh acupressure tool for applying pressure to a right arm region of the body.

The present invention according to claim 15 is the acupressure tool set according to any one of claims 8 to 14, wherein the other acupressure tool further comprises left and right shoulder acupressure tools for applying pressure to shoulder regions of the body, the shoulder acupressure tools having an axial center of the core rod arranged obliquely to the axial center of the core rod of the first acupressure tool.

To solve the above-described problems, the present invention according to claim 16 is a method for arranging the acupressure tool set according to any one of claims 8 to 15, the method comprising the steps of arranging the first acupressure tool in a first predetermined position on an installation surface so that the head region and/or the shoulder regions of the body are placed thereon, and arranging the other acupressure tool in another predetermined position on the installation surface so that a section different from the section having pressure applied thereto by the first acupressure tool is placed thereon.

Effect of the Invention

According to the acupressure tool of the present invention, the acupressure tool comprises the core rod and the pair of long elastic bodies which are attached to the core rod, the elastic bodies being attached to the core rod by being arranged intersecting the axial direction of the core rod and bent along the outer face of the core rod. Then, the elastic bodies described above comprise the first pressure part arranged on the upper face side of the core rod, and the first tapered face is formed on the rear face side of the first pressure part, the first tapered face lying obliquely to a direction of extension of the first pressure part and abutting the outer face of the core rod. With this arrangement, when the head region and the shoulder regions are placed on the front face sides of the elastic bodies, the resulting elastic deformation of the elastic bodies caused by gravity and the softness of the elastic bodies themselves loosen muscles and improve circulation, achieving effects similar to those of acupressure. Further, the first tapered face on the rear face side of the first pressure part abuts the outer face of the core rod, forming a convex curved surface part on the front face side of the first pressure part. As a result, when the head region and shoulder regions are placed on the front face sides of the elastic bodies, it is possible to accurately identify a local area near the mastoids by the first pressure part and apply pressure using an appropriate pressing force. This makes it possible to remove or alleviate stiff shoulders.

Further, when the elastic bodies comprise the second pressure part arranged near the one end side in the longitudinal direction of the elastic bodies and the front face edge of the vertical cross section of the second pressure part is a substantially curved shape, the second pressure part can strongly apply pressure to the shoulder region by hitting a point when the shoulder region (the interscapular region or the upper scapular region, for example) having a curved surface shape is placed on the front face side of the second pressure part. This makes it possible to thoroughly apply pressure to all sections of the curved surface area, from the upper scapular region to the interscapular region.

Further, when the elastic bodies comprise the third pressure part arranged between the first pressure part and the second pressure part, and the front face edge of the vertical cross section of the third pressure part has a substantially linear shape, the third pressure part can softly apply pressure to the shoulder region by hitting a line when the shoulder region (the interscapular region, for example) is placed on the front face side of the third pressure part.

Further, when the elastic bodies comprise the support part that supports the outer face of the core rod in an upright state, and the second tapered face is formed on the rear face side of the support part, the second tapered face lying obliquely to the direction of extension of the support part and abutting the outer face of the core rod, the support part is elastically deformed and the core rod slides across the second tapered face when the head region and the shoulder regions are placed on the front face sides of the elastic bodies, making it possible to more accurately identify local areas near the mastoids by the first pressure part and further apply pressure using an appropriate pressing force. Furthermore, the second tapered face can increase a strength of the support part.

Further, when the elastic bodies further comprise the fourth pressure part arranged on the upper face side of the core rod between the first pressure part and the support part, and the thickness of the fourth pressure part is 2 to 5 mm, the fourth pressure part having a thin thickness can softly apply pressure to the head region when the head region is placed on the front face side of the fourth pressure part.

Furthermore, when the rib that extends in the direction of extension of the first pressure part is provided on the rear face side of the first pressure part, and the first tapered face is formed by the lower face of the rib, the first pressure part can more accurately identify a local area near the mastoid and further apply pressure using an appropriate pressing force.

Furthermore, when the first tapered face is arranged in the concave part that is indented toward the upper face side and formed on the lower face side of the elastic bodies, the first tapered face can be more easily formed.

According to the acupressure tool set of the present invention, the acupressure tool set comprises the aforementioned first acupressure tool for applying pressure to the head region and/or shoulder regions of the body, and another acupressure tool for applying pressure to a section of the body different from the section having pressure applied thereto by the first acupressure tool. Then, the other acupressure tool comprises the core rod and the pair of long elastic bodies which are attached to the core rod, the elastic bodies being attached to the core rod by being arranged intersecting the axial direction of the core rod and bent along the outer face of the core rod, the upper face of the elastic bodies being formed into the convex curved surface that is upwardly convex in the horizontal cross section. With this arrangement, pressure is applied to the head region and/or the shoulder regions of the body by the elastic bodies of the first acupressure tool, and pressure is applied to a section of the body different from the section having pressure applied thereto by the first acupressure tool by the elastic bodies of the other acupressure tool. In particular, pressure is effectively applied to a pressure point of the body by the convex curved surface of the elastic bodies of the other acupressure tool. As a result, in addition to the head region and/or shoulder regions of the body by the first acupressure tool, the fatigue and stiffness of a section other than that having pressure applied thereto by the first acupressure tool are removed by the other acupressure tool, making it possible to more reliably remove or alleviate stiff shoulders.

Further, when the other acupressure tool comprises the second acupressure tool for applying pressure to muscles along the spine of the body, pressure is applied to the muscles along the spine (for example, a first pressure point of a lower scapular region 302; also referred to as a "Kanyu acupressure point"; refer to FIG. 29; refer to p. 81 of the above-described Non-Patent Document 3) of the body by the elastic bodies of the second acupressure tool. As a result, fatigue and stiffness are removed from the muscles along the spine in addition to the head region and/or the shoulder regions and the like of the body. Removal of stiffness from the muscles along the spine in this manner makes it possible to stimulate internal organs to promote bowel movement and thus prevent constipation, and also prevent posture deterioration (that is, curvature of the back, stooped back).

Further, when the other acupressure tool comprises the third acupressure tool for applying pressure to the lumbar region and/or the gluteal region of the body, pressure is applied to the lumbar region and/or the gluteal region (for example, the Namikoshi pressure point; refer to FIG. 29) of the body by the elastic bodies of the third acupressure tool. As a result, fatigue and stiffness are removed from the lumbar region and/or the gluteal region in addition to the head region and/or shoulder regions and the like of the body. Such removal of stiffness from the lumbar region makes it possible to prevent lumbar pain and posture deterioration (that is, lumbar curvature).

Further, when the third acupressure tool comprises the left and right lateral acupressure tools, the lateral acupressure tools having the axial center of the core rod arranged obliquely to the axial center of the core rod of the first acupressure tool, pressure is applied to the lumbar region and/or the gluteal region (in particular, the lumbar region and the sacrum region including the Jinyu and Shishitsu acupressure points, and the lumbar region including the Namikoshi pressure point 304) of the body by the left and right lateral acupressure tools. This makes it possible to more reliably prevent lumbar pain and posture deterioration (that is, lumbar curvature). Further, a combination of the first acupressure tool and the left and right lateral acupressure tools can be used for a long period of time for restful and sound sleep.

Further, when the third acupressure tool comprises the center acupressure tool, the center acupressure tool having the axial center of the core rod arranged parallel to the axial center of the core rod of the first acupressure tool, a shift in the lumbar region and/or the gluteal region is prevented by the center acupressure tool. This makes it possible to remove fatigue and stiffness from the lumbar region and/or the gluteal region by the left and right lateral acupressure tools and the center acupressure tool in a stable manner.

Further, when the other acupressure tool comprises the fourth acupressure tool for applying pressure to the calf region of the leg region of the body, and the fifth acupressure tool for applying pressure to the Achilles tendon region of the leg region of the body, pressure is applied to the calf region of the leg region (for example, a first pressure point of the lower leg outside region 309; also referred to a "Sanri" acupressure point of the leg; refer to FIG. 55B; refer to pp. 50 and 99 of the above-described Non-Patent Document 3) of the body by the elastic bodies of the fourth acupressure tool, and pressure is applied to the Achilles tendon region (for example, a seventh point and an eighth point of the lower leg rear side region 308; refer to FIG. 29) of the body by the elastic body of the fifth acupressure tool. As a result, fatigue and stiffness are removed from the leg region in addition to the head region and/or shoulder regions and the like of the body.

Furthermore, when the other acupressure tool comprises the sixth acupressure tool for applying pressure to the left arm region of the body, and the seventh acupressure tool for applying pressure to the right arm region of the body, pressure is applied to the left arm region (in particular, a forearm region and a wrist region) of the body by the elastic bodies of the sixth acupressure tool, and to the right arm region (in particular, a forearm region and a wrist region) of the body by the elastic bodies of the seventh acupressure tool. As a result, fatigue and stiffness are removed from the arm regions in addition to the head region and/or shoulder regions and the like of the body.

In particular, when the other acupressure tool comprises the first to seventh acupressure tools, the entire body is placed on the first to seventh acupressure tools stabilized on the ground to completely float the entire body in the air by the acupressure tools. In this state, pressure is applied to each of the acupressure points across the entire body. A person receiving pressure (acupressure) becomes completely relaxed. This pressure effect is effective in restoring health to the mind and body. That is, the fatigue and stiffness of the muscles of the entire body are removed or alleviated and tension is released, thereby relaxing the mind and thus reducing mental stress.

Furthermore, when the other acupressure tool comprises the left and right shoulder acupressure tools for applying pressure to the shoulder regions of the body, the shoulder acupressure tools having the axial center of the core rod arranged obliquely to the axial center of the core rod of the first acupressure tool, pressure is applied to the shoulder regions (in particular, the shoulder regions that includes the scapula regions) of the body by the left and right shoulder acupressure tools. Further, a combination of the first acupressure tool and the left and right shoulder acupressure tools can be used as a pillow for restful and sound sleep for a long period of time.

According to the method for arranging the acupressure tool set of the present invention, the method comprises the steps of arranging the first acupressure tool in the first predetermined position on the installation surface so that the head region and/or the shoulder regions of the body are placed thereon, and arranging the other acupressure tool in another predetermined position on the installation surface so that a section of the body different from the section having pressure applied thereto by the first acupressure tool is placed thereon. With this arrangement, pressure is applied to the head region and/or the shoulder regions of the body by the elastic bodies of the first acupressure tool, and pressure is applied to a section of the body different from the section having pressure applied thereto by the first acupressure tool by the elastic bodies of the other acupressure tool. In particular, pressure is effectively applied to a pressure point of the body by the convex curved surface of the elastic bodies of the other acupressure tool. As a result, in addition to the head region and/or shoulder regions of the body by the first acupressure tool, the fatigue and stiffness of a section other than that having pressure applied thereto by the first acupressure tool are removed by the other acupressure tool, making it possible to more reliably remove or alleviate stiff shoulders.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings.

DESCRIPTIONS OF REFERENCE NUMERALS

1: Acupressure tool (First acupressure tool); 2: Core rod; 3, 3', 3": Elastic body; 11: First pressure part; 12: Second pressure part; 13: Third pressure part; 14: Fourth pressure part; 15: Support part; 17: Rib; 21, 21': First tapered face; 22: Second tapered face; D1: Direction of extension of first pressure part; D2: Direction of extension of support part; P: Local area near mastoid; 30, 400: Acupressure tool set; 32: Second acupressure tool; 33: Third acupressure tool; 34: Fourth acupressure tool; 35: Fifth acupressure tool; 36: Sixth acupressure tool; 37: Seventh acupressure tool; 401: Shoulder acupressure tool; 41, 51, 61, 71, 81, 91: Core rod; 42, 52, 62, 72, 82*a*, 82*b*, 92*a*, 92*b*: Elastic body; 99: Installation surface; P1 to P7: Predetermined positions.

DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Acupressure Tool

Figure 1:
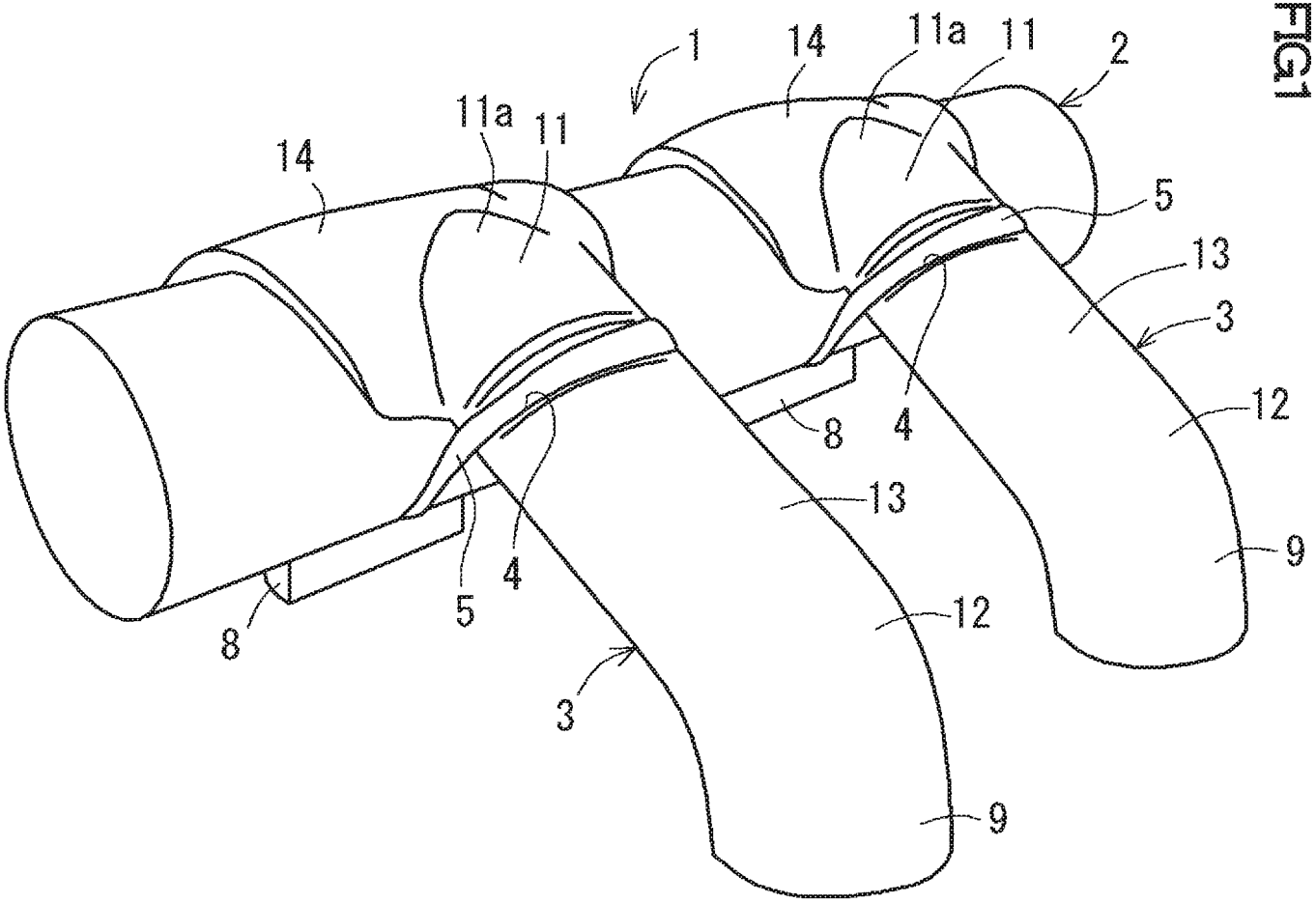
FIG. 1 is a perspective view of an acupressure tool (first acupressure tool) according to an example.

The acupressure tool according to this embodiment comprises a core rod (2) and a pair of long elastic bodies (3, 3', 3") which are attached to the core rod, the elastic bodies being attached to the core rod by being arranged intersecting an axial direction of the core rod and bent along an outer face of the core rod (refer to FIG. 1 and the like, for example). Then, the above-described elastic bodies (3, 3', 3") each comprise a first pressure part (11) arranged on an upper face side of the core rod (2), and a first tapered face (21, 21') is formed on a rear face side of the first pressure part, the first tapered face lying obliquely to a direction of extension (D1) of the first pressure part and abutting the outer face of the core rod (refer to FIG. 4, for example). It should be noted that the above-described "direction of extension of the first pressure part" refers to the direction of extension of the front face edge in the vertical cross section of the first pressure part in a non-elastically deformed state.

Figure 7:
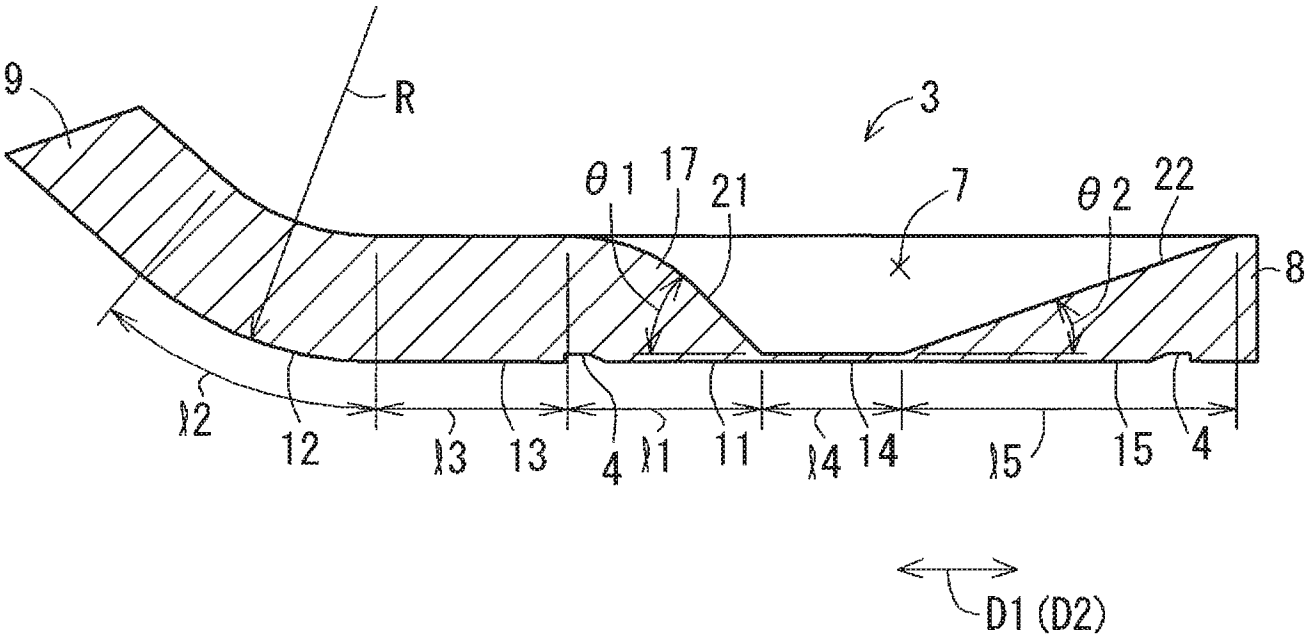
FIG. 7 is a cross-sectional view along line VII-VII in FIG. 6.

An inclination angle (01) of the above-described first tapered face (21, 21') with respect to the first pressure part (11) can be selected as appropriate in correspondence with a pressing force of the first pressure part on a local area near a mastoid (refer to FIG. 7, for example). This inclination angle (θ1) is preferably 30 to 60 degrees from the viewpoint of the pressing force of the first pressure part. Further, for example, the above-described first tapered face (21, 21') can be arranged in a concave part (7) that is indented toward an upper face side and formed on a lower face side of the elastic bodies (3, 3', 3") (refer to FIGS. 5 and 16, for example).

Figure 4:
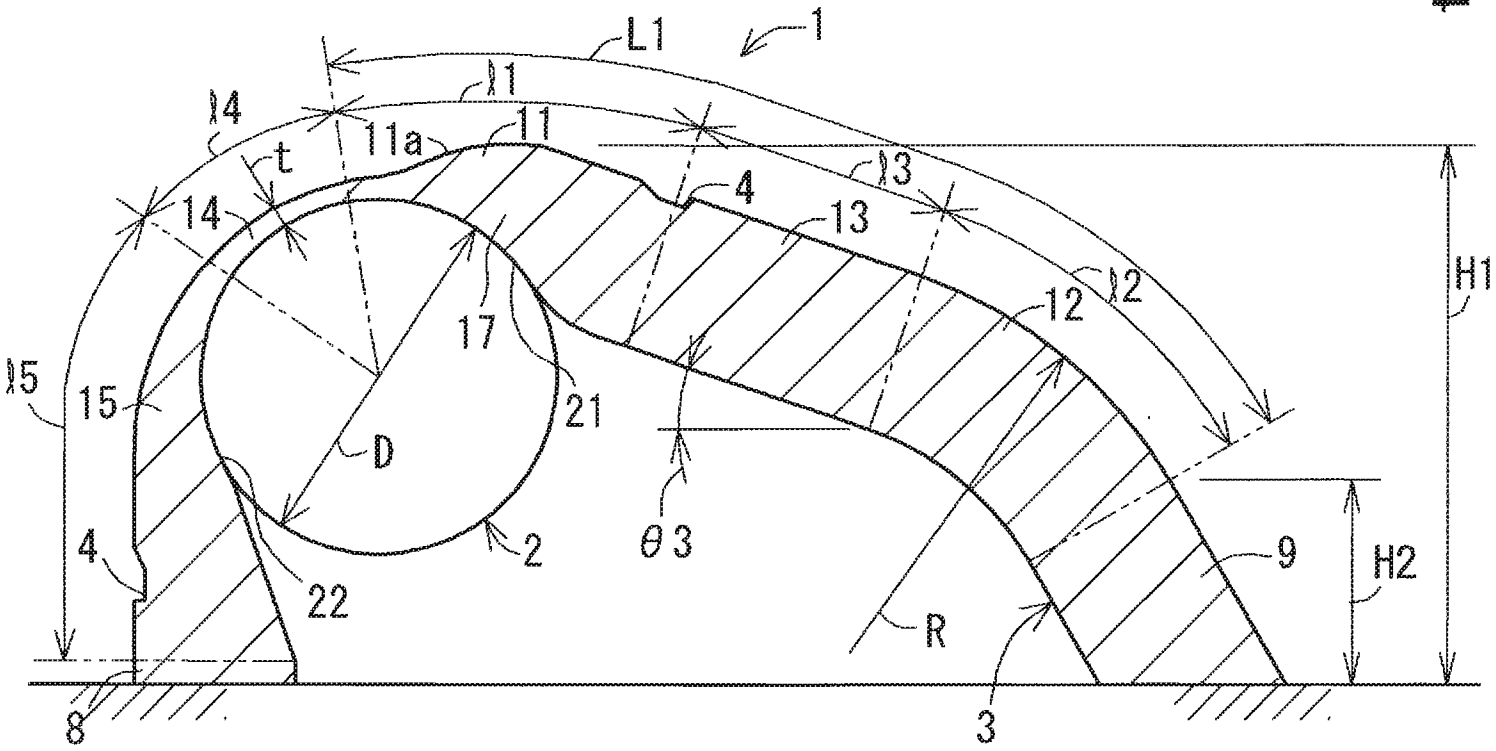
FIG. 4 is an enlarged cross-sectional view along line IV-IV in FIG. 2.

Examples of the acupressure tool according to this embodiment include a form in which the above-described elastic bodies (3, 3', 3") comprise a second pressure part (12) arranged near one end side in a longitudinal direction of the elastic bodies, a front face edge of a vertical cross section of the second pressure part having a substantially curved shape (refer to FIG. 4, for example). It should be noted that the above-described "vertical cross section" refers to the cross section along the longitudinal direction of the elastic bodies. This meaning is similarly applied in the description below.

A radius of curvature (R) of a front face edge of the above-described second pressure part (12) can be selected as appropriate in accordance with the pressure of the second pressure part with respect to an interscapular region and an upper scapular region (refer to FIG. 4, for example). This radius of curvature (R) is preferably 70 to 200 mm from the viewpoint of the pressing force of the second pressure part.

In the case of the aforementioned form, for example, the above-described elastic bodies (3, 3', 3") may further comprise a third pressure part (13) arranged between the first pressure part (11) and the second pressure part (12), a front face edge of a vertical cross section of the third pressure part having a substantially linear shape (refer to FIG. 4, for example).

An inclination angle (θ3) of the front face edge of the above-described third pressure part (13) with respect to horizontality can be selected as appropriate in accordance with the pressing force of the third pressure part with respect to the interscapular region and the upper scapular region (refer to FIG. 4, for example). This inclination angle (θ3) is preferably 10 to 30 degrees from the viewpoint of the pressing force of the third pressure part.

Examples of the acupressure tool according to this embodiment include a form in which the above-described elastic bodies (3, 3', 3") comprise a support part (15) that supports an outer face of the core rod (2) in an upright state, and a second tapered face (22) is formed on a rear face side of the support part, the second tapered face lying obliquely to a direction of extension (D2) of the support part and abutting the outer face of the core rod (refer to FIG. 4, for example). It should be noted that the above-described "direction of extension of the support part" refers to the direction of extension of the front face edge in the vertical cross section of the support part in a non-elastically deformed state.

An inclination angle (θ2) of the above-described second tapered face (22) can be selected as appropriate in accordance with a level of sliding of the support part (15) across the core rod (2) or the like (refer to FIG. 7, for example). This inclination angle (θ2) is preferably 15 to 45 degrees from the viewpoint of the level of sliding of the support part across the core rod. Further, for example, the above-described second tapered face (22) can be arranged in the concave part (7) that is indented toward the upper face side and formed on the lower face side of the elastic bodies (3, 3', 3") (refer to FIG. 5, for example).

In the case of the aforementioned form, examples of the acupressure tool include a form in which the above-described elastic bodies (3, 3', 3") further comprise a fourth pressure part (14) arranged on the upper face side of the core rod (2) between the first pressure part (11) and the support part (15), a thickness (t) of the fourth pressure part being 2 to 5 mm (refer to FIG. 4, for example).

Figure 5:
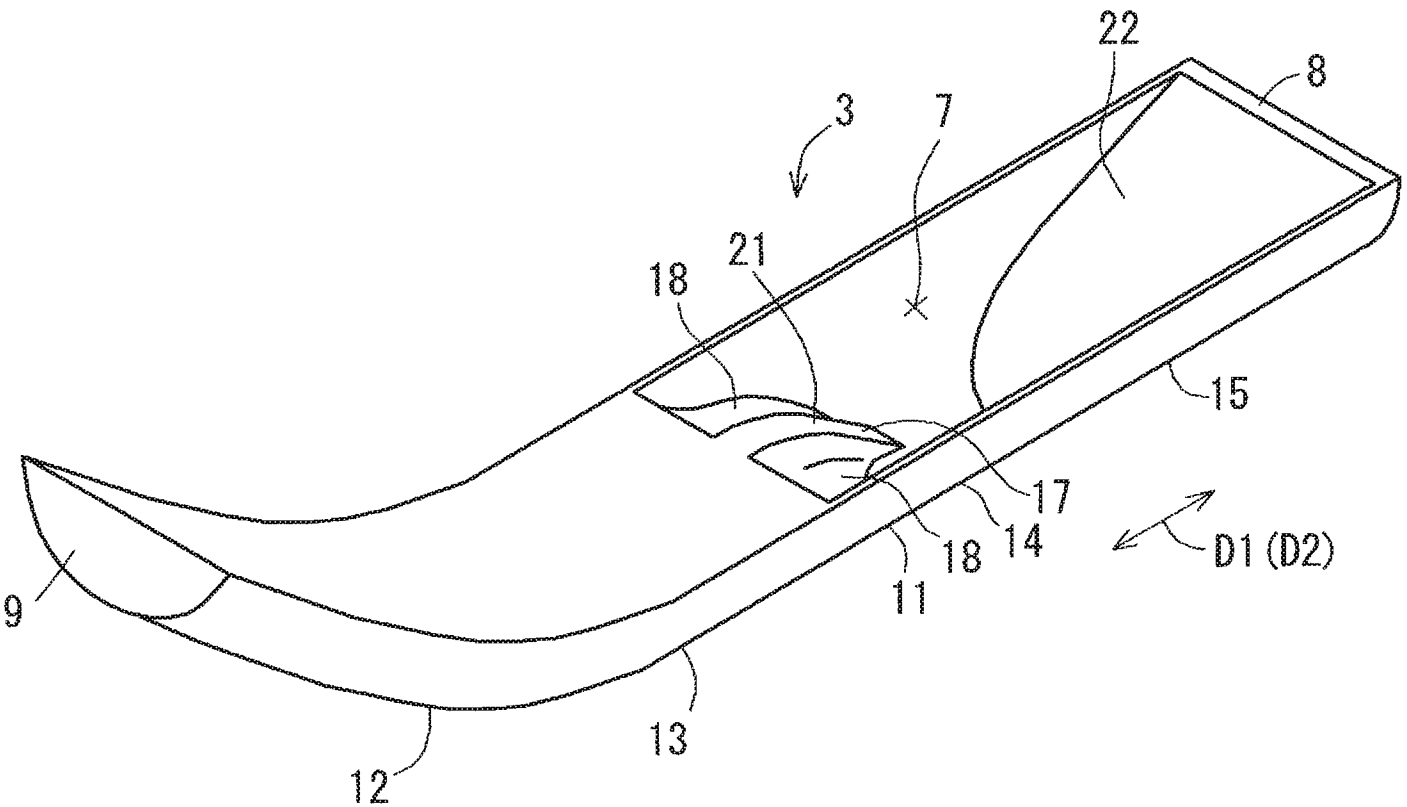
FIG. 5 is a perspective view of an elastic body (non-elastically deformed state) according to the example.

Examples of the acupressure tool according to this embodiment include a form in which a rib (17) that extends in the direction of extension (D1) of the first pressure part is provided on the rear face side of the above-described first pressure part (11), the first tapered face (21) being formed by a lower face of the rib (refer to FIG. 5, for example).

Figure 8:
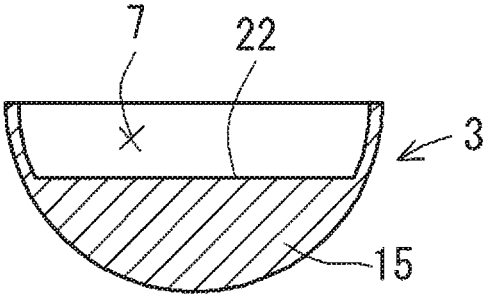
FIG. 8 is an enlarged cross-sectional view along line VIII-VIII in FIG. 6.
Figure 9:
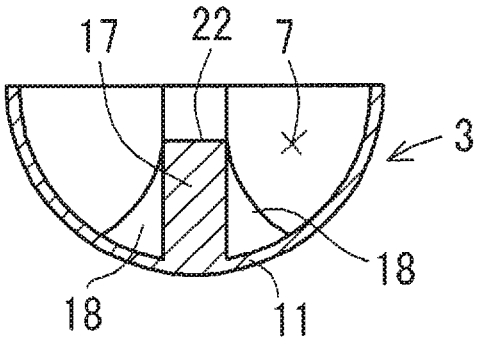
FIG. 9 is an enlarged cross-sectional view along line IX-IX in FIG. 6.

Examples of the acupressure tool according to this embodiment include a form in which the upper face of each of the above-described elastic bodies (3, 3', 3") is formed into a convex curved surface (preferably an arc-shaped convex curved surface) that is upwardly convex in a horizontal cross section (refer to FIGS. 8 and 9, for example). With this arrangement, at least the first pressure part is an upwardly convex curved surface in a vertical cross section and a horizontal cross section of the elastic bodies, and pressure is applied to a local area of the body at a point and not on a line by the first pressure part, increasing the acupressure effect. It should be noted that the above-described "horizontal cross section" refers to the cross section along the direction substantially orthogonal to the longitudinal direction of the elastic bodies.

Acupressure Tool Set

Figure 17:
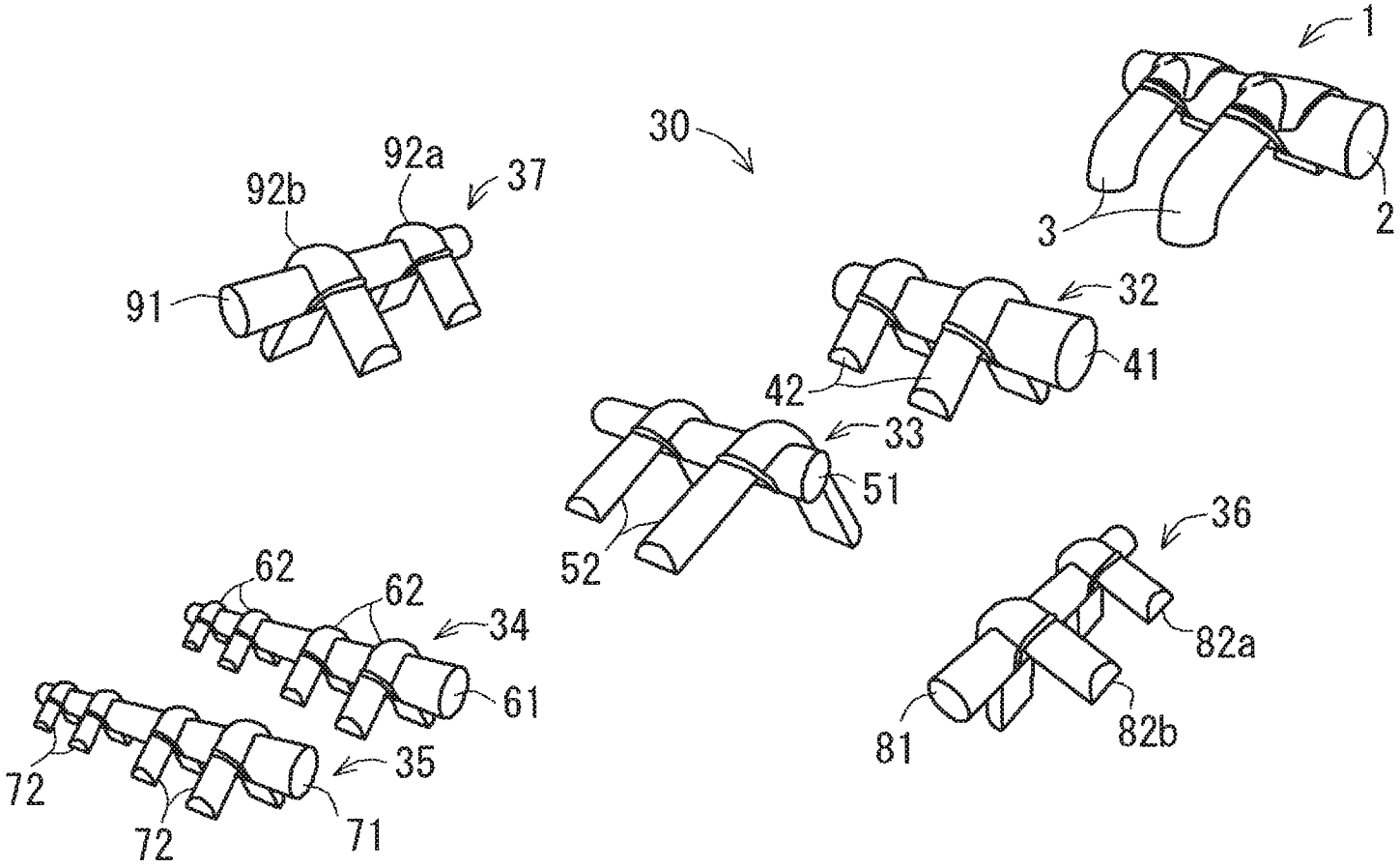
FIG. 17 is a perspective view for explaining an acupressure tool set according to an example.

The acupressure tool set (30) according to this embodiment comprises the aforementioned first acupressure tool (1) for applying pressure to a head region and/or shoulder regions of the body, and another acupressure tool for applying pressure to a section of the body (a section other than the head region of the body, for example) different from the section having pressure applied thereto by the first acupressure tool (refer to FIG. 17, for example). Then, the above-described other acupressure tool comprises a core rod and a pair of long elastic bodies which are attached to the core rod, the elastic bodies being attached to the core rod by being arranged intersecting an axial direction of the core rod and bent along an outer face of the core rod, and an upper face of each of the elastic bodies being formed into a convex curved surface (preferably an arc-shaped convex curved surface) that is upwardly convex in a horizontal cross section (refer to FIGS. 18 to 27, for example). It should be noted that the "horizontal cross section" refers to the cross section along the direction substantially orthogonal to the longitudinal direction of the elastic bodies. This meaning is similarly applied in the description below.

Figure 28:
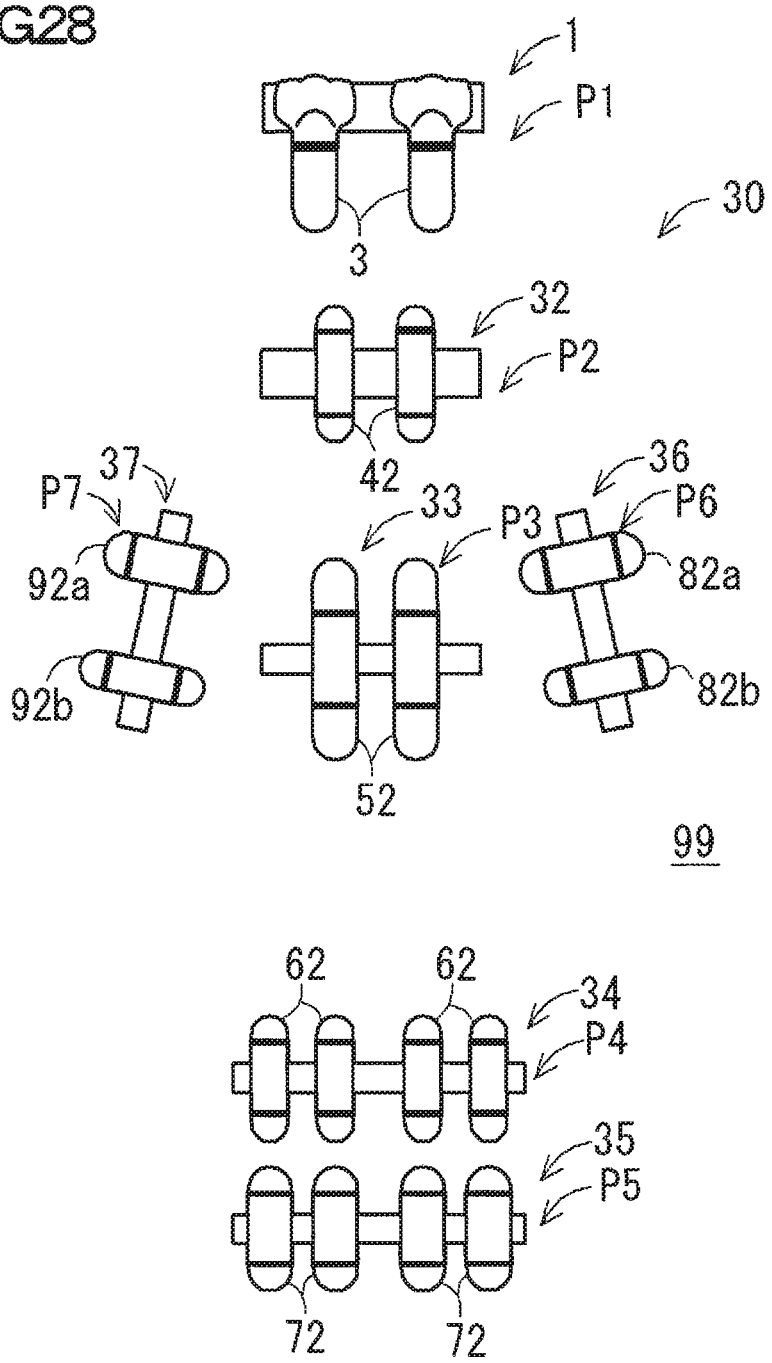
FIG. 28 is an action explanatory view of the acupressure tool set described above.
Figure 29:
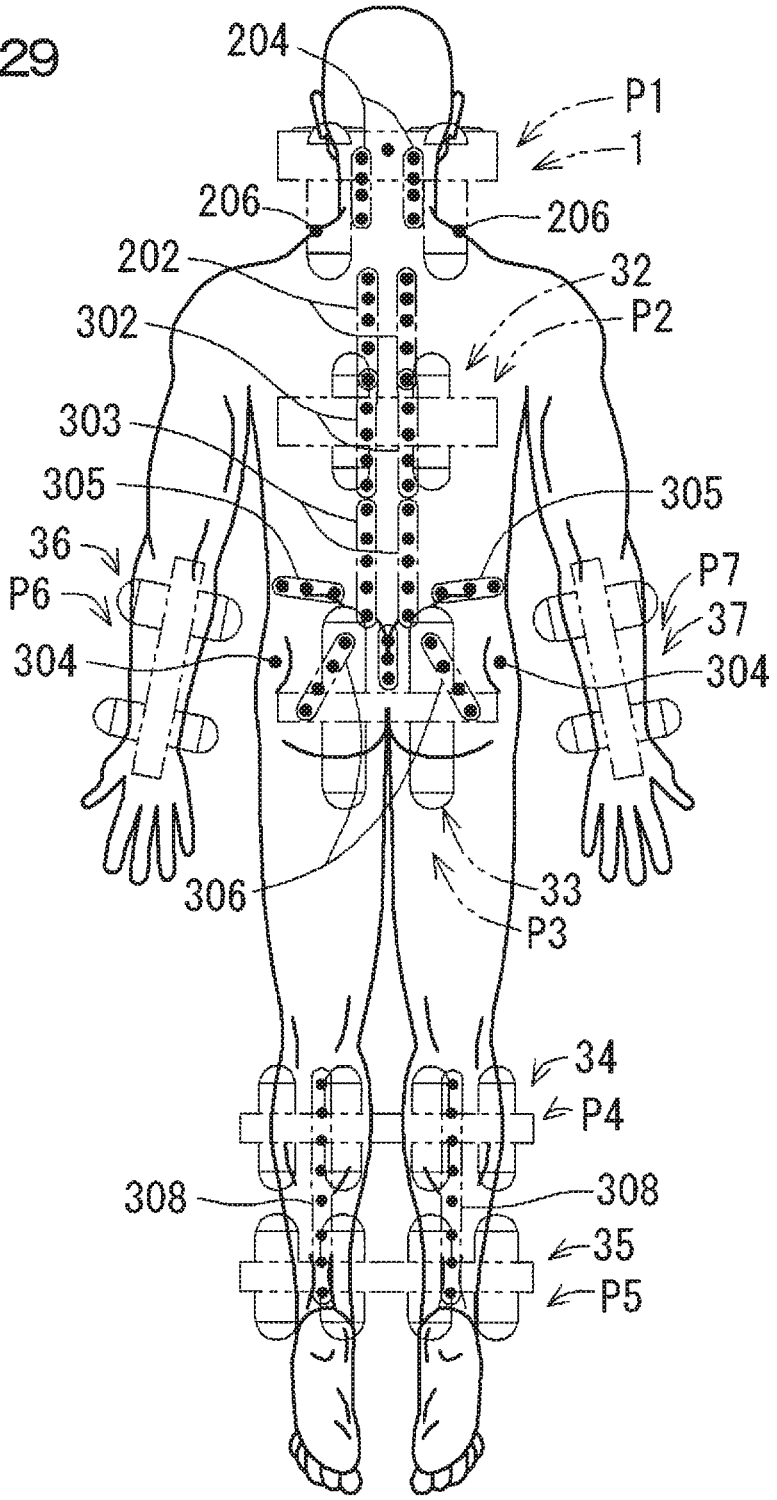
FIG. 29 is an action explanatory view of the acupressure tool set described above, illustrating a position of each acupressure tool as viewed from the back surface of the body.
Figure 30:
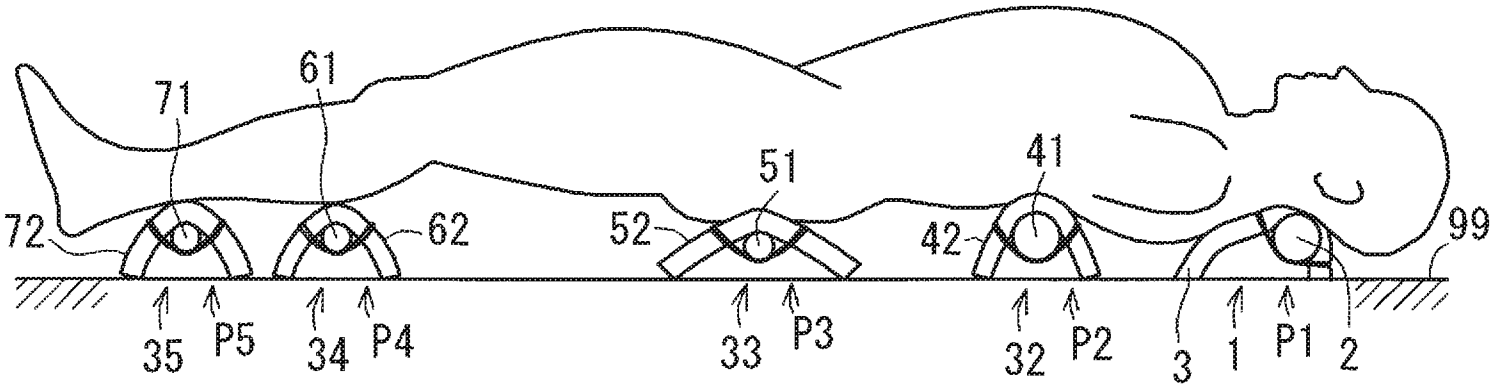
FIG. 30 is an action explanatory view of the acupressure tool set described above, illustrating a position of each acupressure tool as viewed from the side surface of the body.

Examples of the acupressure tool set according to this embodiment include a form in which the above-described other acupressure tool comprises a second acupressure tool (32) for applying pressure to the muscles along the spine of the body (refer to FIGS. 28 to 30, for example).

Examples of the acupressure tool set according to this embodiment include a form in which the above-described other acupressure tool comprises a third acupressure tool (33) for applying pressure to a lumbar region and/or a gluteal region of the body (refer to FIGS. 28 to 30, for example).

Figure 49:
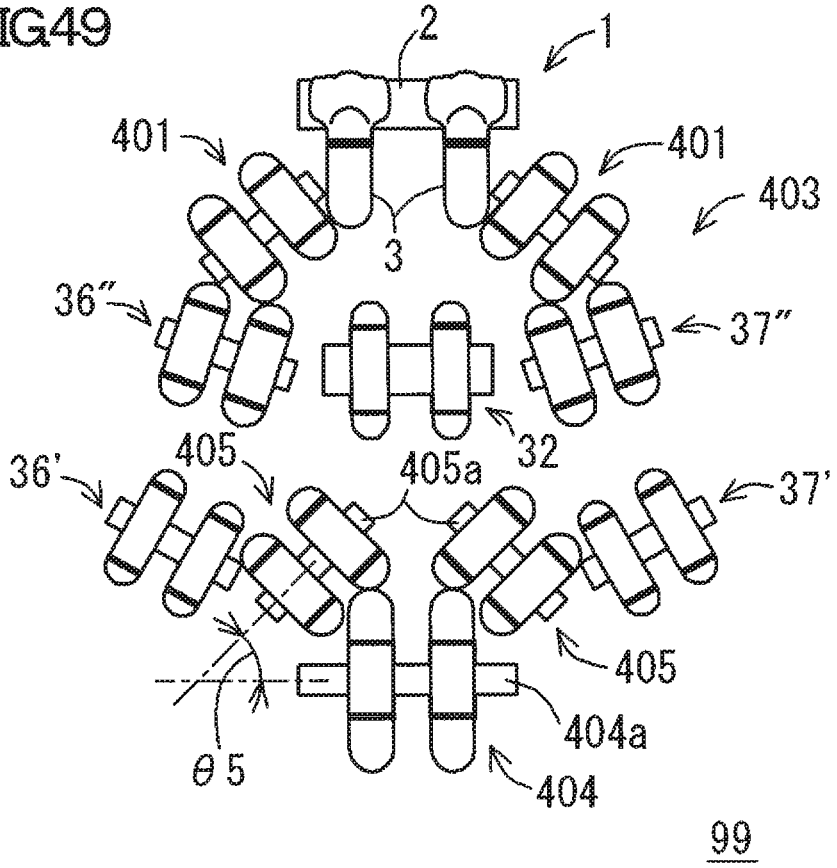
FIG. 49 is a plan view illustrating the disposed relationship of the acupressure tool set according to another modification.
Figure 49:
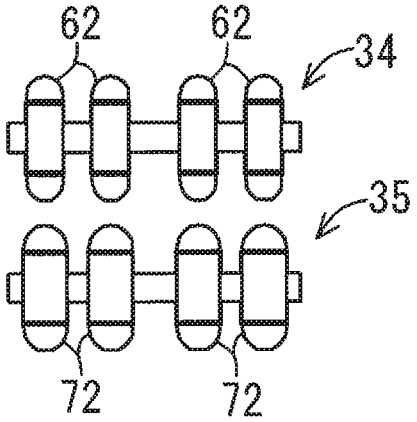
Figure 50:
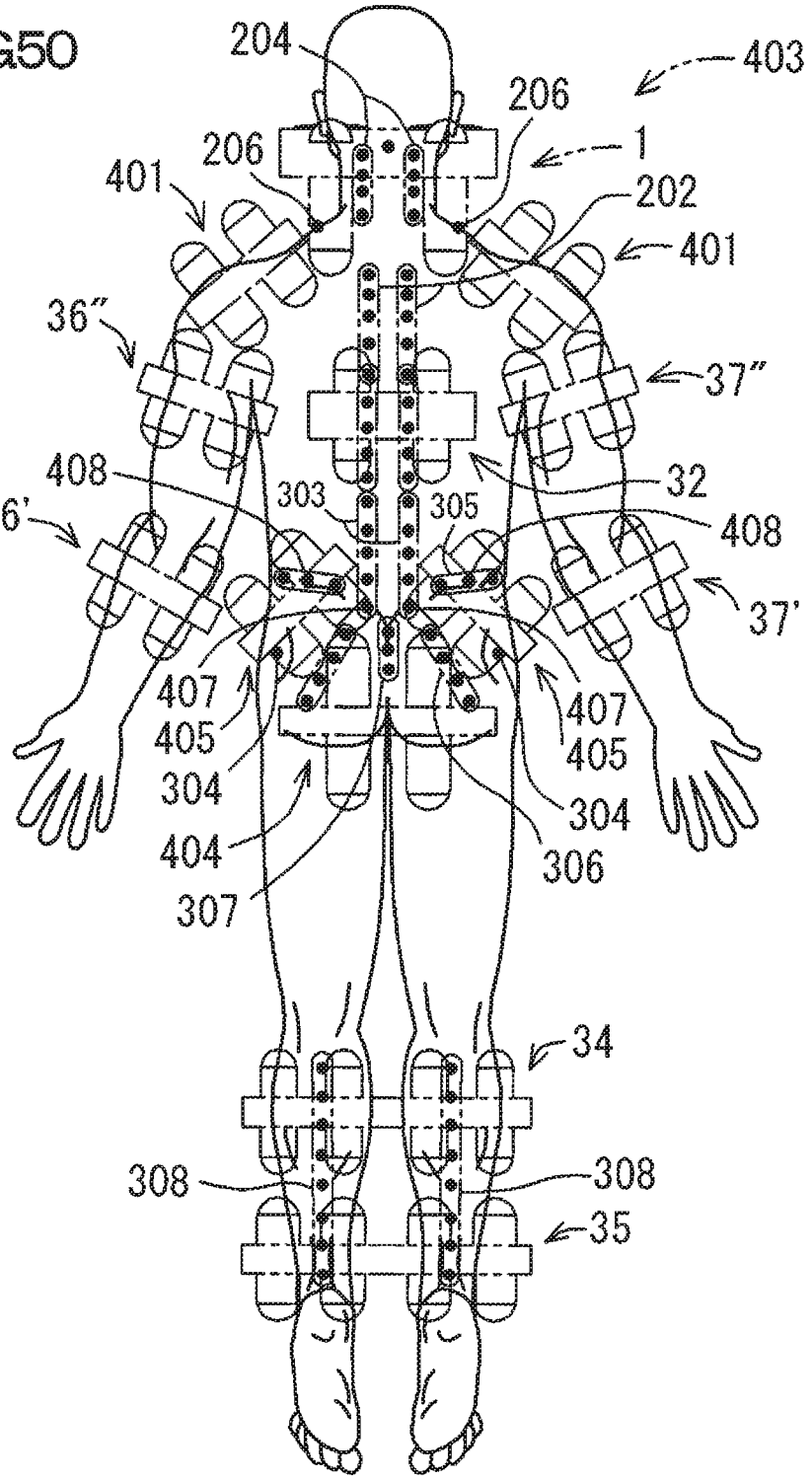
FIG. 50 is an action explanatory view of the acupressure tool set described above, illustrating a position of each acupressure tool as viewed from the back surface of the body.

The above-described third acupressure tool, for example, comprises left and right lateral acupressure tools (405), and each of the lateral acupressure tools (405) may be arranged so that an axial center of a core rod (405*a*) of the lateral acupressure tool lies obliquely to the axial center of the core rod (2) of the first acupressure tool (1) (refer to FIGS. 49 and 50, for example). An angle θ5 (refer to FIG. 49) formed by the axial center of the core rod (405*a*) of this lateral acupressure tool and the axial center of the first acupressure tool (1) (that is, the axial center of a core rod (404*a*) of a center acupressure tool (404)) is, for example 35 to 55° (preferably 40 to 50°).

The above-described third acupressure tool, for example, comprises the above-described left and right lateral acupressure tools (405) and center acupressure tool (404), the center acupressure tool (404) may be arranged so that the axial center of the core rod (404*a*) of the center acupressure tool is parallel with respect to the axial center of the core rod (2) of the first acupressure tool (1) (refer to FIGS. 49 and 50, for example). The above-described left and right lateral acupressure tools (405) are normally arranged on both left and right sides above the center acupressure tool (404). It should be noted that the above-described "parallel" refers to being substantially parallel, and includes cases where the axial center of the core rod of the center acupressure tool lies obliquely to the axial center of the core rod of the first acupressure tool by about ±5 degrees.

Examples of the acupressure tool set according to this embodiment include a form in which the above-described other acupressure tool further comprises a fourth acupressure tool (34) for applying pressure to a calf region of a leg region of the body, and a fifth acupressure tool (35) for applying pressure to an Achilles tendon region of the leg region of the body (refer to FIGS. 28 to 30, for example).

In the case of the aforementioned form, for example, the above-described fourth acupressure tool (34) and fifth acupressure tool (35) may each comprise two pairs of elastic bodies (62, 72) (refer to FIG. 17, for example).

Examples of the acupressure tool set according to this embodiment include a form in which the above-described other acupressure tool further comprises a sixth acupressure tool (36) for applying pressure to a left arm region of the body, and a seventh acupressure tool (37) for applying pressure to a right arm region of the body (refer to FIGS. 28 to 30, for example).

Figure 44:
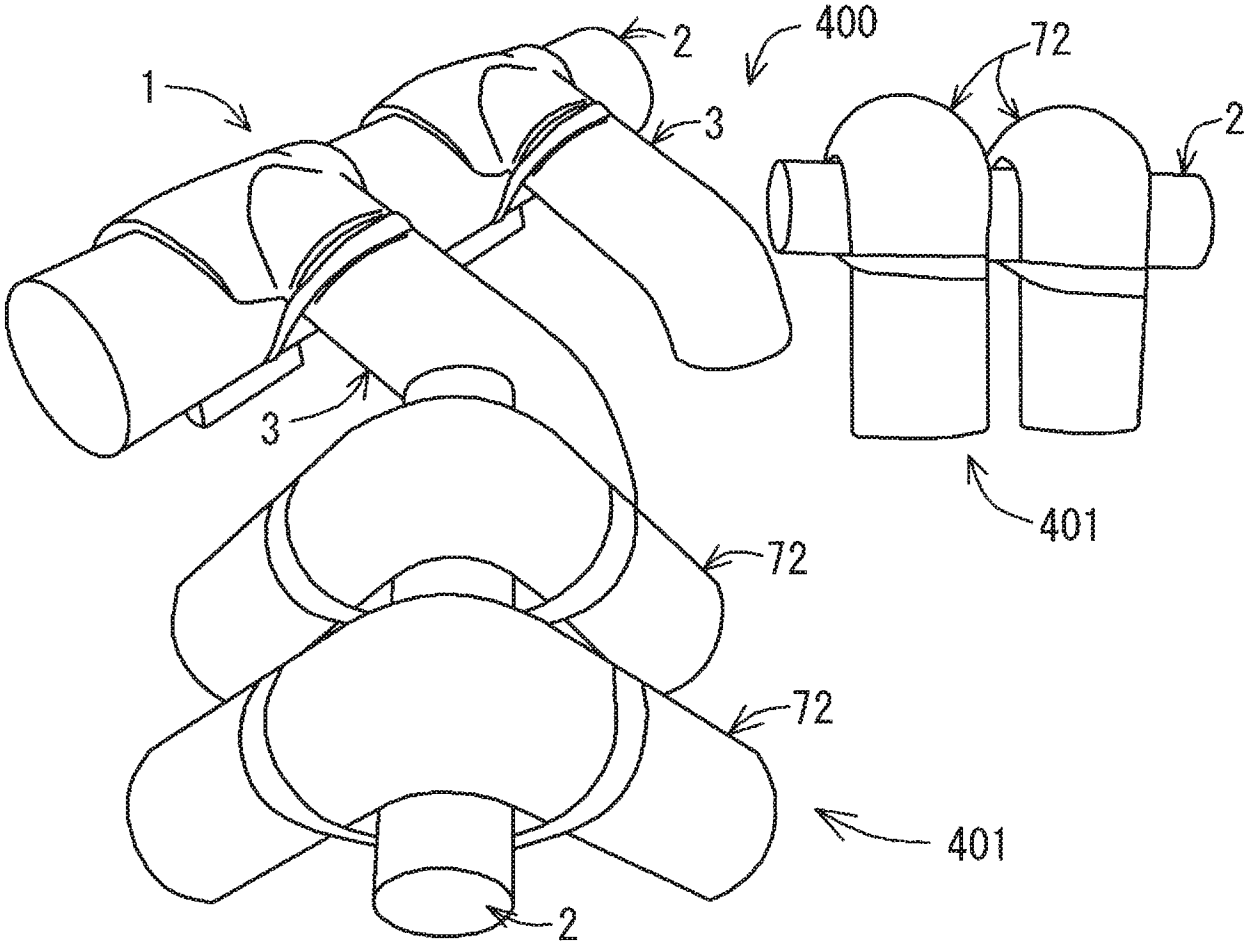
FIG. 44 is a perspective view of the acupressure tool set according to a modification.
Figure 45:
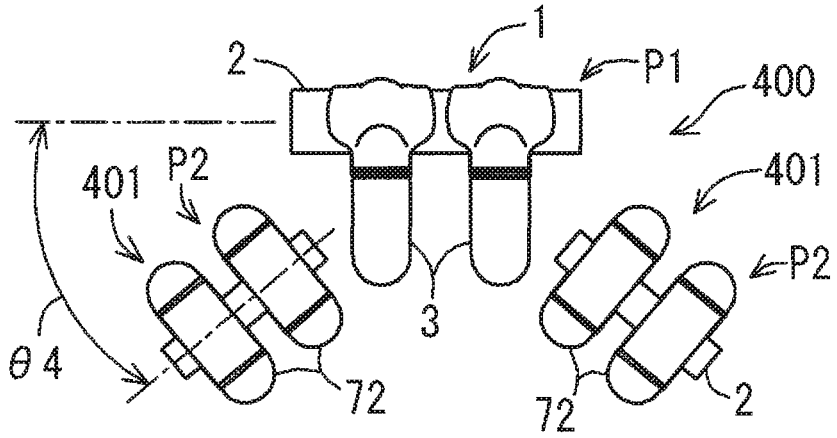
FIGS. 45A and 45B are explanatory views for explaining a disposed relationship of the acupressure tool set described above, FIG. 45A illustrating a planar position of each acupressure tool, and FIG. 45B illustrating a planar position of each acupressure tool as viewed from the back surface of the body.
Figure 45:
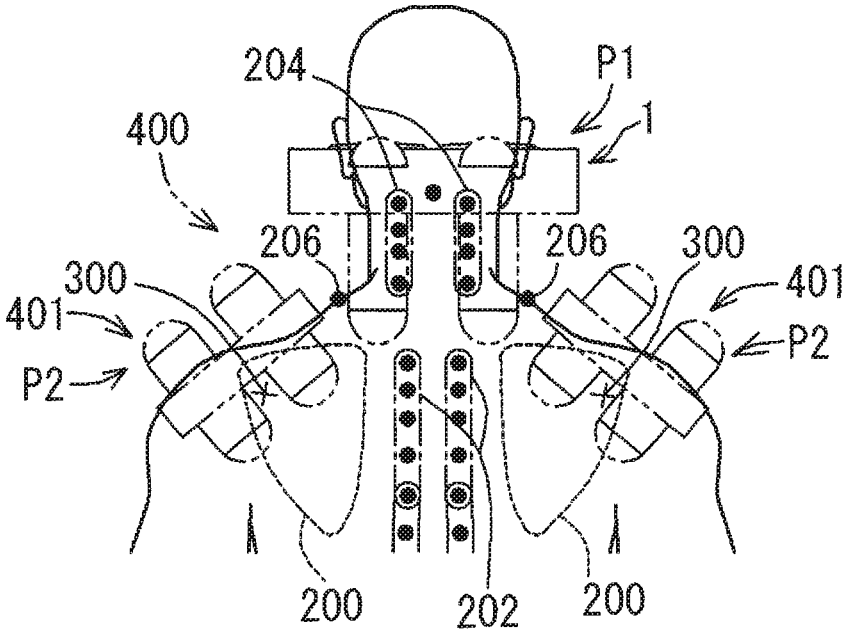
Figure 46:
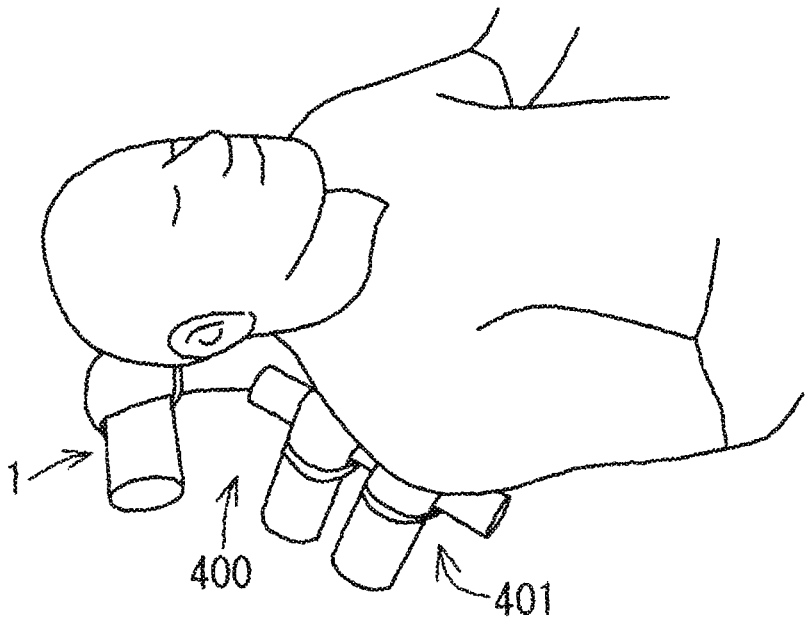
FIGS. 46A and 46B are action explanatory views of the acupressure tool set described above, FIG. 46A illustrating a person lying on his/her back on each acupressure tool, and FIG. 46B illustrating a person lying on his/her side on each acupressure tool.
Figure 46:
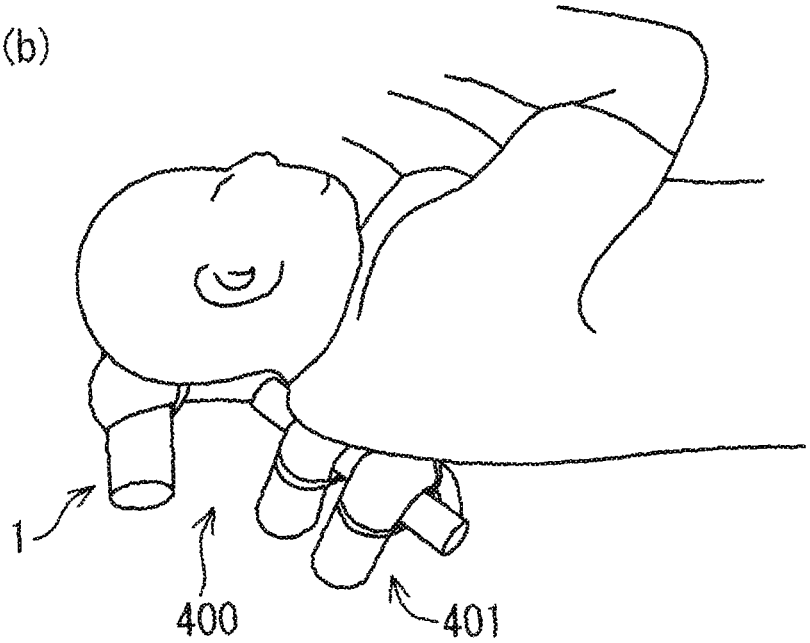

Examples of the acupressure tool set according to this embodiment include a form in which the above-described other acupressure tool further comprises left and right shoulder acupressure tools (401) for applying pressure to the shoulder regions of the body (refer to FIGS. 44 to 46, for example). These shoulder acupressure tools (401) are normally arranged on both the left and right sides below the first acupressure tool (1).

Method for Arranging Acupressure Tool Set

The method for arranging the acupressure tool set according to this embodiment is a method for arranging the aforementioned acupressure tool set (30), comprising the steps of arranging the above-described first acupressure tool (1) in a first predetermined position (P1) on an installation surface (99) so that the head region and/or the shoulder regions of the body are placed thereon, and arranging the other acupressure tool in another predetermined position (P2 to P7) on the installation surface so that a section of the body (a section other than the head region of the body, for example) different from the section having pressure applied thereto by the first acupressure tool is placed thereon (refer to FIGS. 28 to 30, for example). It should be noted that the above-described "predetermined position" is a position determined in accordance with a physique and the like of a user.

It should be noted that the reference numerals in the parentheses of each configuration described in the above-described embodiment indicate corresponding relationships with specific configurations described in examples described later.

Examples

The following specifically describes the present invention by examples using the drawings.

Acupressure Tool

(1) Configuration of Acupressure Tool

Figure 2:
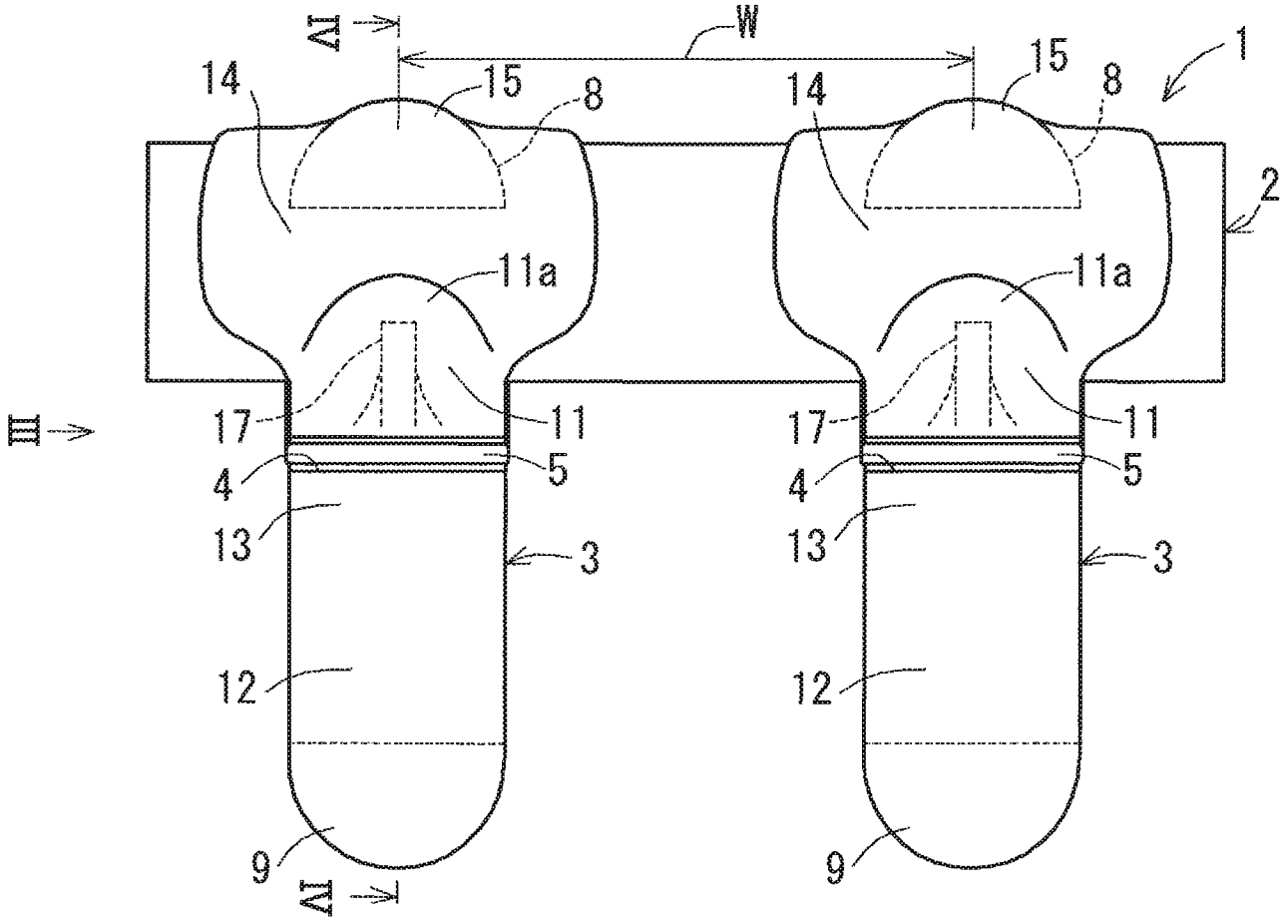
FIG. 2 is a plan view of the acupressure tool described above.
Figure 3:
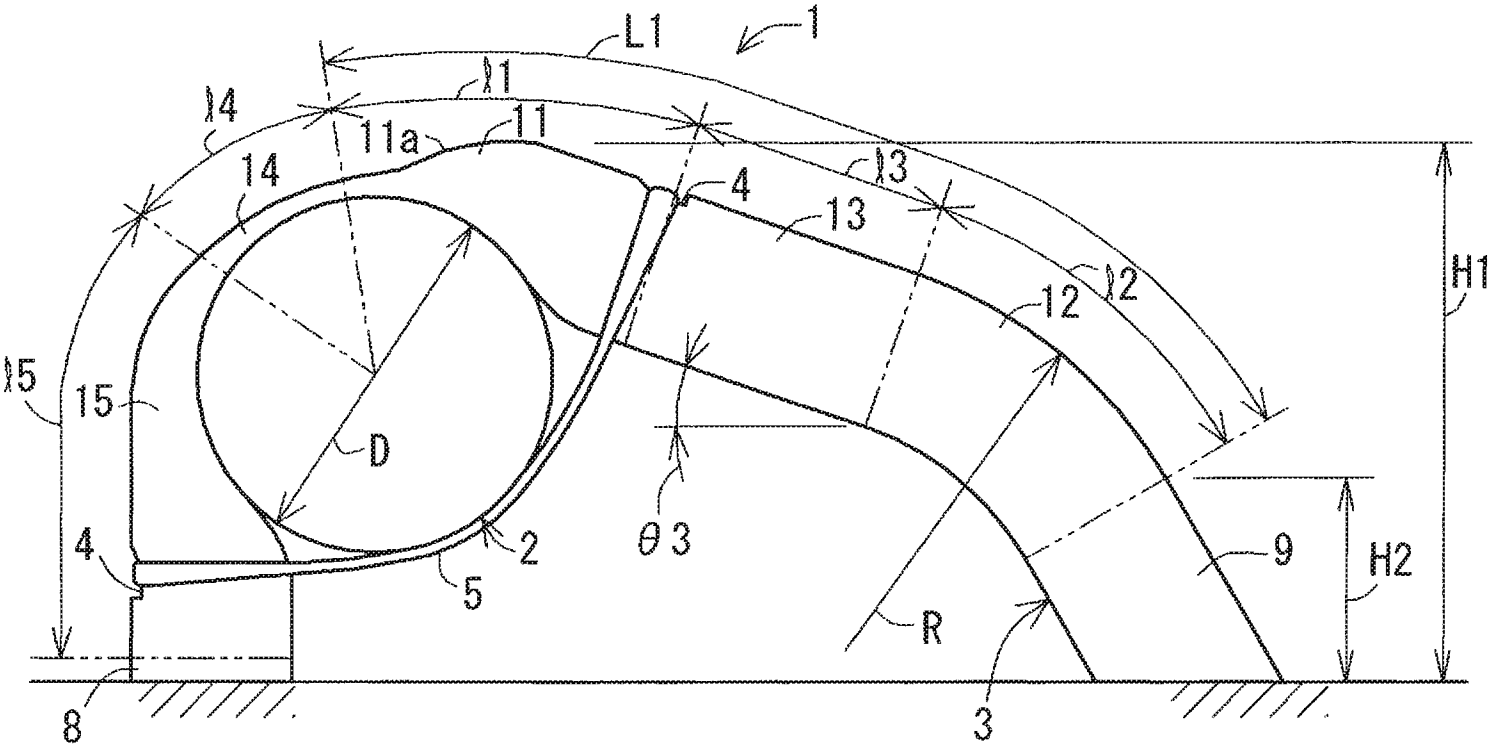
FIG. 3 is an enlarged view in the direction of arrow III in FIG. 2.

The acupressure tool 1 according to this example, as illustrated in FIGS. 1 to 3, comprises the core rod 2, round and made of wood, and the pair of elastic bodies 3, long and made of rubber, attached to this core rod 2. Each of these elastic bodies 3 is disposed so as to intersect (substantially orthogonally) an axial direction of the core rod 2, bent along an outer face of the core rod 2, and attached to the core rod 2. This core rod 2 has a diameter D (refer to FIG. 3) of approximately 66 mm, and a length in the axial direction of approximately 300 mm.

A groove 4 that extends in a circumferential direction is formed on a front face side of each of the above-described elastic bodies 3, as illustrated in FIGS. 1 to 3. A string 5 is inserted through these grooves 4 and wrapped around the core rod 2 and the elastic bodies 3, thereby integrally connecting both 2 and 3. A left and right interval width W (refer to FIG. 2) between the pair of elastic bodies 3 is set to a value (approximately 160 mm, for example) that matches a distance between left and right ears of the head region. The value of this left and right interval width W can be easily adjusted by changing a connection state of the core rod 2 and the elastic bodies 3 by the string 5.

Each of the above-described elastic bodies 3, as illustrated in FIGS. 5 to 9, has a horizontal cross section that is substantially semicircular in shape, and a uniform horizontal width across the longitudinal direction thereof. The front face (upper face) of each of the elastic bodies 3 is formed into a convex curved surface that is upwardly convex in a horizontal cross section. Further, the concave part 7 indented toward the front face side is formed on the rear face side of the elastic bodies 3.

The above-described elastic bodies 3, as illustrated in FIG. 4, each serve as legs 8 and 9 that can be grounded to the installation surface of a floor or the like on both end sides in the longitudinal direction. A height of this leg 8 is set to approximately 5 mm, and a height H2 of the leg 9 is set to approximately 40 mm. Furthermore, the elastic bodies 3 each comprise the first pressure part 11, the second pressure part 12, the third pressure part 13, the fourth pressure part 14, and the support part 15. It should be noted that the above-described concave part 7 is formed in an area that extends across the first pressure part 11, the fourth pressure part 14, and the support part 15 of the elastic body 3.

Figure 6:
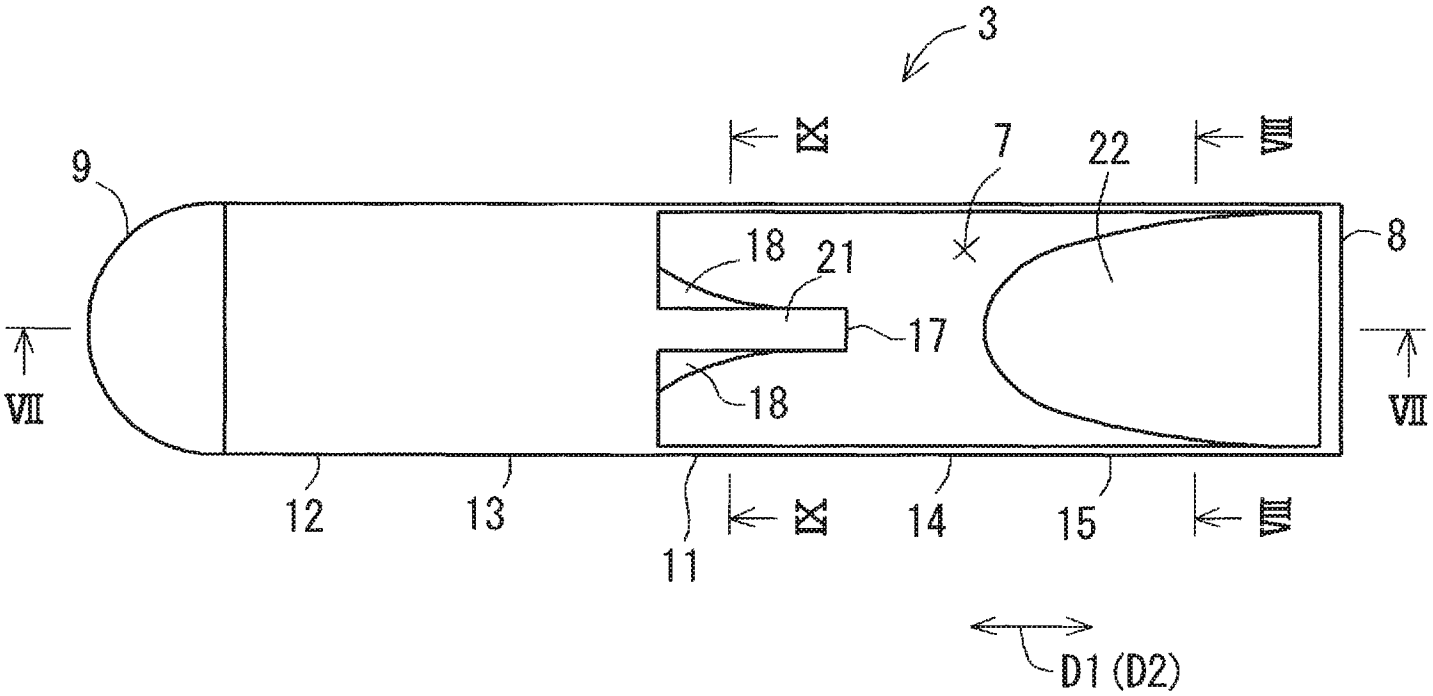
FIG. 6 is a plan view of the elastic body described above as viewed from a rear face side.

The above-described first pressure part 11 is arranged on an upper face side of the core rod 2, as illustrated in FIG. 4. This first pressure part 11 is mainly used for applying pressure to a local area P (refer to FIG. 17C) near a mastoid 210 of the body. Further, the rib 17 (that is, the plate-shaped part 17 erected from a bottom face of the concave part 7) that extends along the direction of extension D1 of the first pressure part 11 is provided on the rear face side of the first pressure part 11, as illustrated in FIGS. 5 to 7. Reinforcement parts 18, each extending in a curved shape, are provided to lateral face sides of this rib 17. Then, a lower face of this rib 17, as illustrated in FIG. 7, is established as the first tapered face 21 that lies obliquely at predetermined inclination angle θ1 (approximately 45 degrees, for example) to the direction of extension D1 of the first pressure part 11. This first tapered face 21 abuts the outer peripheral face of the core rod 2, thereby forming a convex curved surface part 11*a* (refer to FIG. 1) on the front face side of the first pressure part 11.

The above-described second pressure part 12 is arranged near one end side in the longitudinal direction of the elastic body 3 (that is, in a position adjacent to the leg 9), as illustrated in FIG. 4. This second pressure part 12 is mainly used for applying pressure to an interscapular region 202 and an upper scapular region 206 (refer to FIG. 17A) of the body. Further, the front face edge of the vertical cross section of the second pressure part 12 is substantially curve shaped (that is, a curve shaped that is upwardly convex). Furthermore, the radius of curvature R of the front face edge of the second pressure part 12 is set to approximately 85 mm.

The above-described third pressure part 13 is arranged between the first pressure part 11 and the second pressure part 12, as illustrated in FIG. 4. This third pressure part 13 is mainly used for applying pressure to the interscapular region 202 (refer to FIG. 17A) of the body. Further, the front face edge of the vertical cross section of the third pressure part 13 has a substantially linear shape. Furthermore, the inclination angle θ3 with respect to horizontality of the front face edge of the third pressure part 13 is approximately 20 degrees.

The above-described fourth pressure part 14, as illustrated in FIG. 4, is arranged on the upper face side of the core rod 2 between the first pressure part 11 and the support part 15. This fourth pressure part 14 is mainly used for applying pressure to the head region of the body. Further, a thickness of the fourth pressure part 14 is approximately 2 mm. Furthermore, the fourth pressure part 14 has a wide width compared to the other first to third pressure parts 11 to 13 by being wrapped around the core rod 2 (refer to FIG. 1).

The above-described support part 15 is arranged between the fourth pressure part 14 and the leg 8, as illustrated in FIG. 4. This support part 15 is in an upright state with the acupressure tool 1 placed on the installation surface of a floor or the like (that is, with the legs 8 and 9 of the elastic bodies 3 grounded to the installation surface). Further, the second tapered face 22 that lies obliquely at the predetermined inclination angle θ2 (approximately 20 degrees, for example) to the direction of extension D2 of the support part 15 is formed on the rear face side of the support part 15, as illustrated in FIG. 7. This second tapered face 22 abuts the outer peripheral face of the core rod 2, causing the core rod 2 to be supported by the support part 15. Further, the second tapered face 22 extends across substantially the entire length in a width direction of the support part 15 (refer to FIG. 5).

Here, as illustrated in FIG. 4, a contact area L1 by the first and the second pressure parts 11 and 12 according to a length of a neck can be adjusted. The adjustment of this contact area L1 is mainly implemented by changing the values of a length l3 of the third pressure part 13, a length l2 of the second pressure part 12, and the radius of curvature R of the second pressure part 12. Further, an overall height H1 according to a size of the body can be adjusted. The adjustment of this height H1 is mainly implemented by changing the values of the length l2 of the second pressure part 12, the radius of curvature R of the second pressure part, a length l5 of the support part 15, and the diameter D of the core rod.

(2) Action of Acupressure Tool

Figure 10:
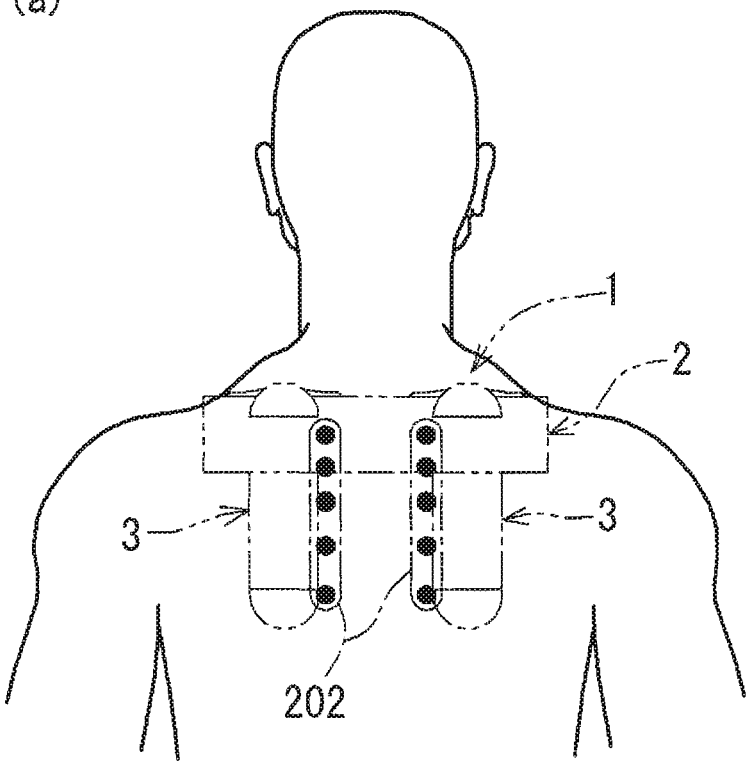
FIGS. 10A and 10B are action explanatory views of the acupressure tool described above, FIG. 10A illustrating a position of the acupressure tool as viewed from a back surface of the body, and FIG. 10B illustrating a position of the acupressure tool as viewed from a side surface of the body.
Figure 10:
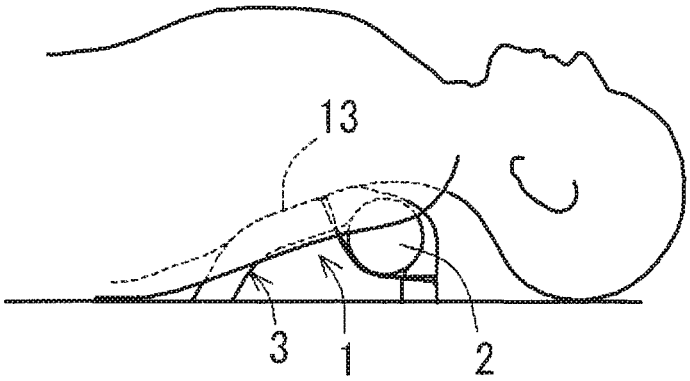

Next, the action of the acupressure tool 1 of the above-described configuration will be described. First, the acupressure tool 1 is placed on the installation surface such as a floor and the user lies on his/her back on the acupressure tool. Then, as illustrated in FIGS. 10A and 10B, the interscapular regions 202 of the user are placed on the third pressure parts 13 of the pair of elastic bodies 3 and, in this state, the user leans a part of his/her weight on the third pressure parts 13. Then, pressure is applied to the interscapular regions 202 by the third pressure parts 13.

Figure 11:
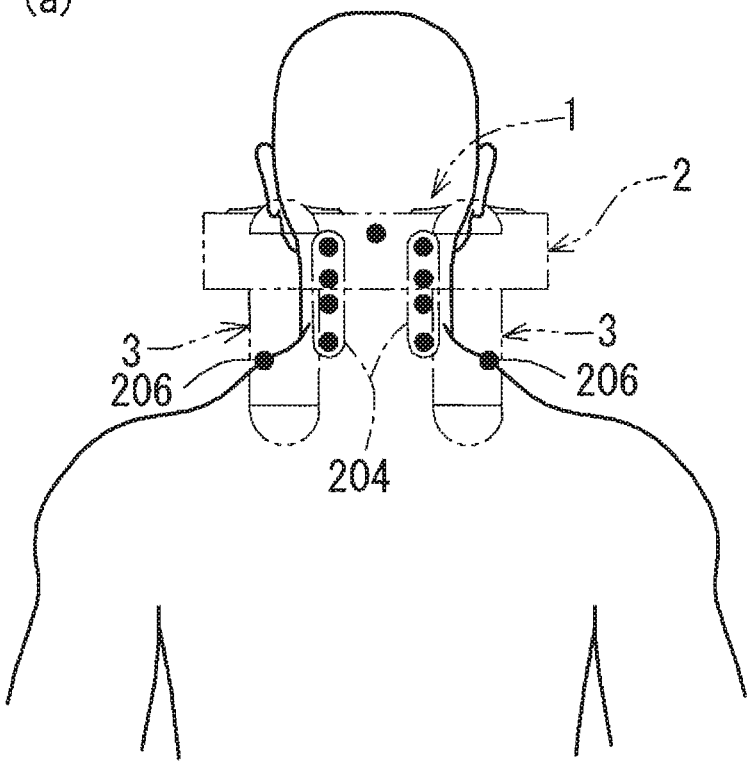
FIGS. 11A and 11B are action explanatory views of the acupressure tool described above, FIG. 11A illustrating the position of the acupressure tool as viewed from the back surface of the body, and FIG. 11B illustrating the position of the acupressure tool as viewed from the side surface of the body.
Figure 11:
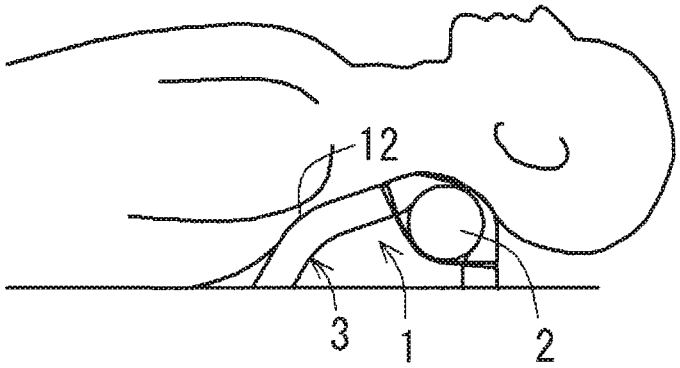

Next, as illustrated in FIGS. 11A and 11B, the area from the upper half of the interscapular regions 202 to the upper scapular regions 206 of the user is placed on the second pressure parts 12 of the pair of elastic bodies 3 and, in this state, the user leans a part of his/her weight on the second pressure parts 12. Then, pressure is applied from the interscapular regions 202 to the upper scapular regions 206 by the second pressure parts 12.

Figure 12:
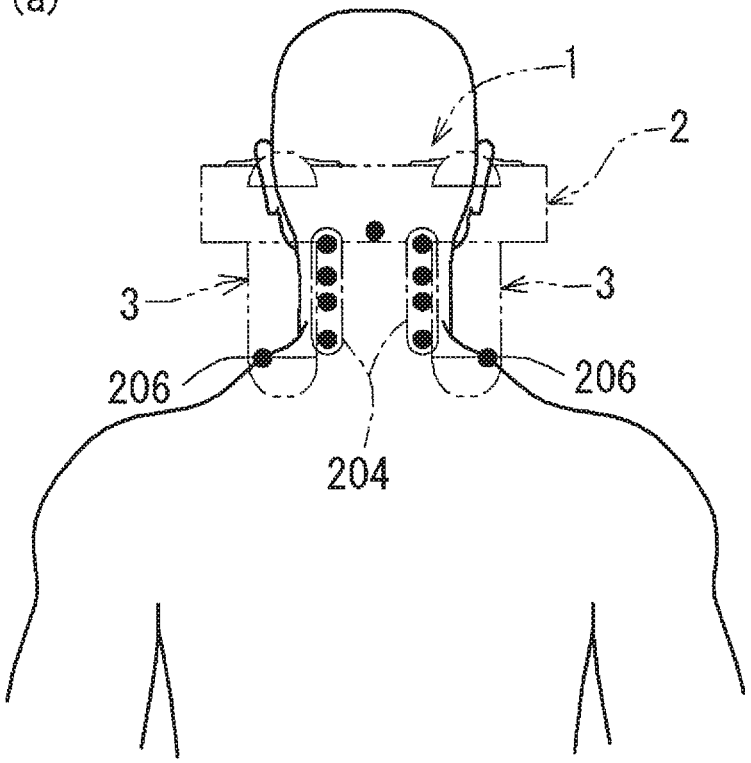
FIGS. 12A and 12B are action explanatory views of the acupressure tool described above, FIG. 12A illustrating the position of the acupressure tool as viewed from the back surface of the body, and FIG. 12B illustrating the position of the acupressure tool as viewed from the side surface of the body.
Figure 12:
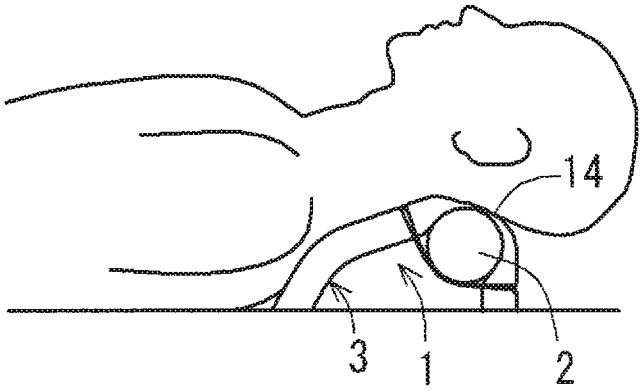
Figure 13:
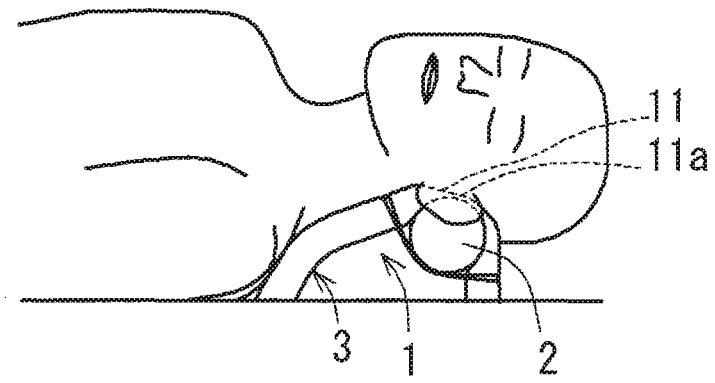
FIG. 13 is an action explanatory view of the acupressure tool described above.

Subsequently, as illustrated in FIGS. 12A and 12B, the head region of the user is placed on the fourth pressure parts 14 of the pair of elastic bodies 3 and, in this state with a face of the user facing upwards, the user leans a part of his/her weight on the fourth pressure parts 14. Then, pressure is applied to the head region by the fourth pressure parts 14. From this state, as illustrated in FIG. 13, the face of the user is turned sideways, an ear bone periphery of the user is placed on the first pressure part 11 of one of the elastic bodies 3 and, in this state, the user leans a part of his/her weight on the first pressure part 11. Then, pressure is applied to the local area P near the mastoid by the convex curved surface part 11*a* of the first pressure part 11.

Figure 14:
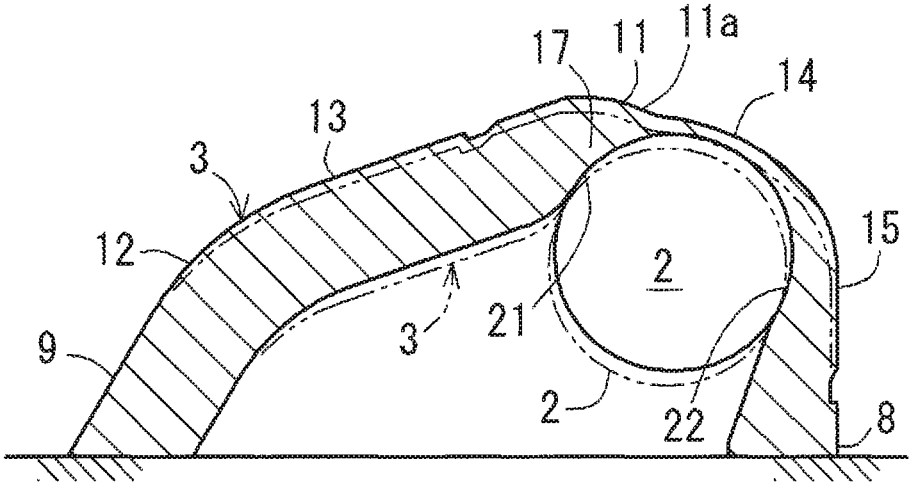
FIG. 14 is an action explanatory view of the acupressure tool described above.

It should be noted that, when the head region and the shoulder regions are placed on the front face sides of the elastic bodies 3 as described above, the core rod 2 slides across the second tapered face 22 of the support part 15 and the elastic bodies 3 overall elastically deform in a vertical direction by the gravity thereof, as indicated by the imaginary lines in FIG. 14.

(3) Effect of Example

From the above, according to the acupressure tool 1 of this example, the acupressure tool 1 comprises the core rod 2 and the pair of long elastic bodies 3 which are attached to the core rod 2, the elastic bodies 3 being attached to the core rod 2 by being arranged intersecting the axial direction of the core rod 2 and bent along the outer face of the core rod 2. Then, the elastic bodies 3 each comprise the first pressure part 11 arranged on the upper face side of the core rod 2, and the first tapered face 21 is formed on the rear face side of the first pressure part 11, the first tapered face 21 lying obliquely to the direction of extension D1 of the first pressure part 11 and abutting the outer face of the core rod 2. With this arrangement, when the head region and the shoulder regions are placed on the front face sides of the elastic bodies 2, the resulting elastic deformation of the elastic bodies 3 caused by gravity and the softness of the elastic bodies 3 themselves loosen muscles and improve circulation, achieving effects similar to those of acupressure. Further, the first tapered face 21 on the rear face side of the first pressure part 11 abuts the outer face of the core rod 2, forming a convex curved surface part 11*a* on the front face side of the first pressure part 11. As a result, when the head region and the shoulder regions are placed on the front face side of the elastic bodies 3, it is possible to accurately identify the local area P near the mastoids by the first pressure parts 11 and apply pressure using an appropriate pressing force. This makes it possible to remove or alleviate stiff shoulders.

In particular, according to the acupressure tool 1 of this example, an amateur can reliably take care of his/her own body on par with a skilled person. For example, the user can remove stiff shoulders and pass the time without awareness of stiff shoulders for a favorable period of time each day. This makes it possible to prevent illness originating from stiff shoulders and contribute to a reduction in medical fees. Further, according to the acupressure tool 1 of this example, pressure is simultaneously applied to the head region and the shoulder regions at two points or four points, and thus the user has the sensation of receiving acupressure by a total of two chiropractors, one applying pressure to the head region and the other to the shoulder regions. Further, according to the acupressure tool 1 of this example, the head region of the user is placed on one of the elastic bodies 3 of the pair of elastic bodies 3 and the user leans a part of his/her weight on the elastic body 3, making it possible to apply pressure to the local area P near the mastoid by the first pressure part 11 and achieve a strong acupressure effect. Further, by increasing the horizontal width of the elastic bodies 3, it is also possible to use the acupressure tool 1 as a pillow for restful and sound sleep for a long period of time. Furthermore, identifying and applying pressure to the local area P near the mastoid by the first pressure part 11 results in identification and pressure application to an acupressure point of a vital energy source, achieving a wonderful health promotion effect.

It should be noted that the local area P near the above-described mastoid is an all-purpose super spot of nerves. The local area P communicates to the entire body, stimulating the nerves throughout the body. Further, this local area P is a switch for vital energy as well as a switch for health energy. Applying pressure to this area every day makes the body healthier and further stabilizes the spirit. Furthermore, applying pressure smoothens the nerve flow and strengthens health.

Further, according to the acupressure tool 1 of this example, the elastic bodies 3 each further comprise the second pressure part 12 arranged near the one end side in the longitudinal direction of the elastic bodies 3, the second pressure part 12 having a front face edge in a vertical cross section that is substantially curved in shape. With this arrangement, when the shoulder regions having a curved surface shape (the interscapular regions 202 or the upper scapular regions 206, for example) are placed on the front face sides of the second pressure parts 12, each of the second pressure parts 12 contacts the shoulder region at a point, making it possible to strongly apply pressure to the shoulder region. This makes it possible to thoroughly apply pressure to all sections of the curved surface area, from the upper scapular region 206 to the interscapular region 202.

Further, according to the acupressure tool 1 of this example, the elastic bodies 3 each further comprise the third pressure part 13 arranged between the first pressure part 11 and the second pressure part 12, the third pressure part 13 having the front face edge in the vertical cross section that is substantially linear in shape. With this arrangement, when the shoulder regions (the interscapular regions 202, for example) are placed on the front face side of the third pressure parts 13, each of the third pressure parts 13 contacts the shoulder region on a line, making it possible to softly apply pressure to the shoulder region.

Further, according to the acupressure tool 1 of this example, the elastic bodies 3 each further comprise the support part 15 that supports the outer face of the core rod 2 in an upright state, and the second tapered face 22 is formed on the rear face side of the support part 15, the second tapered face 22 lying obliquely to the direction of extension D2 of the support part 15 and abutting the outer face of the core rod 2. With this arrangement, when the head region and the shoulder regions are placed on the front face sides of the elastic bodies 3, the support part 15 elastically deforms and the core rod 2 slides across the second tapered face 22, making it possible to more accurately identify the local areas P near the mastoids by the first pressure part 11 and further apply pressure using an appropriate pressing force. Furthermore, the second tapered face 22 can increase a strength of the support part 15.

Further, according to the acupressure tool 1 of this example, the elastic bodies 3 each further comprise the fourth pressure part 14 arranged on the upper face side of the core rod 2 between the first pressure part 11 and the support part 15, the fourth pressure part 14 having a thickness of 2 to 5 mm. With this arrangement, when the head region is placed on the front face sides of the fourth pressure parts 14, the fourth pressure part 14 having a thin thickness can softly apply pressure to the head region.

Furthermore, according to the acupressure tool 1 of this example, the rib 17 that extends in the direction of extension D1 of the first pressure part 11 is provided on the rear face side of the first pressure part 11, the first tapered face 21 being formed by the lower face of the rib 17. With this arrangement, the first pressure part 11 can more accurately identify the local area P near the mastoid and further apply pressure using an appropriate pressing force.

Furthermore, according to the acupressure tool 1 of this example, the first tapered face 21 is arranged in the concave part 7 indented toward the upper face side and formed on the lower face side of each of the elastic bodies 3. With this arrangement, the first tapered face 21 can be easily formed. Furthermore, according to the acupressure tool 1 of this example, the second tapered face 22 is arranged in the concave part 7 indented toward the upper face side and formed on the lower face side of each of the elastic bodies 3. With this arrangement, the second tapered face 22 can be easily formed.

Acupressure Tool Set

(1) Configuration of Acupressure Tool Set

The acupressure tool set 30 according to this example, as illustrated in FIG. 17, comprises the aforementioned first acupressure tool 1 (refer to FIG. 1), and the second acupressure tool 32, the third acupressure tool 33, the fourth acupressure tool 34, the fifth acupressure tool 35, the sixth acupressure tool 36, and the seventh acupressure tool 37 described below.

The above-described first acupressure tool 1 is an acupressure tool for applying pressure to the head region and/or the shoulder regions of the body (refer to FIG. 29). This first acupressure tool 1 comprises the aforementioned first core rod 2 and the pair of first elastic bodies 3.

Figure 18:
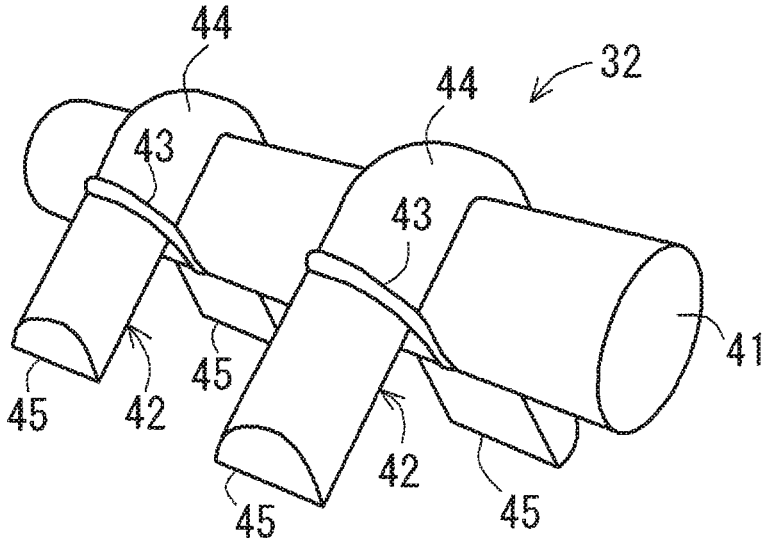
FIG. 18 is a perspective view of a second acupressure tool according to the example.

The above-described second acupressure tool 32 is an acupressure tool for applying pressure to the muscles along the spine of the body (refer to FIG. 29). This second acupressure tool 32, as illustrated in FIG. 18, comprises a second core rod 41, round and made of wood, and a pair of second elastic bodies 42, long and made of rubber, attached to this second core rod 41. This second core rod 41 has a diameter of approximately 66 mm, and a length in the axial direction of approximately 300 mm. Further, each of these second elastic bodies 42 is disposed so as to intersect (substantially orthogonally) an axial direction of the second core rod 41, bent along an outer face of the second core rod 41, and attached to the second core rod 41.

A string 43 is wrapped around the above-described second core rod 41 and second elastic bodies 42, thereby integrally connecting both 41 and 42. The left and right distance between the pair of second elastic bodies 42 can be easily adjusted by changing a connection state of the second core rod 41 and the second elastic bodies 42 by the string 43.

Figure 19:
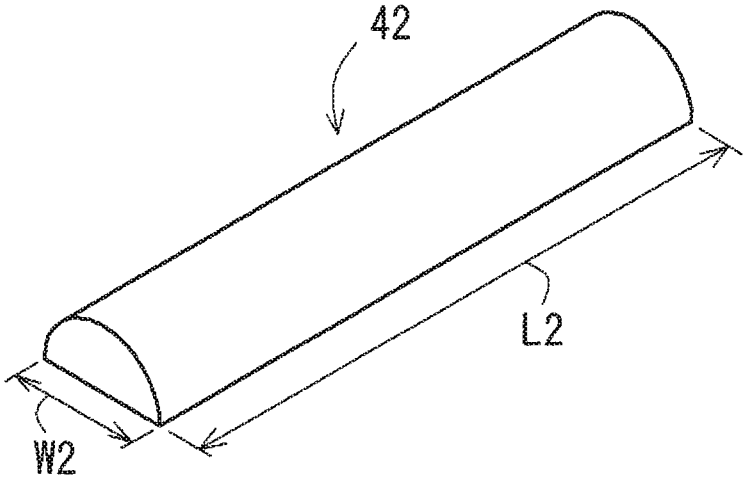
FIG. 19 is a perspective view of a second elastic body (non-elastically deformed state) according to the example.

The above-described second elastic bodies 42, as illustrated in FIG. 19, extend substantially linearly at a predetermined length L2 (approximately 230 mm, for example) in a non-elastically deformed state (that is, the state before attachment to the second core rod 41). Each of the second elastic bodies 42 has a horizontal cross section that is substantially semicircular in shape, and a uniform maximum horizontal width W2 (approximately 50 mm, for example) across the longitudinal direction thereof. Further, the front face (upper face) of each of the second elastic bodies 42 is formed into a convex curved surface that is upwardly convex in a horizontal cross section. Further, a pressure part 44 that is an upper side part of the second core rod 41 of the second elastic body 42, as illustrated in FIG. 18, is formed into a convex curved surface that is upwardly convex in a vertical cross section. Furthermore, both end sides of each of the second elastic bodies 42 in the longitudinal direction serve as legs 45 that can be grounded to the installation surface such as a floor.

Figure 20:
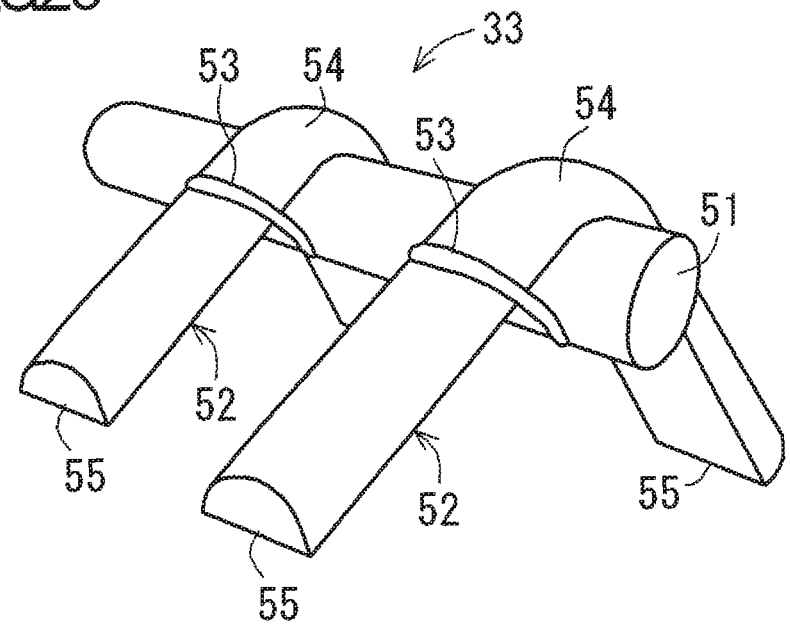
FIG. 20 is a perspective view of a third acupressure tool according to the example.

The above-described third acupressure tool 33 is an acupressure tool for applying pressure to the lumbar region and/or the gluteal region of the body (refer to FIG. 29). This third acupressure tool 33, as illustrated in FIG. 20, comprises a third core rod 51, round and made of wood, and a pair of third elastic bodies 52, long and made of rubber, attached to this third core rod 51. This third core rod 51 has a diameter of approximately 40 mm, and a length in the axial direction of approximately 300 mm. Further, each of these third elastic bodies 52 is disposed so as to intersect (substantially orthogonally) an axial direction of the third core rod 51, bent along an outer face of the third core rod 51, and attached to the third core rod 51.

A string 53 is wrapped around the above-described third core rod 51 and third elastic bodies 52, thereby integrally connecting both 51 and 52. The left and right distance between the pair of third elastic bodies 52 can be easily adjusted by changing a connection state of the third core rod 51 and the third elastic bodies 52 by the string 53.

Figure 21:
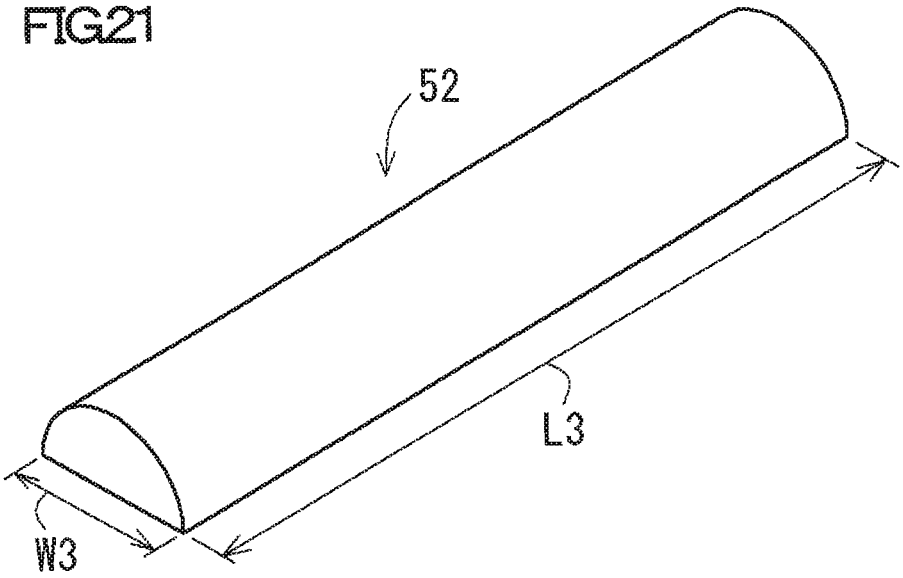
FIG. 21 is a perspective view of a third elastic body (non-elastically deformed state) according to the example.

The above-described third elastic bodies 52, as illustrated in FIG. 21, extend substantially linearly at a predetermined length L3 (approximately 300 mm, for example) in a non-elastically deformed state (that is, the state before attachment to the third core rod 51). Each of the third elastic bodies 52 has a horizontal cross section that is substantially semicircular in shape, and a uniform maximum horizontal width W3 (approximately 60 mm, for example) across the longitudinal direction thereof. Further, the front face (upper face) of each of the third elastic bodies 52 is formed into a convex curved surface that is upwardly convex in a horizontal cross section. Further, a pressure part 54 that is an upper side part of the third core rod 51 of the third elastic body 52, as illustrated in FIG. 20, is formed into a convex curved surface that is upwardly convex in a vertical cross section. Furthermore, both end sides of each of the third elastic bodies 52 in the longitudinal direction serve as legs 55 that can be grounded to the installation surface such as a floor.

It should be noted that the long length L2 of the second elastic bodies 42 of the above-described second acupressure tool 32 is less than the long length L3 of the third elastic bodies 52 of the third acupressure tool 33. Further, the maximum horizontal width W2 of the second elastic bodies 42 of the above-described second acupressure tool 32 is less than the maximum horizontal width W3 of the third elastic bodies 52 of the third acupressure tool 33. Furthermore, the diameter of the second core rod 41 of the above-described second acupressure tool 32 is greater than the diameter of the third core rod 51 of the third acupressure tool 33.

Figure 22:
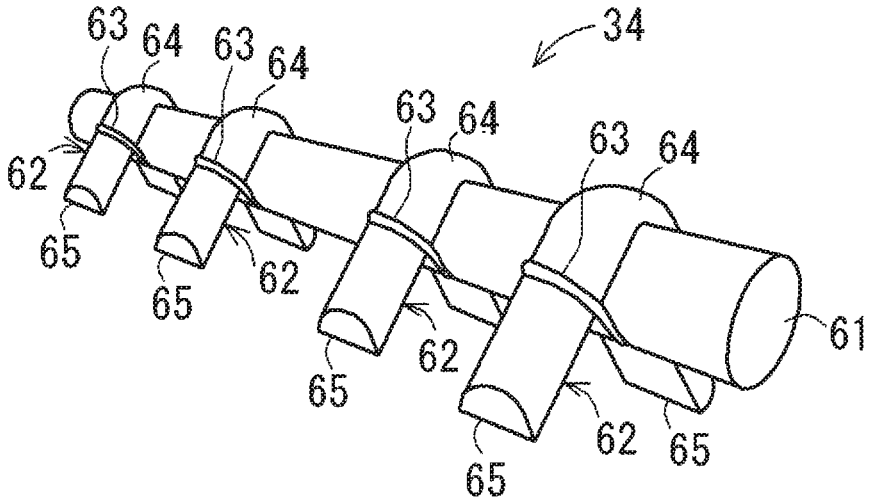
FIG. 22 is a perspective view of a fourth acupressure tool according to the example.

The above-described fourth acupressure tool 34 is an acupressure tool for applying pressure to the calf region of the leg region of the body (refer to FIG. 29). This fourth acupressure tool 34, as illustrated in FIG. 22, comprises a fourth core rod 61, round and made of wood, and a pair of fourth elastic bodies 62, long and made of rubber, attached to this fourth core rod 61. This fourth core rod 61 has a diameter of approximately 40 mm, and a length in the axial direction of approximately 450 mm. Further, each of these fourth elastic bodies 62 is disposed so as to intersect (substantially orthogonally) an axial direction of the fourth core rod 61, bent along an outer face of the fourth core rod 61, and attached to the fourth core rod 61. Furthermore, two pairs of the fourth elastic bodies 62 are provided to one fourth core rod 61.

A string 63 is wrapped around the above-described fourth core rod 61 and fourth elastic bodies 62, thereby integrally connecting both 61 and 62. The left and right distance between the pair of fourth elastic bodies 62 can be easily adjusted by changing a connection state of the fourth core rod 61 and the fourth elastic bodies 62 by the string 63.

Figure 23:
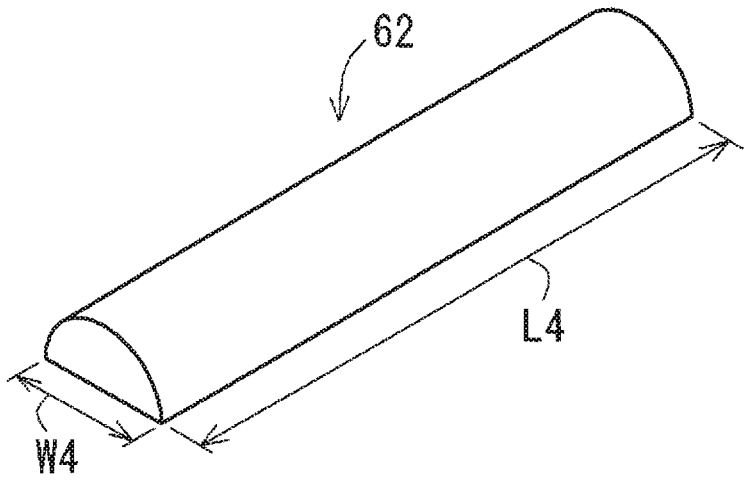
FIG. 23 is a perspective view of a fourth elastic body (non-elastically deformed state) according to the example.

The above-described fourth elastic bodies 62, as illustrated in FIG. 23, extend substantially linearly at a predetermined length L4 (approximately 230 mm, for example) in a non-elastically deformed state (that is, the state before attachment to the fourth core rod 61). Each of the fourth elastic bodies 62 has a horizontal cross section that is substantially semicircular in shape, and a uniform maximum horizontal width W4 (approximately 50 mm, for example) across the longitudinal direction thereof. Further, the front face (upper face) of each of the fourth elastic bodies 62 is formed into a convex curved surface that is upwardly convex in a horizontal cross section. Further, a pressure part 64 that is an upper side part of the fourth core rod 61 of the fourth elastic body 62, as illustrated in FIG. 22, is formed into a convex curved surface that is upwardly convex in a vertical cross section. Furthermore, both end sides of each of the fourth elastic bodies 61 in the longitudinal direction serve as legs 65 that can be grounded to the installation surface such as a floor.

Figure 24:
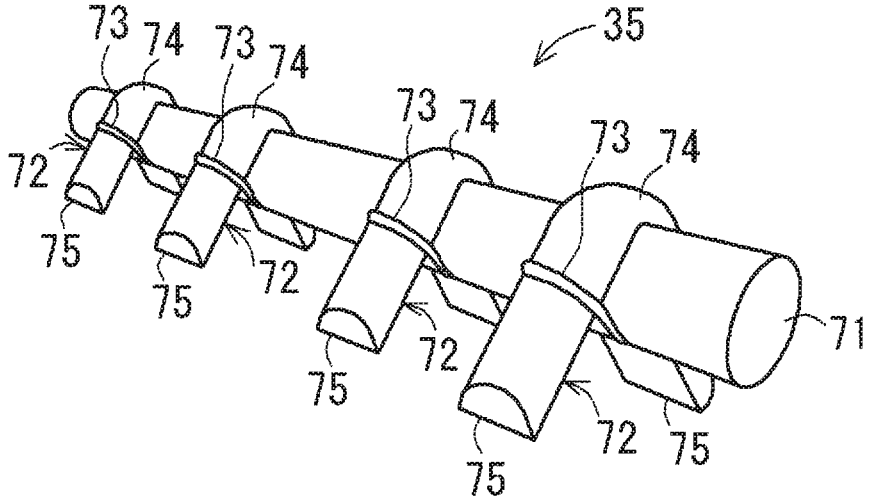
FIG. 24 is a perspective view of a fifth acupressure tool according to the example.

The above-described fifth acupressure tool 35 is an acupressure tool for applying pressure to the Achilles tendon region of the leg region of the body (refer to FIG. 29). This fifth acupressure tool 35, as illustrated in FIG. 24, comprises a fifth core rod 71, round and made of wood, and a pair of fifth elastic bodies 72, long and made of rubber, attached to this fifth core rod 71. This fifth core rod 71 has a diameter of approximately 40 mm, and a length in the axial direction of approximately 450 mm. Further, each of these fifth elastic bodies 72 is disposed so as to intersect (substantially orthogonally) an axial direction of the fifth core rod 71, bent along an outer face of the fifth core rod 71, and attached to the fifth core rod 71. Furthermore, two pairs of the fifth elastic bodies 72 are provided to one fifth core rod 72.

A string 73 is wrapped around the above-described fifth core rod 71 and fifth elastic bodies 72, thereby integrally connecting both 71 and 72. The left and right distance between the pair of fifth elastic bodies 72 can be easily adjusted by changing the connection state of the fifth core rod 71 and the fifth elastic bodies 72 by the string 73.

Figure 25:
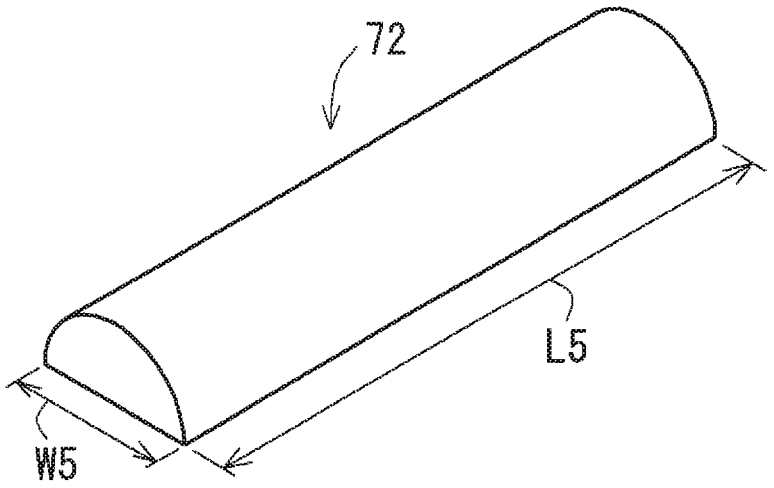
FIG. 25 is a perspective view of a fifth elastic body (non-elastically deformed state) according to the example.

The above-described fifth elastic bodies 72, as illustrated in FIG. 25, extend substantially linearly at a predetermined length L5 (approximately 230 mm, for example) in a non-elastically deformed state (that is, the state before attachment to the fifth core rod 71). Each of the fifth elastic bodies 72 has a horizontal cross section that is substantially semicircular in shape, and a uniform maximum horizontal width W5 (approximately 60 mm, for example) across the longitudinal direction thereof. Further, the front face (upper face) of each of the fifth elastic bodies 72 is formed into a convex curved surface that is upwardly convex in a horizontal cross section. Further, a pressure part 74 that is an upper side part of the fifth core rod 71 of the fifth elastic body 72, as illustrated in FIG. 24, is formed into a convex curved surface that is upwardly convex in a vertical cross section. Furthermore, both end sides of each of the fifth elastic bodies 72 in the longitudinal direction serve as legs 75 that can be grounded to the installation surface such as a floor.

It should be noted that the maximum horizontal width W4 of the fourth elastic bodies 62 of the above-described fourth acupressure tool 34 is less than the maximum horizontal width W5 of the fifth elastic bodies 72 of the fifth acupressure tool 35.

Figure 26:
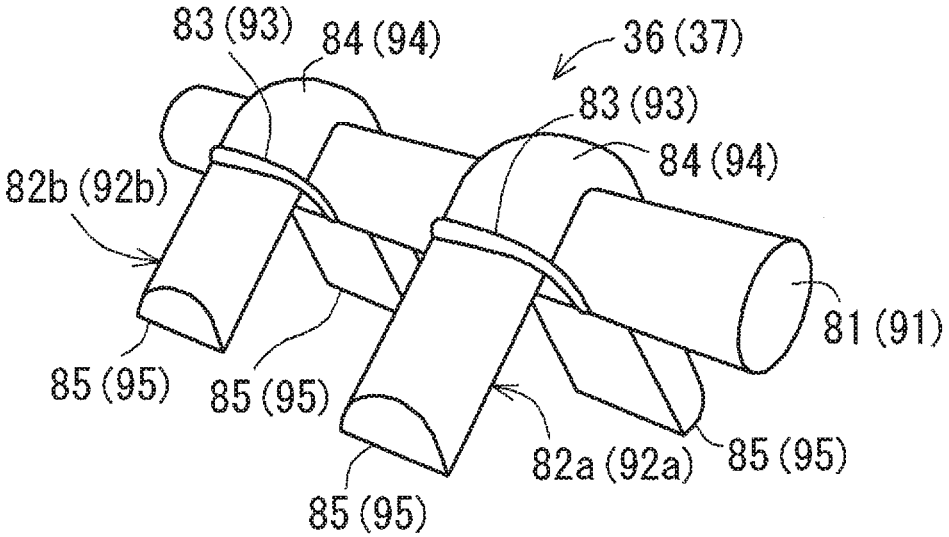
FIG. 26 is a perspective view of a sixth acupressure tool (or a seventh acupressure tool) according to the example.

The above-described sixth acupressure tool 36 is an acupressure tool for applying pressure to the left arm region of the body (refer to FIG. 29). This sixth acupressure tool 36, as illustrated in FIG. 26, comprises a sixth core rod 81, round and made of wood, and a pair of sixth elastic bodies 82*a* and 82*b*, long and made of rubber, attached to this sixth core rod 81. This sixth core rod 81 has a diameter of approximately 40 mm, and a length in the axial direction of approximately 300 mm. Further, each of these sixth elastic bodies 82*a* and 82*b* is disposed so as to intersect (substantially orthogonally) an axial direction of the sixth core rod 81, bent along an outer face of the sixth core rod 81, and attached to the sixth core rod 81.

A string 83 is wrapped around the above-described sixth core rod 81 and sixth elastic bodies 82*a* and 82*b*, thereby integrally connecting 81, 82*a*, and 82*b*. The left and right distance between the pair of sixth elastic bodies 82*a* and 82*b* can be easily adjusted by changing a connection state of the sixth core rod 81 and the sixth elastic bodies 82*a* and 82*b* by the string 83.

Figure 27:
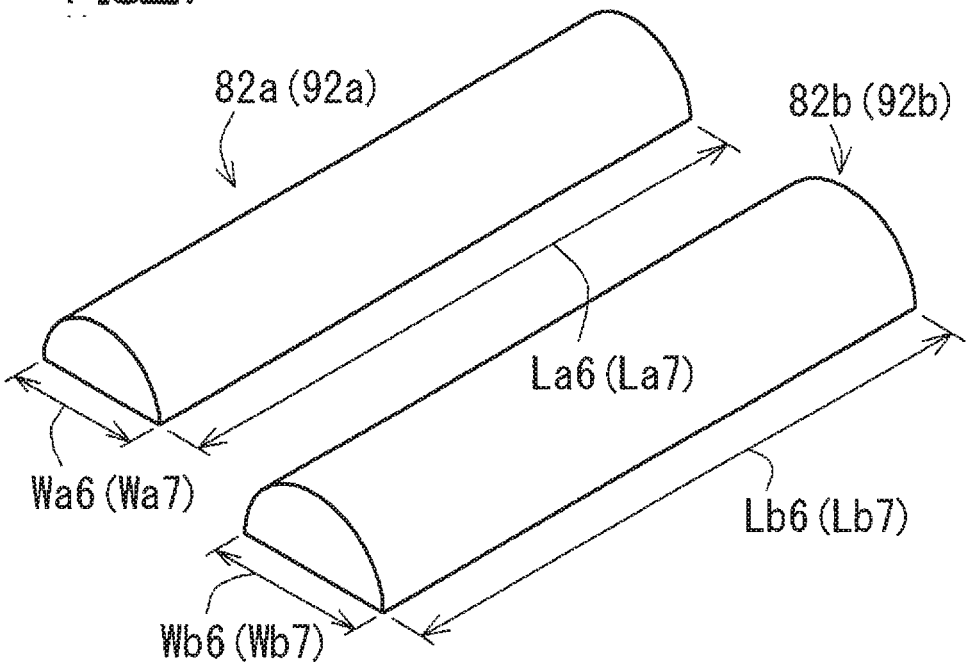
FIG. 27 is a perspective view of a sixth elastic body (or a seventh elastic body; non-elastically deformed state) according to the example.

The above-described sixth elastic body 82*a*, as illustrated in FIG. 27, extends substantially linearly at a predetermined length La6 (approximately 230 mm, for example) in a non-elastically deformed state (that is, the state before attachment to the sixth core rod 81). This sixth elastic body 82*a* has a horizontal cross section that is substantially semicircular in shape, and a uniform maximum horizontal width Wa6 (approximately 50 mm, for example) across the longitudinal direction thereof. Further, the above-described sixth elastic body 82*b* extends substantially linearly at a predetermined length Lb6 (approximately 230 mm, for example) in a non-elastically deformed state (that is, the state before attachment to the sixth core rod 81). This sixth elastic body 82*b* has a horizontal cross section that is substantially semicircular in shape, and a uniform maximum horizontal width Wb6 (approximately 60 mm, for example) across the longitudinal direction thereof. Further, the front face (upper face) of each of the sixth elastic bodies 82*a* and 82*b* is formed into a convex curved surface that is upwardly convex in a horizontal cross section. Further, a pressure part 84 that is an upper side part of the sixth core rod 81 of each of the sixth elastic bodies 82*a* and 82*b*, as illustrated in FIG. 26, is formed into a convex curved surface that is upwardly convex in the vertical cross section. Furthermore, both end sides of each of the sixth elastic bodies 82*a* and 82*b* in the longitudinal direction serve as legs 85 that can be grounded to the installation surface such as a floor.

The above-described seventh acupressure tool 37 is an acupressure tool for applying pressure to the right arm region of the body (refer to FIG. 29). This seventh acupressure tool 37, as illustrated in FIG. 26, comprises a seventh core rod 91, round and made of wood, and a pair of seventh elastic bodies 92*a* and 92*b*, long and made of rubber, attached to this seventh core rod 91. This seventh core rod 91 has a diameter of approximately 40 mm, and a length in the axial direction of approximately 300 mm. Further, each of these seventh elastic bodies 92*a* and 92*b* is disposed so as to intersect (substantially orthogonally) an axial direction of the seventh core rod 91, bent along an outer face of the seventh core rod 91, and attached to the seventh core rod 91.

A string 93 is wrapped around the above-described seventh core rod 91 and seventh elastic bodies 92*a* and 92*b*, thereby integrally connecting 91, 92*a*, and 92*b*. The left and right distance between the pair of seventh elastic bodies 92*a* and 92*b* can be easily adjusted by changing a connection state of the seventh core rod 91 and the seventh elastic bodies 92*a* and 92*b* by the string 93.

The above-described seventh elastic body 92*a*, as illustrated in FIG. 27, extends linearly at a predetermined length La7 (approximately 230 mm, for example) in a non-elastically deformed state. This seventh elastic body 92*a* has a horizontal cross section that is substantially semicircular in shape, and a uniform maximum horizontal width Wa7 (approximately 50 mm, for example) across the longitudinal direction thereof. Further, the above-described seventh elastic body 92*b* extends linearly at a predetermined length Lb7 (approximately 230 mm, for example) in a non-elastically deformed state. This seventh elastic body 92*b* has a horizontal cross section that is substantially semicircular in shape, and a uniform maximum horizontal width Wb7 (approximately 60 mm, for example) across the longitudinal direction thereof. Further, the front face (upper face) of each of the seventh elastic bodies 92*a* and 92*b* is formed into a convex curved surface that is upwardly convex in a horizontal cross section. Further, a pressure part 94 that is an upper side part of the seventh core rod 91 of the seventh elastic bodies 92*a* and 92*b*, as illustrated in FIG. 26, is formed into a convex curved surface that is upwardly convex in the vertical cross section. Furthermore, both end sides of each of the seventh elastic bodies 92*a* and 92*b* in the longitudinal direction serve as legs 95 that can be grounded to the installation surface such as a floor.

(2) Action of Acupressure Tool Set

Next, the action of the acupressure tool set 30 of the above-described configuration will be described. First, the method for arranging the acupressure tool set 30 will be described. As illustrated in FIGS. 28 to 30, the first acupressure tool 1 is disposed in the first predetermined position P1 on an installation surface 99 such as a floor, allowing the head region and the shoulder regions of the user (acupressure recipient) to be placed thereon. Further, the second acupressure tool 32 is disposed in the second predetermined position P2 on the installation surface 99, allowing the muscles along the spine of the user to be placed thereon. Further, the third acupressure tool 33 is disposed in the third predetermined position P3 on the installation surface 99, allowing the lumbar region and the gluteal region of the user to be placed thereon. Further, the fourth acupressure tool 34 is disposed in the fourth predetermined position P4 on the installation surface 99, allowing the calf regions of the leg regions of the user to be placed thereon. Further, the fifth acupressure tool 35 is disposed in the fifth predetermined position P5 on the installation surface 99, allowing the Achilles tendon regions of the leg regions of the user to be placed thereon. Further, the sixth acupressure tool 36 is disposed in the sixth predetermined position P6 on the installation surface 99, allowing the left arm region of the user to be placed thereon. Furthermore, the seventh acupressure tool 37 is disposed in the seventh predetermined position P7 on the installation surface 99, allowing the right arm region of the user to be placed thereon. It should be noted that positions of the above-described acupressure tools 1 and 32 to 37 may be adjusted and determined as appropriate in accordance with the physique and the like of the user.

Figure 31:
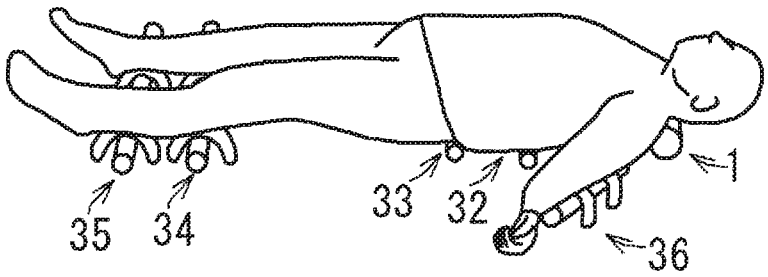
FIGS. 31A to 31C are action explanatory views of the acupressure tool set described above, FIG. 31A illustrating a person lying on his/her back on each acupressure tool, FIG. 31B illustrating a person lying on his/her side on each acupressure tool, and FIG. 31C illustrating a person lying on his/her side on each acupressure tool.
Figure 31:
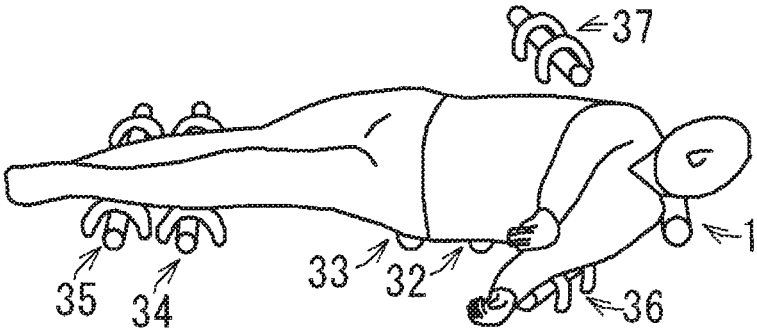
Figure 31:
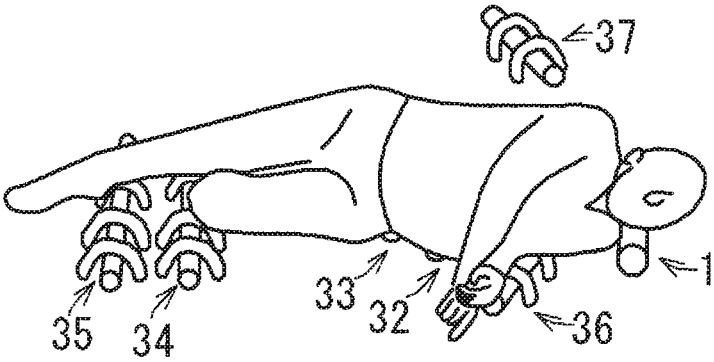
Figure 32:
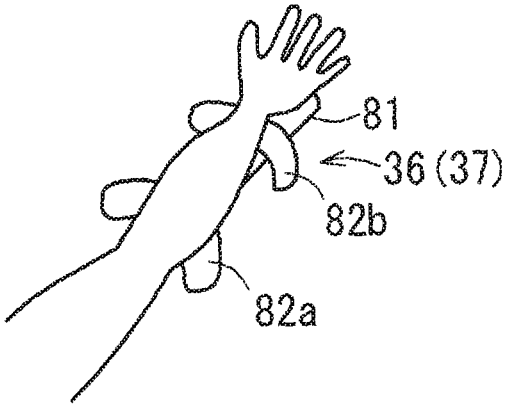
FIGS. 32A and 32B are action explanatory views of the sixth acupressure tool (or the seventh acupressure tool) described above, FIG. 32A illustrating one acupressure tool being used, and FIG. 32B illustrating two acupressure tools being used.
Figure 32:
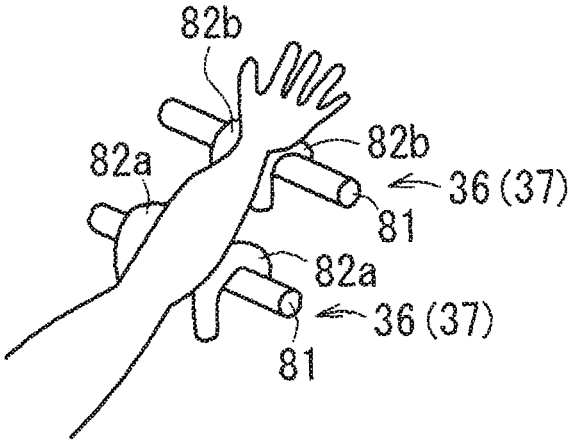

Next, as illustrated in FIG. 31A, the user lies on his/her back on the first to seventh acupressure tools 1 and 32 to 37 and leans his/her entire weight thereon. Then, the user is in a state in which his/her body is floating in the air (that is, the body is relaxed). Then, as illustrated in FIGS. 29 and 30, pressure is applied to the pressure point of the head region (the pressure point of a rear neck region 204, for example) and the pressure points of the shoulder regions (the upper scapular regions 206, for example) by the first acupressure tool. Further, pressure is applied to the pressure point of the muscles along the spine (for example, the pressure point of a lower scapular region 302 (in particular, a first pressure point of the lower scapular region 302); also referred to as a "Kanyu acupressure point"; refer to p. 81 of the above-described Non-Patent Document 3) by the second acupressure tool 32. Further, pressure is applied to the pressure points of the lumbar region and gluteal region (in particular, a Namikoshi pressure point 304) by the third acupressure tool 33. Further, pressure is applied to the pressure points of the calf regions of the leg regions (the pressure points of lower leg rear side regions 308, for example) of the body by the fourth acupressure tool 34. Further, pressure is applied to the pressure points of the Achilles tendon regions (the pressure points of the lower leg rear side regions 308, for example) of the body by the fifth acupressure tool 35. Further, as illustrated in FIG. 32A, pressure is applied to the pressure point of the left arm region (the pressure point of the forearm outside region, for example) of the body by the sixth acupressure tool 36. Furthermore, pressure is applied to the pressure point of the right arm region (the pressure point of the forearm outside region, for example) of the body by the seventh acupressure tool 37.

Figure 55:
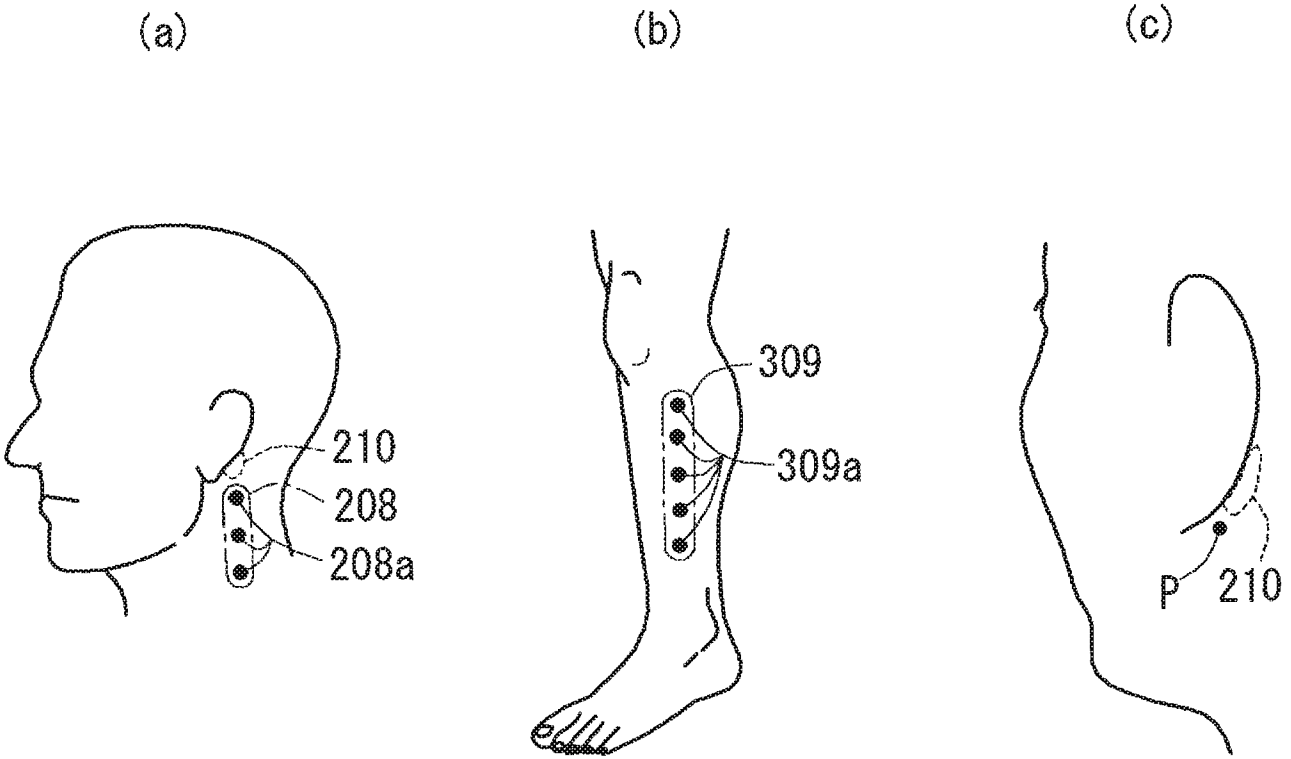
FIG. 55 is an explanatory view illustrating acupressure pressure points conventionally known.
Figure 56:
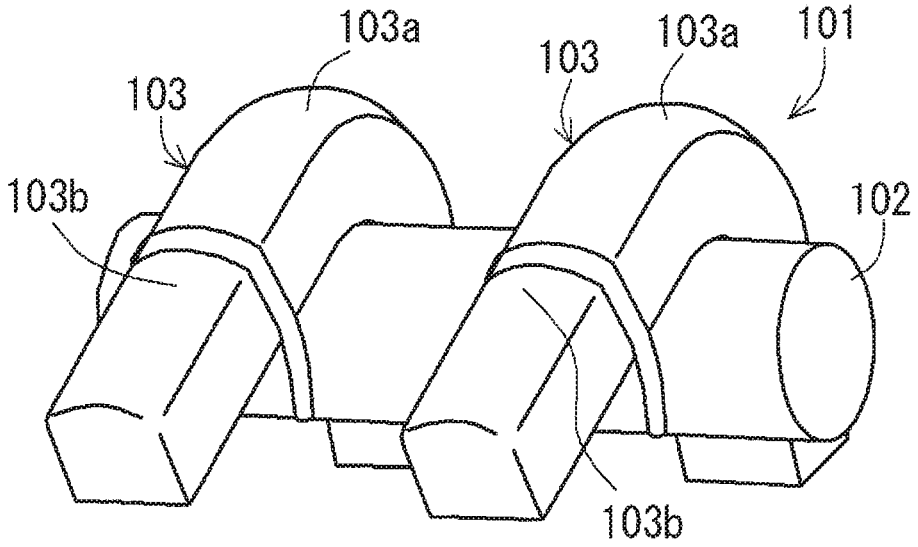
FIG. 56 is a perspective view illustrating a conventional acupressure tool.
Figure 57:
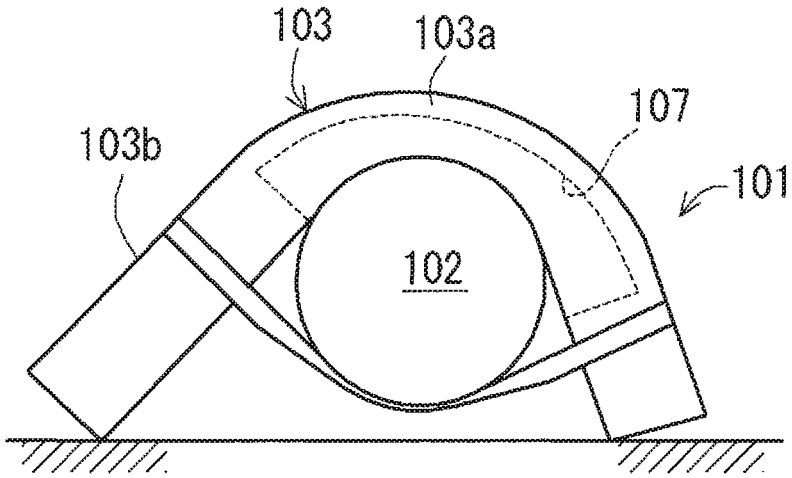
FIG. 57 is a perspective view illustrating another conventional acupressure tool.

Next, as illustrated in FIGS. 31B and 31C, the user lies on his/her side on the first to seventh acupressure tools 1 and 32 to 37 and leans his/her entire weight thereon. Then, pressure is more strongly applied to the pressure points of the entire body by the elastic bodies 42, 52, 62, 72, 82*a*, 82*b*, 92*a*, and 92*b* of the first to seventh acupressure tools 1 and 32 to 37. In particular, pressure is strongly applied to the local area P (refer to FIG. 55C) near the mastoid 210 of the head region by the first elastic bodies 3 of the first acupressure tool 1. Further, pressure is strongly applied to a first pressure point of a lower leg outside region 309 (also referred to as a "Sanri" acupressure point of the leg; refer to FIG. 55B; refer to pp. 50 and 99 of the above-described Non-Patent Document 3) by the fourth elastic bodies 62 of the fourth acupressure tool 34.

It should be noted that, during full-body acupressure using the above-described first to seventh acupressure tools 1 and 32 to 37, an overall effect is reliably achieved if each of the acupressure tools 1 and 32 to 37 reliably captures the first target pressure points (acupressure points). Then, pressure is firmly applied to the user's heart's content with the user lying on his/her back and his/her side. As a result, the body is naturally satisfied and the user enters a restful sleep. Further, the user applies pressure to other acupressure points when he/she has time. For example, pressure may be applied to the backs and fronts of the legs by the above-described fifth acupressure tool 35. Further, the user lies on his/her stomach on the above-described third acupressure tool 33, and pressure is applied to a lower abdominal region below the belly button by slowly rocking, thereby directly stimulating the bowels, promoting bowel movement and preventing constipation.

(3) Effect of Example

From the above, according to the acupressure tool set 30 of this example, the acupressure tool set 30 comprises the first acupressure tool 1 for applying pressure to the head region and/or the shoulder regions of the body, and another acupressure tool for applying pressure to a section of the body other than the head region and the shoulder regions. Then, the other acupressure tool comprises the core rod and the pair of long elastic bodies which are attached to the core rod, the elastic bodies being attached to the core rod by being arranged intersecting the axial direction of the core rod and bent along the outer face of the core rod, and the upper face of the elastic bodies being formed into the convex curved surface that is upwardly convex in the horizontal cross section. With this arrangement, pressure is applied to the head region and/or the shoulder regions of the body by the elastic bodies 3 of the first acupressure tool 1, and pressure is applied to a section of the body other than the head region and the shoulder regions by the elastic bodies of the other acupressure tool. In particular, pressure is effectively applied to pressure points of the body by the convex curved surfaces of the elastic bodies of the other acupressure tool. As a result, by relieving fatigue and stiffness in the head region and/or the shoulder regions as well as other sections of the body, it is possible to more reliably remove or alleviate stiff shoulders.

Further, according to this example, the other acupressure tool further comprises the second acupressure tool 32 for applying pressure to the muscles along the spine of the body. With this arrangement, pressure is applied to the muscles along the spine (for example, the first pressure point of the lower scapular region 302; also referred to as the "Kanyu acupressure point"; refer to FIG. 29; refer to p. 81 of the above-described Non-Patent Document 3) of the body by the elastic bodies 42 of the second acupressure tool 32. As a result, fatigue and stiffness are removed from the muscles along the spine in addition to the head region and/or the shoulder regions and the like of the body. Removal of stiffness from the muscles along the spine in this manner makes it possible to stimulate internal organs to promote bowel movement and prevent constipation, and also prevent posture deterioration (that is, curvature of the back, stooped back).

Further, according to this example, the other acupressure tool further comprises the third acupressure tool 33 for applying pressure to the lumbar region and/or the gluteal region of the body. With this arrangement, pressure is applied to the lumbar region and/or the gluteal region (the Namikoshi pressure point 304, for example; refer to FIG. 29) of the body by the elastic bodies 52 of the third acupressure tool 33. As a result, fatigue and stiffness are removed from the lumbar region and/or the gluteal region in addition to the head region and/or shoulder regions and the like of the body. Such removal of stiffness from the lumbar region of the body makes it possible to prevent lumbar pain and posture deterioration (that is, lumbar curvature).

Further, according to this example, the long length L2 of the second elastic bodies 42 of the second acupressure tool 32 is less than the long length L3 of the third elastic bodies 52 of the third acupressure tool 33. Further, the maximum horizontal width W2 of the second elastic bodies 42 of the second acupressure tool 32 is less than the maximum horizontal width W3 of the third elastic bodies 52 of the third acupressure tool 33. Furthermore, the diameter of the core rod 41 of the second acupressure tool 32 is greater than the diameter of the core rod 51 of the third acupressure tool 33. As a result, pressure is strongly applied to the muscles along the spine of the body by the second elastic bodies 42 of the second acupressure tool 32 while pressure is softly applied to the lumbar region and/or the gluteal region of the body by the third elastic bodies 52 of the third acupressure tool 33.

Further, according to this example, the other acupressure tool comprises the fourth acupressure tool 34 for applying pressure to the calf regions of the leg regions of the body, and the fifth acupressure tool 35 for applying pressure to the Achilles tendon regions of the leg regions of the body. With this arrangement, pressure is applied to the calf regions of the leg regions (for example, the first pressure points of the lower leg outside regions 309; also referred to the "Sanri" acupressure point of the leg; refer to FIG. 55B; refer to pp. 50 and 99 of the above-described Non-Patent Document 3) of the body by the elastic bodies 62 of the fourth acupressure tool 34, and pressure is applied to the Achilles tendon regions (for example, the seventh point and the eighth point of the lower leg rear side regions 308; refer to FIG. 29) of the body by the elastic bodies 72 of the fifth acupressure tool 35. As a result, fatigue and stiffness are removed from the leg regions in addition to the head region and/or the shoulder regions and the like of the body.

Further, according to this example, the fourth acupressure tool 34 and the fifth acupressure tool 35 each comprise two pairs of elastic bodies 62 and 72. This makes it possible to place and fit the left and right leg regions on the pair of elastic bodies 62 and 72 and apply pressure. As a result, the left and right leg regions can be placed on the acupressure tools 34 and 35 in a relaxed state, making it possible to effectively apply pressure to each pressure point of the leg regions.

Here, one leg is regarded as the same as a torso. The spine and bones pass through the center of both the torso and the leg, and muscles extends to both sides of the bone. The widths of the elastic bodies 62 and 72 are set so that pressure is firmly applied to the two muscles. Then, the fourth and fifth acupressure tools 34 and 35 of this example further comprise a total of four elastic bodies 62 and 72 (two sets each), allowing the legs to be placed on the acupressure tools 34 and 35 while completely relaxed without the need of leg strength. With this arrangement, the muscles are accurately identified and become completely relaxed, thereby achieving a favorable acupressure effect.

Further, according to this example, the maximum horizontal width W4 of the fourth elastic bodies 62 of the fourth acupressure tool 34 is less than the maximum horizontal width W5 of the fifth elastic bodies 72 of the fifth acupressure tool 35. With this arrangement, pressure is strongly applied to the calf regions of the leg regions of the body by the fourth elastic bodies 62 of the fourth acupressure tool 34 while pressure is softly applied to the Achilles tendon regions of the leg regions of the body by the fifth elastic bodies 72 of the fifth acupressure tool 35.

Further, according to this example, the other acupressure tool comprises the sixth acupressure tool 36 for applying pressure to the left arm region of the body, and the seventh acupressure tool 37 for applying pressure to the right arm region of the body. With this arrangement, pressure is applied to the left arm region (in particular, a forearm region and a wrist region) of the body by the elastic bodies 82*a* and 82*b* of the sixth acupressure tool 36, and to the right arm region (in particular, a forearm region and a wrist region) of the body by the elastic bodies 92*a* and 92*b* of the seventh acupressure tool 37. As a result, fatigue and stiffness are removed from the arm regions in addition to the head region and/or the shoulder regions and the like of the body.

In particular, according to the acupressure tool set 30 of this example, the entire body is placed on the first to seventh acupressure tools 1 and 32 to 37 grounded in a stable manner, causing the entire body to completely float in the air on the acupressure tools 1 and 32 to 37. In this state, pressure is applied to each of the acupressure points across the entire body. The person receiving the pressure (acupressure) then becomes completely relaxed. This pressure effect is effective in restoring health to the mind and body. That is, the fatigue and stiffness of the muscles of the entire body are removed or alleviated and tension is released, thereby relaxing the mind and thus reducing mental stress.

Figure 48:
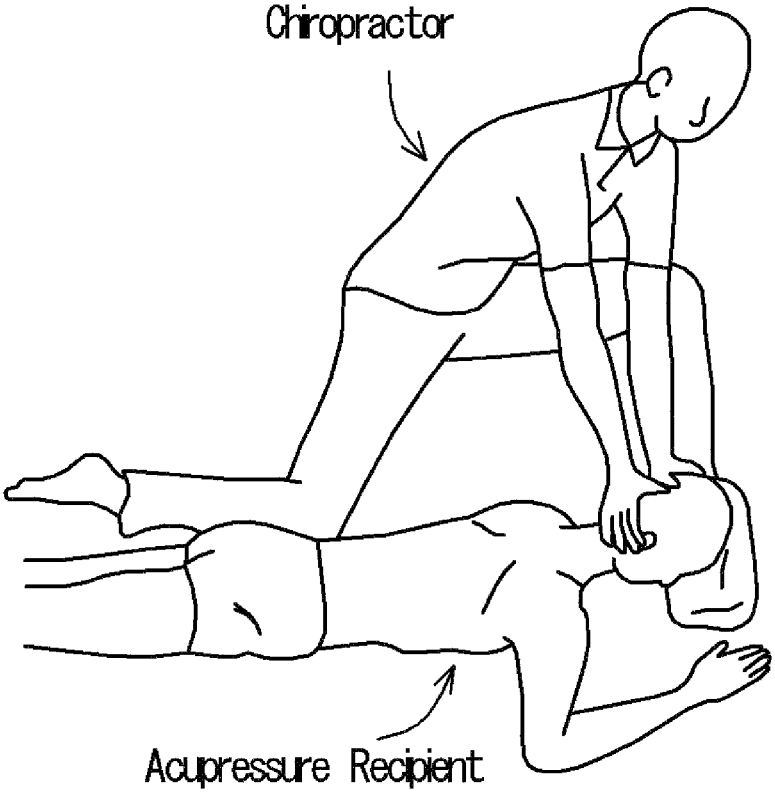
FIG. 48 is an explanatory view for explaining acupressure by a chiropractor.

Here, according to the acupressure by a chiropractor, for example, the chiropractor applies his/her own weight through his/her finger pads to apply weak and strong pressure to the acupressure recipient using a support point of one knee as the axis, as illustrated in FIG. 48. This acupressure surface area of the chiropractor is a tip section of the thumb, and relatively small. In contrast, according to the acupressure tool set 30 of this example, the pressure resulting from the entire weight of the acupressure recipient is dispersed to the acupressure tools 1 and 32 to 37 (refer to FIG. 30). These acupressure surface areas of the acupressure tools 1 and 32 to 37 correspond to the convex surfaces of the elastic bodies, and are large compared to that of the thumb of the chiropractor. Then, the person places his/her body on the acupressure tools 1 and 32 to 37, making it possible to achieve a strong pressing force and, moreover, a constant pressing force over a long period of time. In comparison, due to the weak pressing force and increasing fatigue of the chiropractor, the acupressure by the chiropractor cannot be maintained at a stable pressing force over a long period of time.

Then, according to the acupressure tool set 30 of this example, a large pressing force is achieved, making it possible to apply pressure using a convex surface area (that is, acupressure surface area) greater than that of the thumb when a pressing force equivalent to that of the chiropractor is to be achieved. With the acupressure surface area being large, the acupressure point readily enters the acupressure surface area even when an amateur with little knowledge of acupressure point positions applies pressure by approximation. This makes it possible to easily apply pressure to the same acupressure points as those by a professional chiropractor. That is, the acupressure tool, even for an amateur, results in a professional level acupressure effect. Further, according to the acupressure tool set 30 of this example, constant pressure can be applied for a long period of time, making it possible to apply the acupressure tool set 30 to the development of a pillow or bed for restful and sound sleep by decreasing the acupressure pressure. It should be noted that, while the chiropractor grows weary when providing acupressure treatment to four to five persons daily, the acupressure tool set 30 of this example can be used by the chiropractor himself/herself to care for his/her own body.

Furthermore, according to the acupressure tool set 30 of this example, pressure can be applied to the entire body, making the acupressure tool set 30 truly effective in removing stiffness and fatigue from the entire body, including lumbar pain, lumbar curvature, stooped back, constipation, leg fatigue, and internal organ fatigue. Further, the acupressure tool set 30 achieves the same acupressure effect as that when a total of 12 chiropractors apply pressure simultaneously to the head region, shoulder regions, muscles along the spine, lumbar region, right calf region, right Achilles tendon region, left calf region, left Achilles tendon region, right forearm region, right wrist region, left forearm region, and left wrist region.

It should be noted that massage is an ancient practice that exists throughout the world. This is due to the human desire to eliminate stiffness and fatigue in the muscles throughout the body. Use of the acupressure tool set 30 of this example allows the user to, without receiving acupressure (including massage) from another person, achieve at least the same effect and, on his/her own, take care of his/her own body at a favorable time and location.

Furthermore, when an acupressure service is provided to other persons using the acupressure tool set 30 of this example, a large number of acupressure recipients can be managed by one person. Further, the chiropractor can provide the acupressure service by learning only a little bit about acupressure points. With this arrangement, the acupressure fee is significantly reduced. Reduction of the acupressure fee results in a significant increase in the number of persons who do acupressure. The number of opportunities for receiving acupressure will then increase even in developing countries. Then, acupressure work in developing countries will increase, which will lead to increases in employment, quality of life, and the country's GDP.

Here, "acupressure" refers to applying pressure using (through) the fingers (refer to the above-described Non-Patent Document 1, p. 15, and the like). Further, in the case of self-acupressure, the trick to applying pressure is to balance the entire body, apply pressure gradually, and remove pressure gradually, without using excessive force at the fingertips. Further, pressure should be applied vertically onto the skin surface. Furthermore, the chiropractor applies pressure by applying his/her weight through his/her fingertips without using excessive force at the fingertips. The acupressure is effective when the pressure pleasantly and gradually penetrates from the skin to the muscle. So-called acupressure is applying pressure by applying the "natural force" of weight.

Then, the acupressure tool set 30 of this example uses the elastic bodies 3, 42, 52, 62, 72, 82*a*, 82*b*, 92*a*, and 92*b* as body contact points to express the "softness of the skin of the hand" of a chiropractor. Further, the structure of the elastic bodies 3, 42, 52, 62, 72, 82*a*, 82*b*, 92*a*, and 92*b* can be changed by the strength of the pressure applied.

Further, to gradually transmit the body weight pressure of the chiropractor to the skin of the hands, flexibility in the joints of the finger, wrist, elbow, and shoulder is a prerequisite for the chiropractor, and here lies the "essence of acupressure." Accordingly, according to the first to seventh acupressure tools 1 and 32 to 37 of this example, the "legs 8, 9, 45, 55, 65, 75, 85, and 95" for grounding are provided, and the area from the body contact points "pressure parts 11 to 14, 44, 54, 64, 74, 84, and 94" to the legs 8, 9, 45, 55, 65, 75, 85, and 95 of the grounding surface become one elastic body 3, 42, 52, 62, 72, 82*a*, 82*b*, 92*a*, and 92*b* to express the "flexibility in the joints." Applying body-weight pressure deforms the overall structure of the legs 8, 9, 45, 55, 65, 75, 85, and 95 of the elastic bodies 3, 42, 52, 62, 72, 82*a*, 82*b*, 92*a*, and 92*b*, fulfilling the role of the joints.

Further, according to the acupressure tool set 30 of this example, pressure is applied by utilizing the user's own entire weight and placing the body of the user on the acupressure tools 1 and 32 to 37, rather than the weight of the chiropractor. Allowing use of the user's entire weight achieves utilization of a true natural force, and utilization of a true natural force is the essence of acupressure. It should be noted that a good chiropractor utilizes 100% of his/her own weight, and pressure can be applied by changing the degree of pressure by the "body-weight force."

Here, the acupressure of the chiropractor is performed with the acupressure recipient lying down, wearing thin clothing. This is said to allow the acupressure recipient to release the tension from his/her body, sleep in a relaxed state, and become 100% stable. The chiropractor can then utilize 100% of his/her body-weight pressure. Conversely, if the acupressure recipient is standing or sitting, the recipient uses strength to maintain that posture. Such a scenario is not truly acupressure, but massage. According to the acupressure tool set 30 of this example, the user places his/her body on the acupressure tools 1 and 32 to 37 in a completely relaxed state. This is true acupressure. Further, the acupressure tool set 30 of this example is an instrument that allows an amateur to identify the acupressure points of his/her own body. Further, in the first to seventh acupressure tools 1 and 32 to 37, the pressure sections that abut the body all have curved surfaces. Furthermore, the first to seventh acupressure tools 1 and 32 to 37 are adjustable, moving easily in all X, Y, and Z directions. This makes it possible to adjust the area of the body having pressure applied thereto as well as the strength of the pressuring force.

Further, pressure should be applied vertically onto the skin surface. Because this is acupressure, the contact point on the skin is a single point. The acupressure point is a point; if pressure is linearly applied, pressure is not applied to the acupressure point, and an acupressure effect is not achieved. Linear pressure is only a simple massage. Conversely, in the first to seventh acupressure tools 1 and 32 to 37 of this example, each body contact section abuts at a point of the curved surface, and the direction of force is orthogonal to the tangent. That is, pressure is vertically applied to the skin.

Further, the first to seventh acupressure tools 1 and 32 to 37 of this example are "self-care all-purpose acupressure tools" capable of applying pressure to (substantially all) areas of the entire body.

Further, the first to seventh acupressure tools 1 and 32 to 37 of this example are formed by the pairs of elastic bodies 3, 42, 52, 62, 72, 82*a*, 82*b*, 92*a*, and 92*b*, and maintain stability on the ground by the four legs 8, 9, 45, 55, 65, 75, 85, and 95, thereby making the acupressure tools 1 and 32 to 37 stable and not move, allowing pressure to be applied utilizing the weight of the user himself/herself as described above. In other words, the 100% natural force of the body-weight force can be utilized. If the tool that is the recipient of the body-weight force were to move, full utilization of the body-weight force would not be achievable. This is not acupressure.

Further, the first acupressure tool 1 of this example specializes in the ability to apply pressure to four points, two head region points near the "mastoids 210," and two shoulder region points near the "upper scapular regions 206," which are the main sources of stiff shoulders, and is designed to dramatically alleviate stiff shoulders.

Furthermore, according to the acupressure tool set 30 of this example, the acupressure tool set 30 has the effect of promoting not only physical well-being, but spiritual well-being, i.e., relaxation of the mind, as well. The user places his/her body on the acupressure tools 1 and 32 to 37, and completely releases all tension. "To release tension is to relax the mind." The mind relaxes as if the user is leisurely immersed in an open air hot spring or completely drawn into a starry sky. Time periods that allow such relaxation of the mind are increasingly essential for those who experience higher tension on a daily basis. Only with the two time periods, mental tension followed by mental relaxation, is the spiritual well-being of a person maintained. The first to seventh acupressure tools 1 and 32 to 37 (self-care all-purpose acupressure tools) of this example capable of removing daily body fatigue and allowing the mind to relax are essential to the "physical and spiritual" well-being life of a person.

Figure 15:
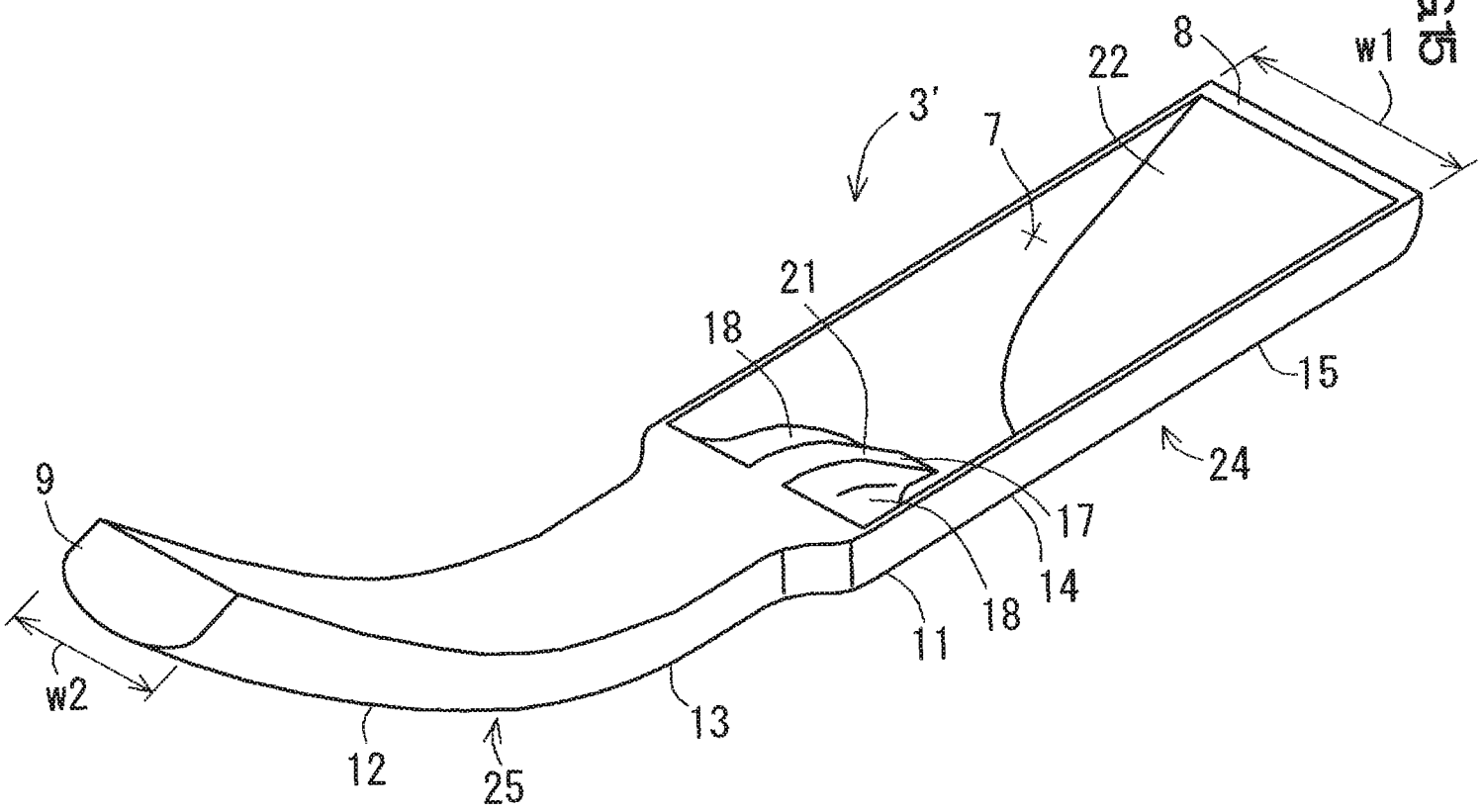
FIG. 15 is a perspective view of an elastic body (non-elastically deformed state) according to a modification.

It should be noted that the present invention is not limited to the above-described example, and various modifications are possible without departing from the scope of the present invention according to a purpose and usage. That is, while the above-described example describes the elastic bodies 3 having uniform horizontal widths across the longitudinal direction, the present invention is not limited thereto, allowing adoption of elastic bodies 3' comprising a wide width part 24 that has a horizontal width w1 (50 to 80 mm, for example), and a narrow width part 25 that has a horizontal width w2 (40 to 60 mm, for example), is continuous from one end side of this wide width part 24, and is smaller than the horizontal width of the wide width part 3, as illustrated in FIG. 15, for example. According to the acupressure tool 1 that uses the elastic bodies 3', it is possible to apply relatively soft pressure to the head region and the local areas P near the mastoids by the first pressure part 11 and the fourth pressure part 14 provided to the wide width part 24, and apply relatively strong pressure to the interscapular regions 202 and the upper scapular regions 206 by the second pressure part 12 and the third pressure part 13 provided to the narrow width part 25.

Figure 16:
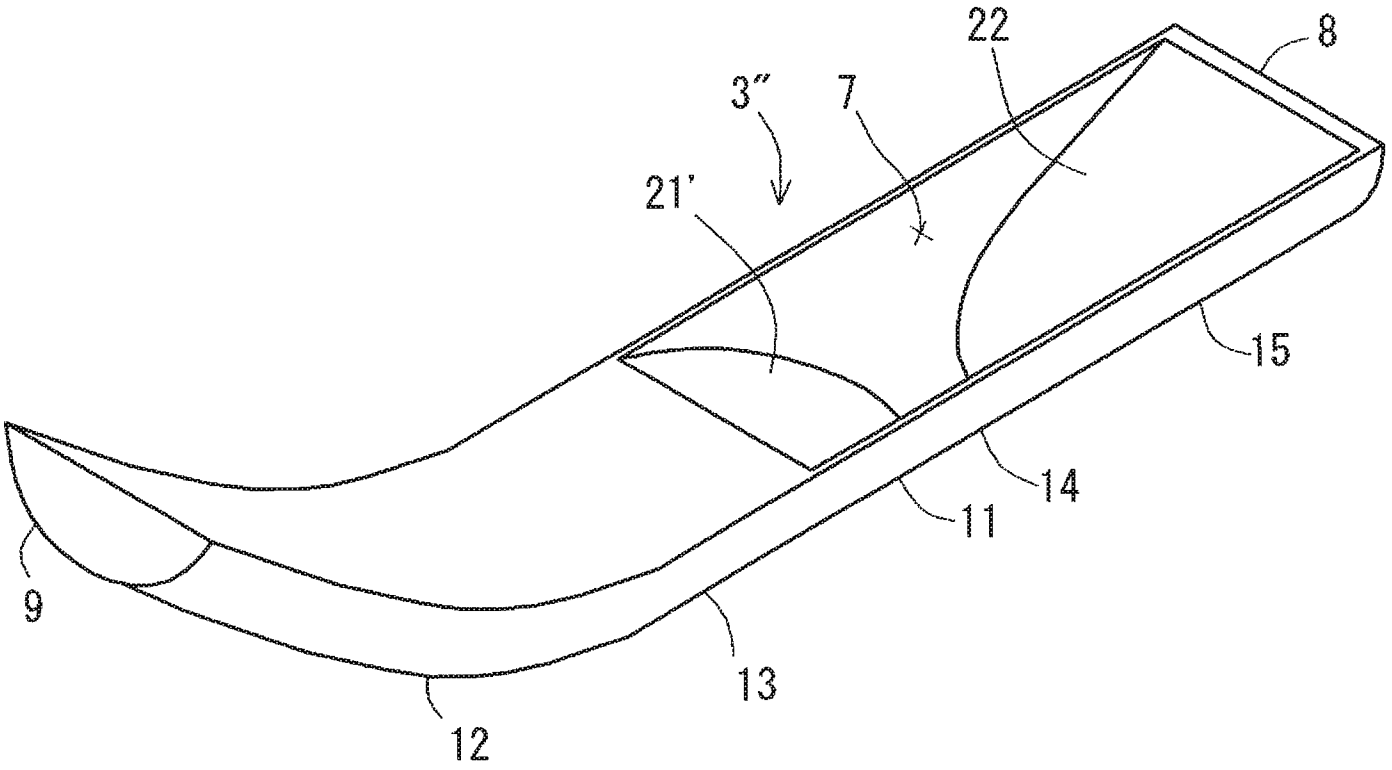
FIG. 16 is a perspective view of an elastic body (non-elastically deformed state) according to another modification.

Further, while the above-described example describes the rib 17 provided on the rear face side of the first pressure part 11, and elastic bodies 3 having the lower face of this rib 17 serving as the first tapered face 21, the present invention is not limited thereto, allowing adoption of elastic bodies 3" in which a first tapered face 21' that extends across substantially the entire length in a width direction of the first pressure part 11 is formed on the rear face side of the first pressure part 11, as illustrated in FIG. 16, for example.

Further, while the above-described example describes as the second pressure part 12 having a front face edge in the vertical cross section that is substantially curved in shape, the present invention is not limited thereto, and the second pressure part may have a front face edge in the vertical cross section that is substantially linear in shape, for example.

Further, while the above-described example describes the third pressure part 13 having a front face edge in the vertical cross section that is substantially linear in shape, the present invention is not limited thereto, and the third pressure part may have a front face edge in the vertical cross section that is a substantially curved surface shape, for example.

Further, while the above-described example describes the first pressure part 11, the fourth pressure part 14, and the support part 15 each having a front face edge in the vertical cross section that is substantially linear in shape in a non-elastically deformed state, the present invention is not limited thereto, and the first pressure part, the fourth pressure part, and the support part may each have a front face edge in the vertical cross section that is a substantially curved surface shape in a non-elastically deformed state, for example.

Further, while the above-described example describes the support part 15 being in an upright state when the acupressure tool 1 is placed on the installation surface, the present invention is not limited thereto, and the support part may be in a state lying obliquely to a perpendicular line when the acupressure tool is placed on the installation surface, for example.

Further, while the above-described example describes the tapered faces 21, 21', and 22 having a planar shape, the present invention is not limited thereto, and the tapered faces may have a curved surface shape, for example.

Further, while the above-described example describes the tapered faces 21, 21', and 22 each abutting the outer peripheral face of the core rode 2 in a no-load state with respect to the elastic bodies 3, 3', and 3", the present invention is not limited thereto, and the tapered faces may face the outer peripheral face of the core rod 2 in a no-load state with respect to the elastic bodies 3, 3', and 3", and abut the outer peripheral face of the core rod 2 when load is applied to the elastic bodies 3, 3', and 3" (that is, when the head region and shoulder regions are placed on the elastic bodies), for example.

Further, a material, a shape, and the like of the core rods 2, 41, 51, 61, 71, 81, and 91 of the above-described example may be selected as appropriate in accordance with the strength of the pressuring force of the elastic bodies. Examples of the material of the core rods 2, 41, . . . , and 91 include wood, resin, rubber, elastomer, foam, and metal. Further, examples of the shape of the core rods 2, 41, . . . , and 91 include shapes having a circular, elliptical, polygonal, and irregular vertical cross section. The core rods 2, 41, . . . , and 91 may have at least the upper face part in the horizontal cross section is formed into a convex curved surface that is upwardly convex.

Further, a material, a shape, and the like of the elastic bodies 3, 42, 52, 62, 72, 82*a*, 82*b*, 92*a*, and 92*b* of the above-described example may be selected as appropriate in accordance with the strength of the pressuring force of the elastic bodies. Examples of the material of the elastic bodies 3, 42, . . . , and 92*b* include rubber, elastomer, and foam. Further, examples of the shape of the elastic bodies 3, 42, . . . , and 92*b* include a long shape having a bending part and/or a curved part, and a long shape extending substantially linearly. Furthermore, a hardness (rubber hardness, for example) of the elastic bodies 3, 42, . . . , and 92*b* may be 50 to 75° (preferably 55 to 70°), for example. This hardness is measured in accordance with the new JIS standard K6235, and a type A durometer is used as the hardness meter.

Furthermore, the pressure area, sequence, and the like resulting from the acupressure tool 1 of the above-described example do not matter. Examples of the area to which pressure is applied by this acupressure tool 1 include the head region, the interscapular region, the upper scapular region, a local area near the mastoid, the rear neck region, the side neck region, the lumbar region, the gluteal region, leg region, and the arm region of the body.

Further, while the above-described example describes the acupressure tool set 30 comprising the second to seventh acupressure tools 32 to 37 as the other acupressure tools, the present invention is not limited thereto, and the acupressure tool set may comprise not all but at least one of the second to seventh acupressure tools 32 to 37 as the other acupressure tools, for example. Furthermore, the acupressure tool set may comprise yet other acupressure tools in addition to the second to seventh acupressure tools 32 to 37 as the other acupressure tools.

Further, while the above-described example describes a form in which the first to seventh acupressure tools 1 and 32 to 37 are disposed in a predetermined order, the present invention is not limited thereto, and the order in which the first to seventh acupressure tools 1 and 32 to 37 are disposed does not matter.

Further, while the above-described example describes the acupressure tool set 30 comprising a single sixth acupressure tool 36 (or seventh acupressure tool 37), the present invention is not limited thereto, and the acupressure tool set may comprise a plurality (two in the figure) of sixth acupressure tools 36 (or seventh acupressure tools 37), as illustrated in FIG. 32B, for example.

Figure 33:
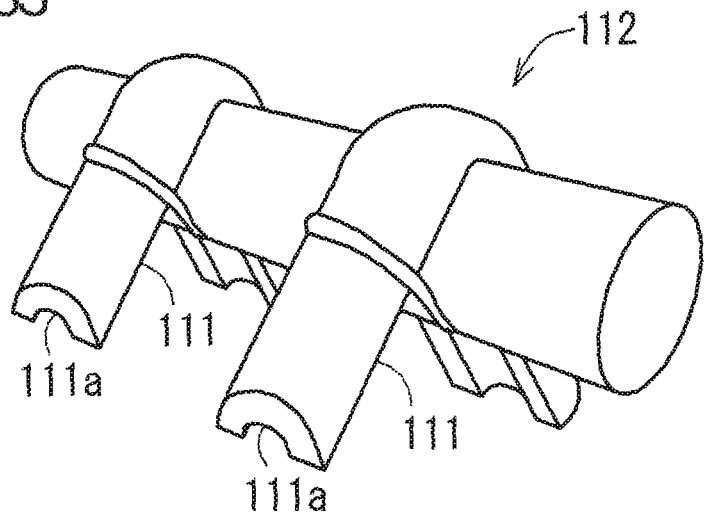
FIG. 33 is a perspective view of the second acupressure tool according to a modification.
Figure 34:
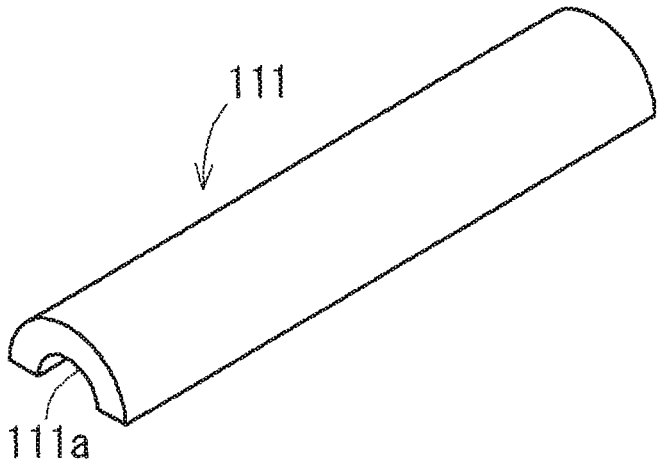
FIG. 34 is a perspective view of the second elastic body (non-elastically deformed state) according to the modification.

Further, while the above-described example describes the acupressure tools 32 to 37 comprising solid elastic bodies 42, 52, 62, 72, 82*a*, 82*b*, 92*a*, and 92*b*, the present invention is not limited thereto, and an acupressure tool may be an acupressure tool 112 comprising hollow elastic bodies 111 in which a concave part 111*a* is formed along the longitudinal direction on the rear face side thereof, as illustrated in FIGS. 33 and 34, for example.

Figure 35:
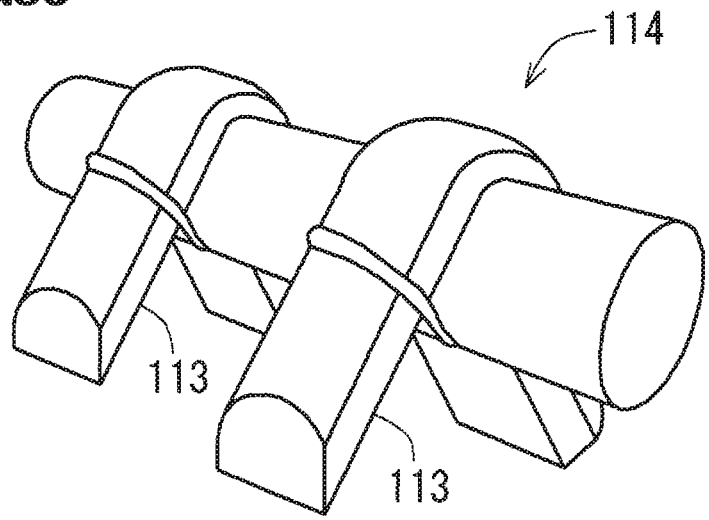
FIG. 35 is a perspective view of the second acupressure tool according to another modification.
Figure 36:
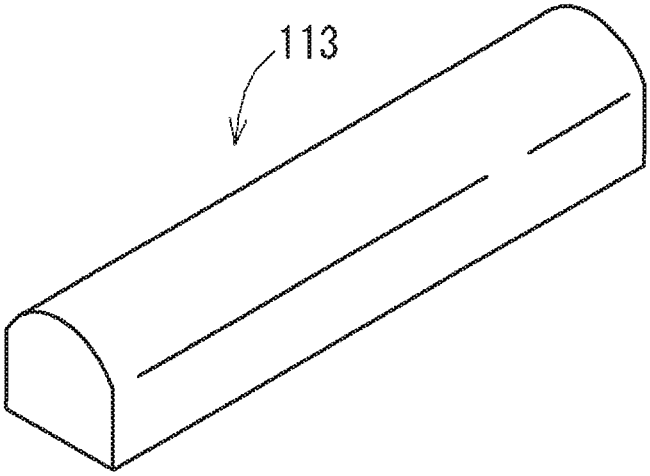
FIG. 36 is a perspective view of the second elastic body (non-elastically deformed state) according to the other modification.

Furthermore, while the above-described example describes the acupressure tools 32 to 37 comprising the elastic bodies 42, 52, 62, 72, 82*a*, 82*b*, 92*a*, and 92*b* having a semicircular horizontal cross section, the present invention is not limited thereto, and the tool may be an acupressure tool 114 comprising elastic bodies 113 having a rectangular vertical cross section in which the upper face side is formed into a convex curved surface that is upwardly convex, as illustrated in FIGS. 35 and 36, for example.

Figure 37:
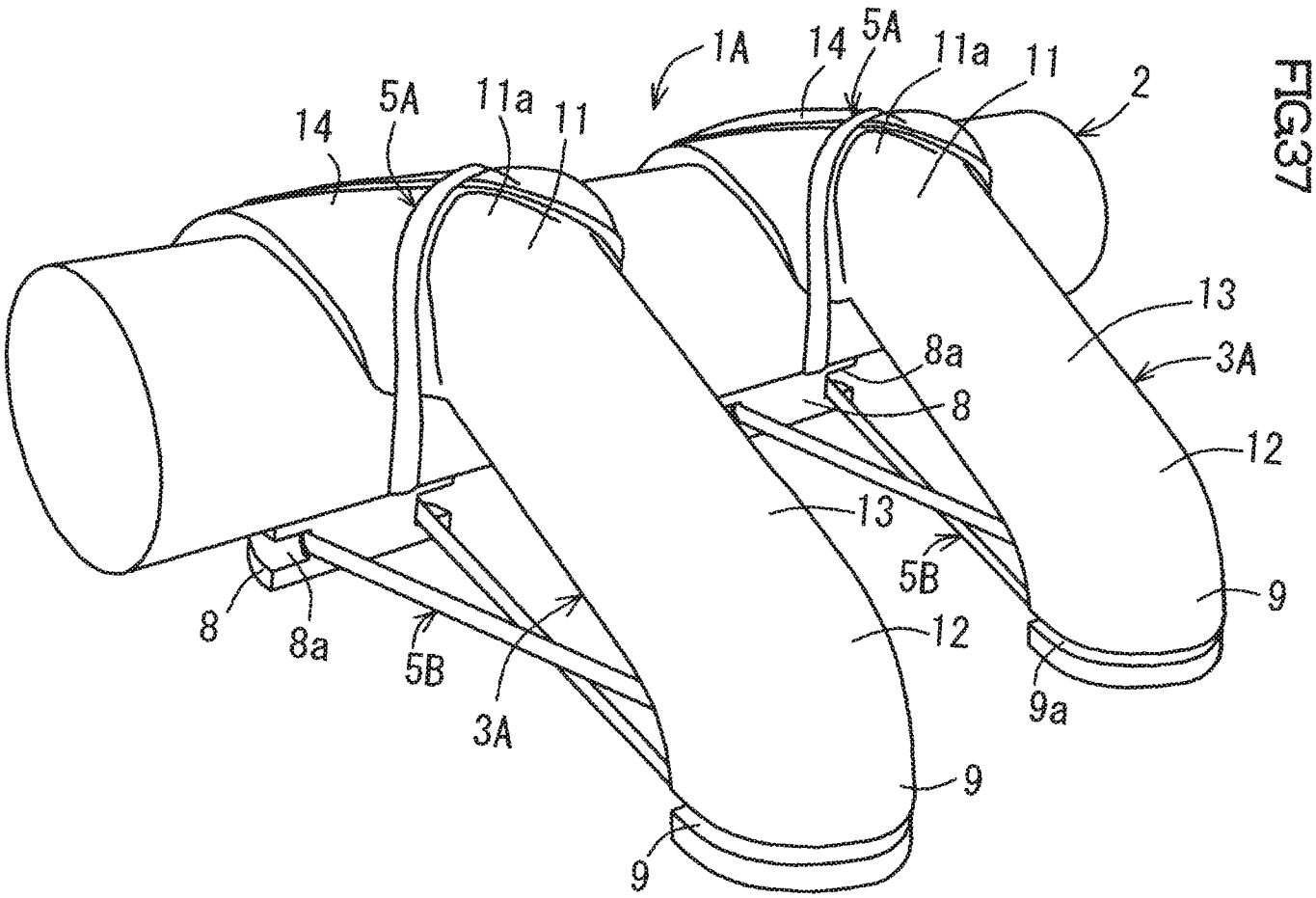
FIG. 37 is a perspective view of the acupressure tool (first acupressure tool) according to a modification.
Figure 38:
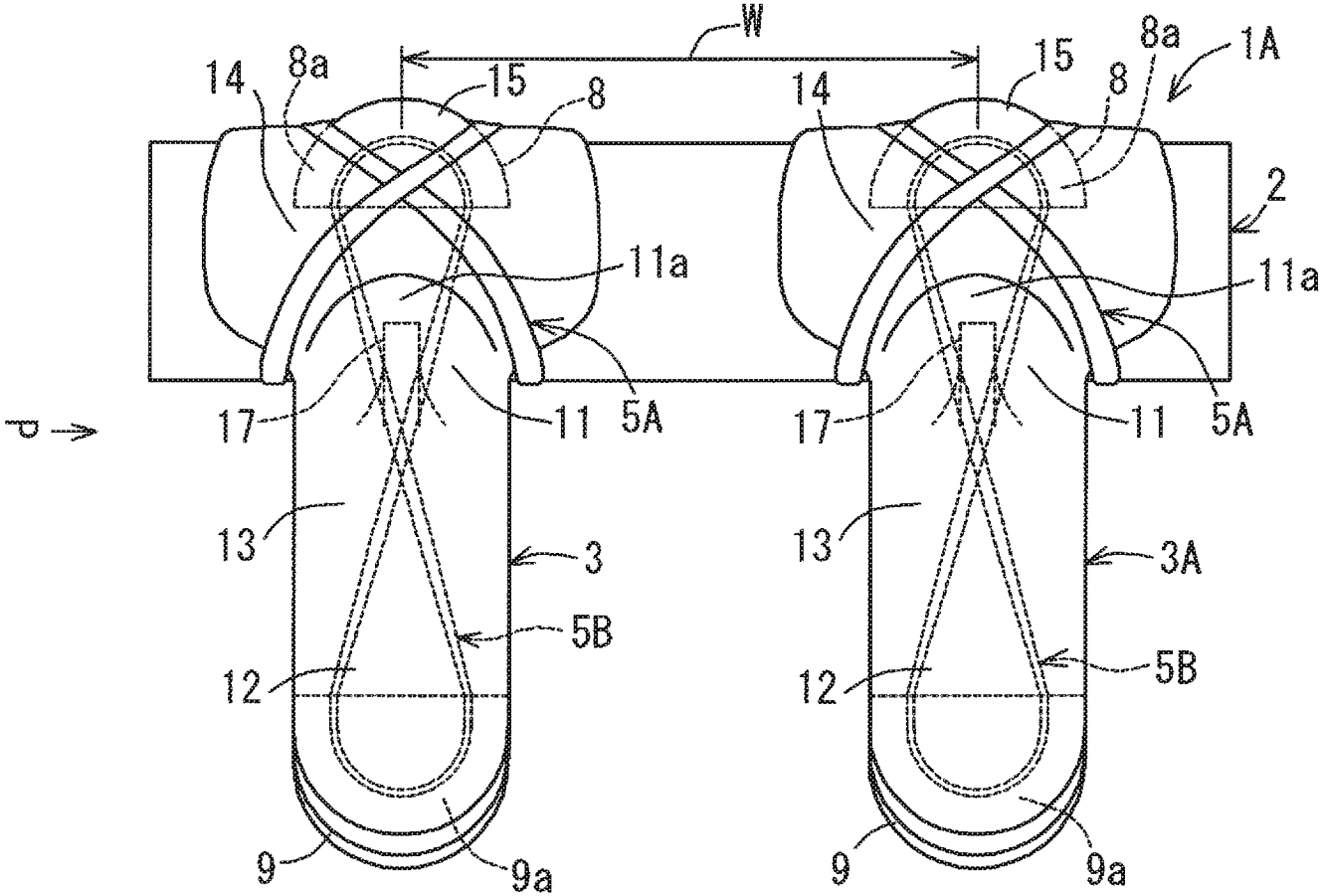
FIG. 38 is a plan view of the acupressure tool described above.
Figure 39:
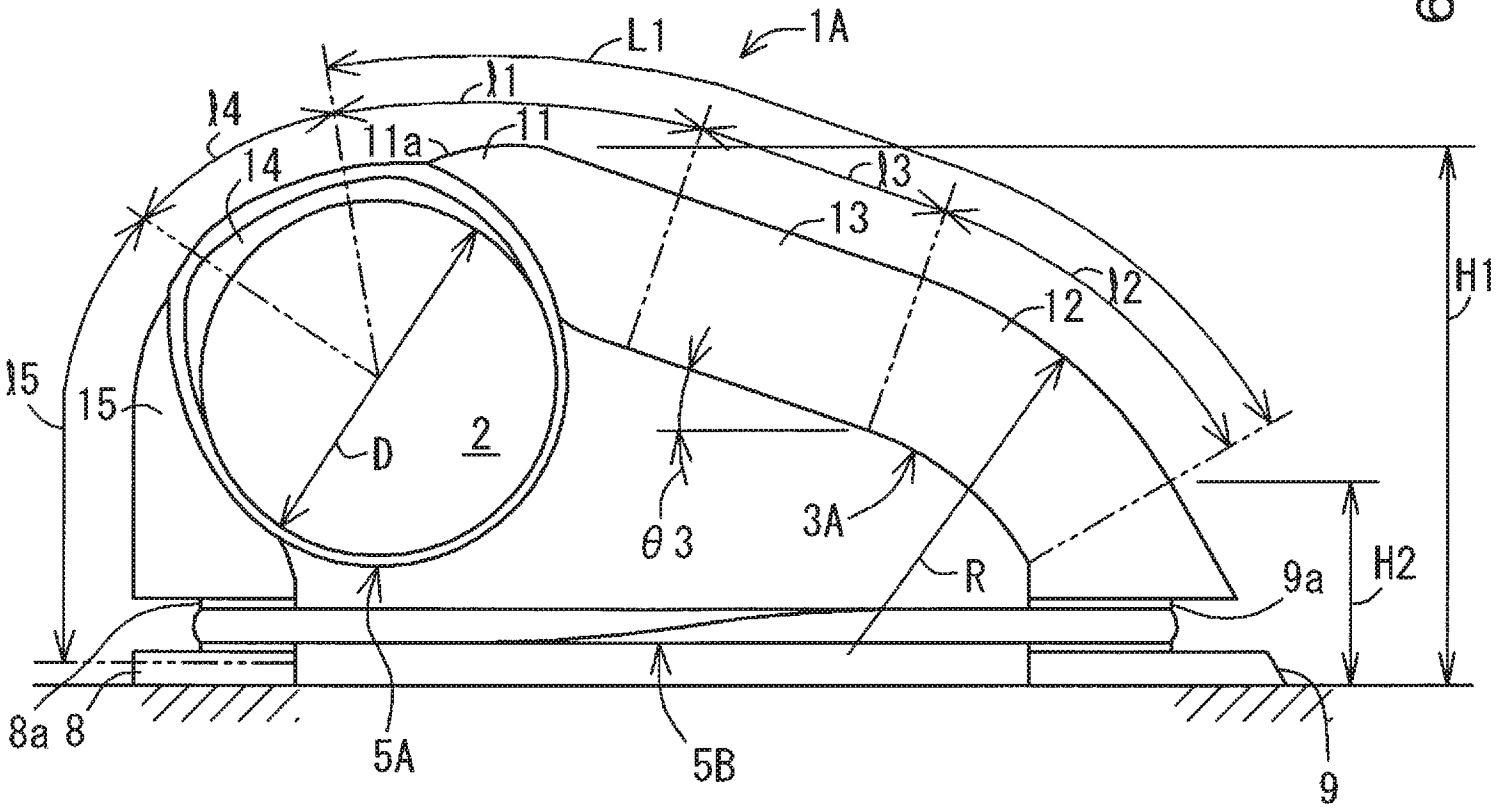
FIG. 39 is an enlarged view in the direction of arrow P in FIG. 38.

Furthermore, while the above-described example describes the acupressure tool 1 (refer to FIGS. 1 to 3) in which the string 5 is inserted through the grooves 4 formed into the elastic bodies 3 and wrapped around the core rod 2 and the elastic bodies 3, thereby integrally connecting both 2 and 3, the present invention is not limited thereto, and the acupressure tool may be an acupressure tool 1A in which a string 5A is wrapped in a crisscross shape around the core rod 2 and elastic bodies 3A (in particular, the first pressure part 11 and the fourth pressure part 14), and a circular string 5B is wrapped around circular grooves 8*a* and 9*a* formed into the legs 8 and 9 of the elastic bodies, thereby integrally connecting the core rod 2 and the elastic bodies 3A, as illustrated in FIGS. 37 to 39, for example. With this arrangement, the core rod 2 and the elastic bodies 3A are securely integrally connected by the string 5A, and both legs 8 and 9 are prevented from separating from each other and collapsing in posture by the string 5B. Furthermore, the support part 15 easily elastically deforms due to the groove 8*a*, making it possible to more accurately identify the local area P near the mastoid by the first pressure part 11 and apply further pressure using an appropriate pressing force. It should be noted that the above-described string 5B may be a criss-crossing circular string, or a non-crisscrossing circular string. Furthermore, in the above-described acupressure tool 1A illustrated in FIGS. 37 to 39, the components that are substantially the same as those of the above-described acupressure tool 1 are denoted using the same reference numerals.

Figure 40:
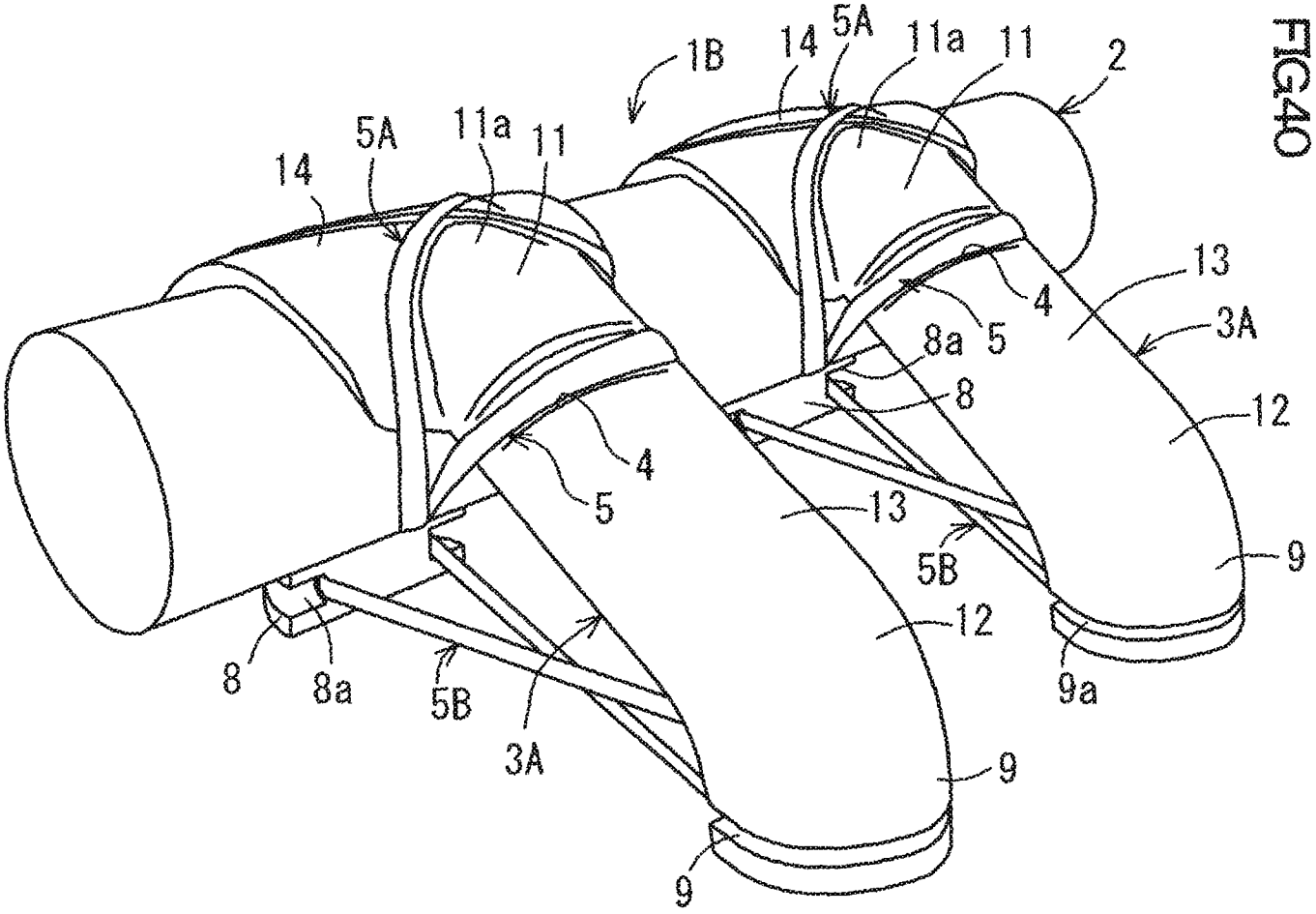
FIG. 40 is a perspective view of the acupressure tool (first acupressure tool) according to another modification.
Figure 41:
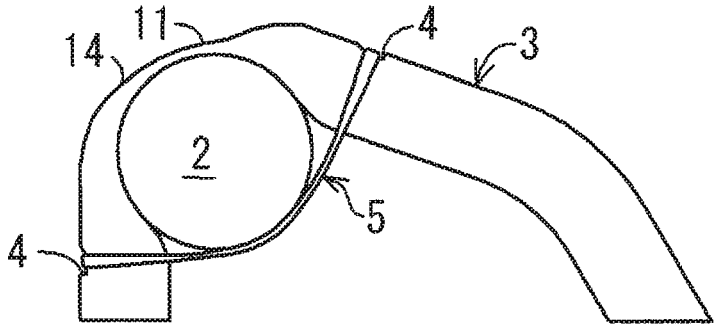
FIGS. 41A to 41C are explanatory views for explaining a method for assembling the acupressure tool described above, FIG. 41A illustrating a first string tied to a core rod, FIG. 41B illustrating a second string tied to the core rod, and FIG. 41C illustrating a third string tied between legs of the elastic body.
Figure 41:
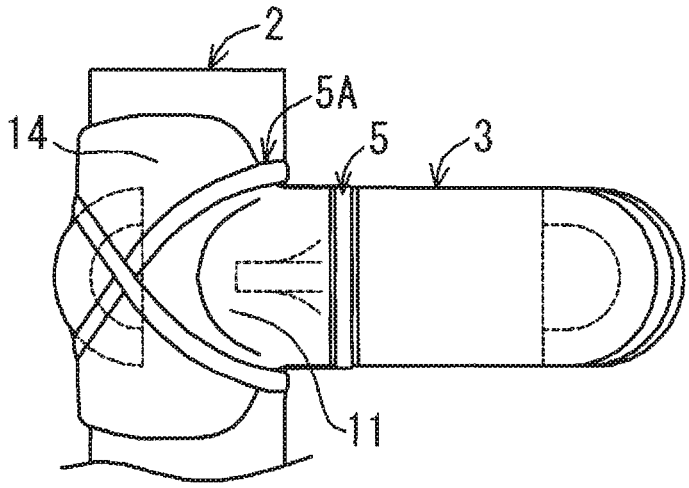
Figure 41:
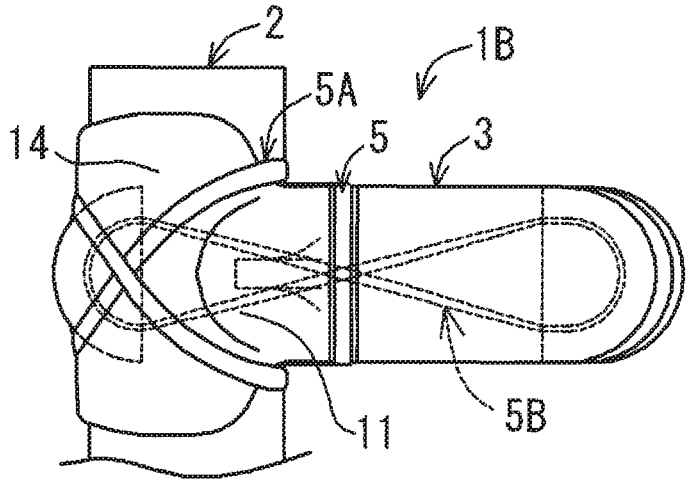

Further, the forms of tying the strings 5, 5A, and 5B of the aforementioned acupressure tools 1 and 1A may be combined, as illustrated in FIGS. 40 and 41, for example. Specifically, first, a first string 5 is tied to the core rod 2 and the elastic body 3B (FIG. 41A); next, a second string 5A is wrapped in a crisscross shape around the core rod 2 and the elastic body 3B (FIG. 41B); and next, a third string 5B is wrapped around the circular grooves 8*a* and 9*a* formed in the legs 8 and 9 of the elastic body (FIG. 41C); thereby making it possible to achieve the acupressure tool 1B in which the core rod 2 and the elastic body 3B are integrally connected. According to this acupressure tool 1B, substantially the same actions and effects as those of the aforementioned acupressure tools 1 and 1A are achieved, and the first pressure part 11 and the fourth pressure part 14 abut and are temporarily attached to the front face of the core rod 2 without any gaps by the first string 5, making it possible to subsequently easily perform the assembly work using the second and third strings 5A and 5B.

Figure 42:
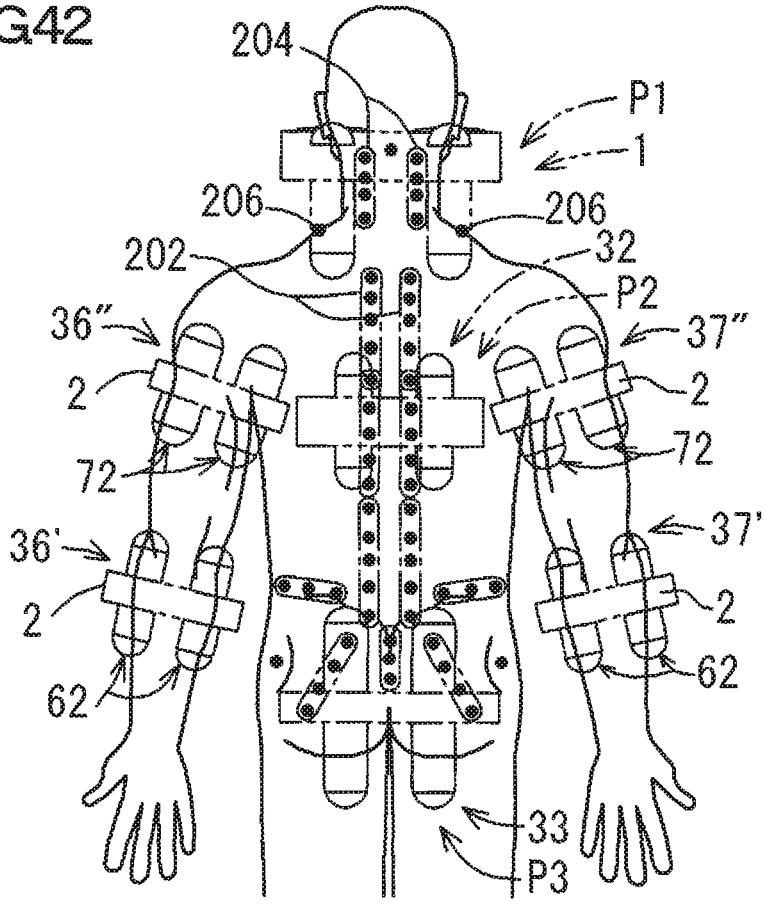
FIG. 42 is an explanatory view for explaining the sixth and the seventh acupressure tools according to another modification.
Figure 43:
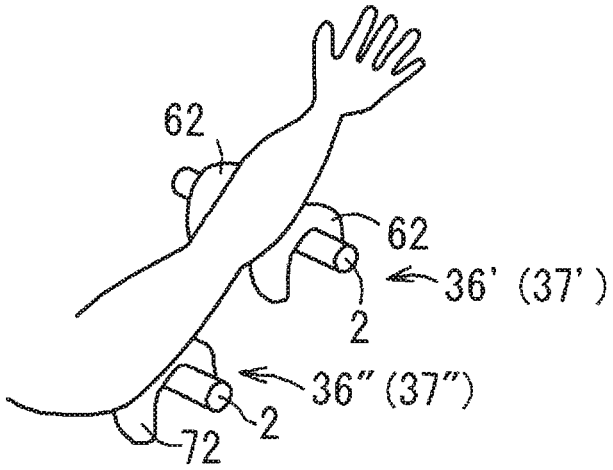
FIG. 43 is an action explanatory view of the sixth and the seventh acupressure tools described above.

While the above-described example describes the sixth and the seventh acupressure tools 36 and 37 (refer to FIG. 29) for applying pressure to the forearm regions of the body, the present invention is not limited thereto, and the acupressure tools may be acupressure tools 36' and 37' for applying pressure to upper arm connecting regions of the forearms, and acupressure tools 36" and 37" for applying pressure to shoulder connecting regions and/or armpit regions of the upper arm, as illustrated in FIGS. 42 and 43, for example. It should be noted that examples of the above-described acupressure tools 36' and 37' include acupressure tools in which the pair of elastic bodies 62 (refer to FIGS. 22 and 23) used in the fourth acupressure tool 34 is wrapped at a predetermined narrow angle (predetermined acute angle) around the core rod 2 (diameter: 40 mm, shaft length: 250 mm). Further, examples of the above-described acupressure tools 36" and 37" include acupressure tools in which the pair of elastic bodies 72 (refer to FIGS. 24 and 25) used in the fifth acupressure tool 35 is wrapped at a predetermined narrow angle (predetermined acute angle) around the core rod 2 (diameter: 40 mm, shaft length: 250 mm).

Furthermore, examples of an acupressure tool set according to a modification include an acupressure tool set 400 comprising the aforementioned first acupressure tool 1 (refer to FIG. 1) for applying pressure to the head region and/or the shoulder regions of the body, and a left and right shoulder acupressure tool 401 for applying pressure to left and right shoulder regions 300 (in particular, the shoulder regions 300 that include the scapula regions 200; refer to FIG. 45B) of the body, as illustrated in FIGS. 44 and 45. It should be noted that examples of the above-described shoulder acupressure tool 401 include acupressure tools in which the pair of elastic bodies 72 (refer to FIGS. 24 and 25) used in the fifth acupressure tool 35 is wrapped at a predetermined narrow angle (predetermined acute angle) around the core rod 2 (diameter: 40 mm, shaft length: 250 mm).

In the above-described acupressure tool set 400, the first acupressure tool 1 is disposed in the first predetermined position P1 on the installation surface such as a floor so as to allow the head region of the user (acupressure recipient) to be placed thereon, and the left and right shoulder acupressure tools 401 are disposed in the left and right second predetermined positions P2 on the installation surface so as to allow the shoulder regions of the user to be placed thereon, as illustrated in FIG. 45, for example. At this time, an angle θ4 (refer to FIG. 45B) formed by the axial center of the core rod 2 of the first acupressure tool 1 and an axial center of the core rod 2 of the shoulder acupressure tool 401 is 35 to 55° (preferably, 40 to 50°), for example.

Then, as illustrated in FIG. 46A, the user lies on his/her back and places his/her head region and shoulder regions on the first acupressure tool 1 and the left and right shoulder acupressure tools 401, as illustrated in FIG. 46A. Then, pressure is applied to the pressure points of the head region by the first acupressure tool 1, and pressure is applied to the pressure points of the left and right shoulder regions by the left and right shoulder acupressure tools 401. On the other hand, as illustrated in FIG. 46B, the user lies on his/her side and places his/her head region and shoulder region on the first acupressure tool 1 and one of the left and right shoulder acupressure tools 401. Then, pressure is applied to the pressure points of the head region by the first acupressure tool 1, and pressure is relatively strongly applied to the pressure point of one of the left and right shoulder regions by one of the left and right shoulder acupressure tools 401. From the above, pressure is firmly applied to the user's heart's content with the user lying on his/her back and his/her side, entering a restful sleep. That is, the combination of the first acupressure tool 1 and the left and right shoulder acupressure tools 401 can be used as a pillow for restful and sound sleep for a long period of time.

Figure 47:
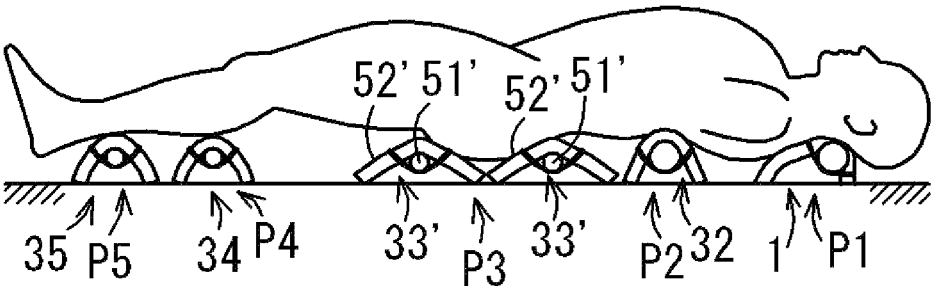
FIG. 47 is an explanatory view for explaining the third acupressure tool according to a modification.

Further, while the above described example describes a single third acupressure tool 33 (refer to FIG. 30) for applying pressure to the lumbar region and/or the gluteal region of the body, the present invention is not limited thereto, and the third acupressure tool may be a pair of acupressure tools 33' and 33' arranged side-by-side along the lumbar region and/or the gluteal region, as illustrated in FIG. 47, for example. In this case, the pair of acupressure tools 33' and 33' may be arranged side-by-side with a constant distance therebetween by connecting the pair 33' and 33' by tying together a core rod 51' and/or elastic bodies 53' of the pair 33' and 33' using a connecting material such as a string.

Furthermore, examples of the acupressure tool set according to another modification include an acupressure tool set 403 comprising a center acupressure tool 404 and left and right lateral acupressure tools 405 as the third acupressure tool for applying pressure to the lumbar region and/or the gluteal region of the body, as illustrated in FIG. 49 and FIG. 50. In this case, the center acupressure tool 404 is arranged so that an axial center of a core rod 404*a* of the center acupressure tool 404 is substantially parallel to the axial center of a core rod 2 of the first acupressure tool 1 (refer to FIG. 49). Further, the left and right lateral acupressure tools 405 are arranged so that axial centers of the core rods 405*a* of the left and right lateral acupressure tools 405 lie obliquely at a predetermined inclination angle θ5 (approximately 45 degrees, for example) to the axial center of the first acupressure tool 1 (that is, the axial center of the core rod 404*a* of the center acupressure tool 404) (refer to FIG. 49). With this arrangement, pressure is applied to the lumbar region and the sacrum region including the acupressure points of a Jinyu 407 and a Shishitsu 408 by one of the elastic bodies of the left and right lateral acupressure tools 405, and pressure is applied to the lumbar region including the Namikoshi pressure point 304 by the other of the elastic bodies (refer to FIG. 50). Further, the center acupressure tool 404 prevents the lumbar regions from shifting downward in the body. Accordingly, it is possible to remove the fatigue and stiffness from the lumbar region and/or the gluteal region in a stable manner, and more reliably prevent lumbar pain and posture deterioration (that is, lumbar curvature).

It should be noted that, in this acupressure tool set 403, the aforementioned acupressure tools 36', 36", 37', and 37" are adopted as the sixth and seventh acupressure tools for applying pressure to the arm regions of the body, and the acupressure tool set 403 further comprises the aforementioned left and right shoulder acupressure tools 401 for applying pressure to the shoulder regions of the body. Further, examples of the center acupressure tool 404 include acupressure tools in which the pair of elastic bodies 72 (refer to FIGS. 24 and 25) used in the fifth acupressure tool 35 is wrapped at a predetermined wide angle (predetermined obtuse angle) around a core rod 404*a* (diameter: 40 mm, shaft length: 250 mm). Further, examples of the left and right lateral acupressure tools 405 include acupressure tools in which the pair of elastic bodies 72 (refer to FIGS. 24 and 25) used in the fifth acupressure tool 35 is wrapped at a predetermined narrow angle (predetermined acute angle) around a core rod 405*a* (diameter: 40 mm, shaft length: 250 mm).

Figure 51:
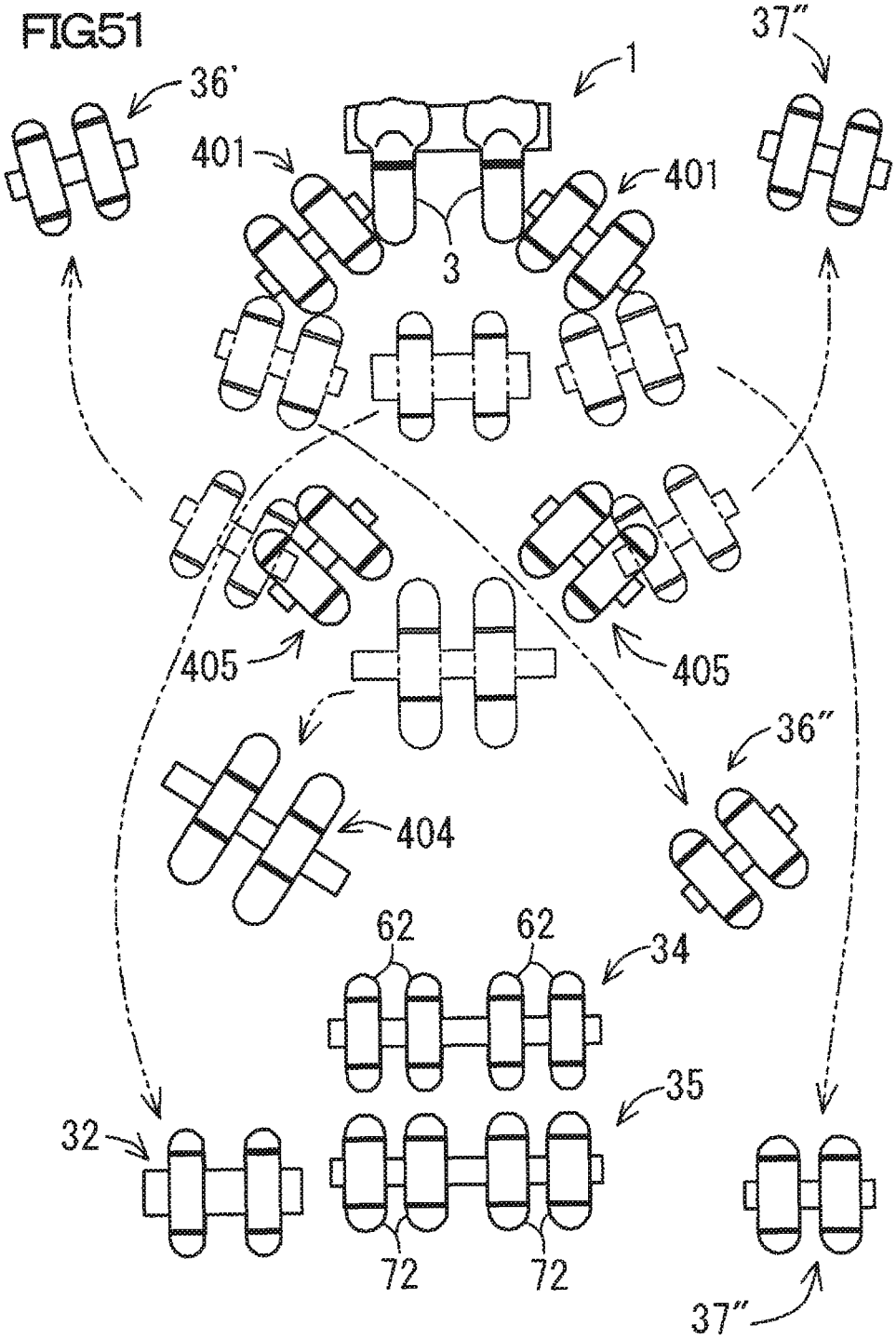
FIG. 51 is a plan view illustrating the disposed relationship of the acupressure tool set described above during sleep.
Figure 52:
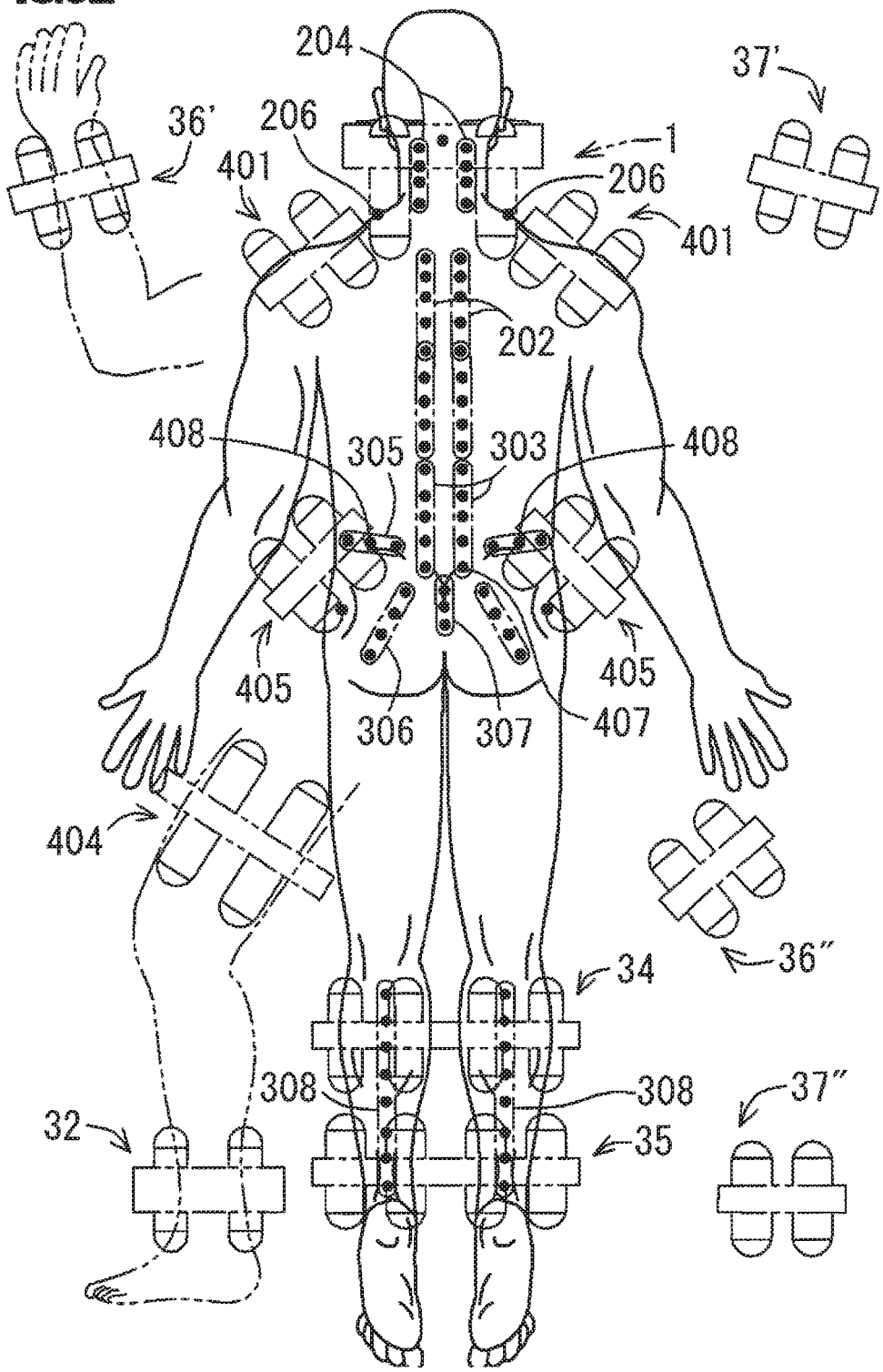
FIG. 52 is an action explanatory view of the acupressure tool set described above, illustrating a position of each acupressure tool as viewed from the back surface of the body.

When the above-described acupressure tool set 403 is used for a restful and sound sleep, the acupressure tools 36', 36", 37', and 37" for applying pressure to the arm regions of the body, the acupressure tool 32 for applying pressure to the muscles along the spine of the body, and the center acupressure tool 404 are removed from set positions during acupressure, and set to appropriate positions for applying pressure to the leg regions and arm regions with the user lying on his/her side (refer to FIG. 51), as illustrated in FIGS. 51 and 52, for example. Furthermore, the left and right distance between the left and right lateral acupressure tools 405 is slightly wide compared to during acupressure.

In the aforementioned state, the user, lying on his/her back, places his/her head region and shoulder regions on the first acupressure tool 1 and the left and right shoulder acupressure tools 401, inserts his/her lumbar region between the left and right lateral acupressure tools 405, and places his/her leg regions on the acupressure tools 34 and 35, as illustrated in FIG. 52. Then, pressure is applied to the pressure point of the head region by the first acupressure tool 1, the pressure points of the left and right shoulder regions by the left and right shoulder acupressure tools 401, the pressure points of the lumbar region by the left and right lateral acupressure tools 404, and the pressure points of the leg regions by the acupressure tools 34 and 35.

Figure 53:
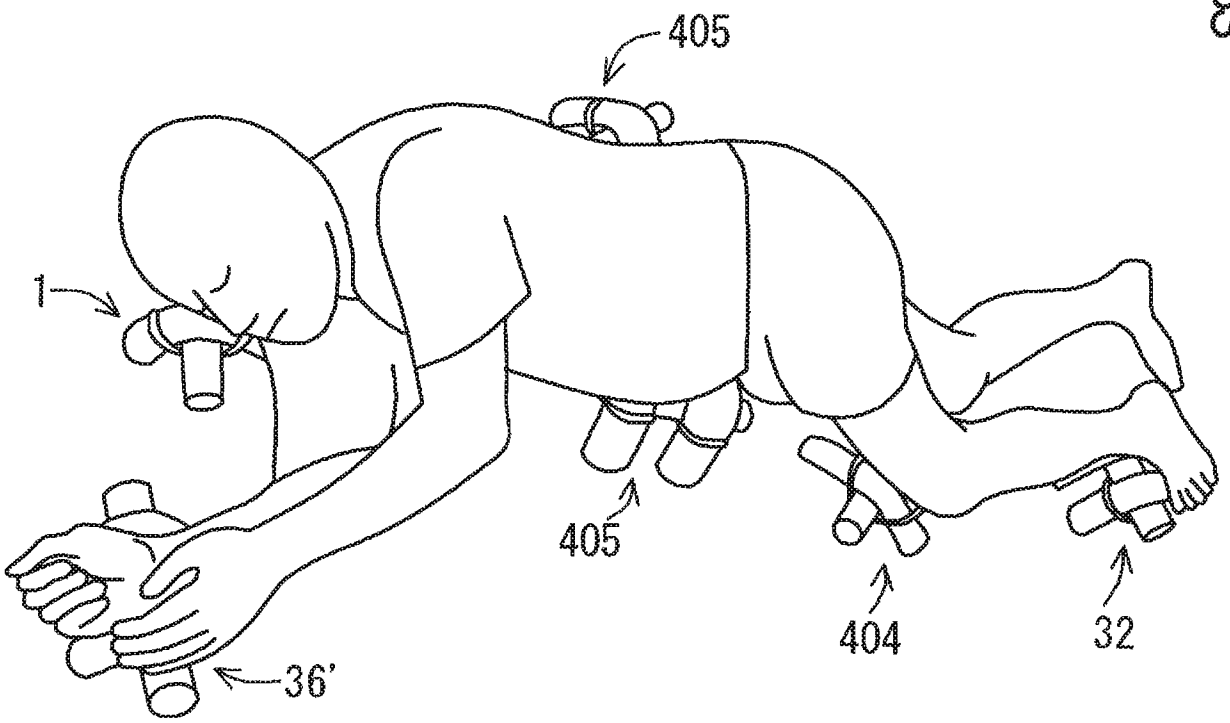
FIG. 53 is an action explanatory view of the acupressure tool set described above.
Figure 54:
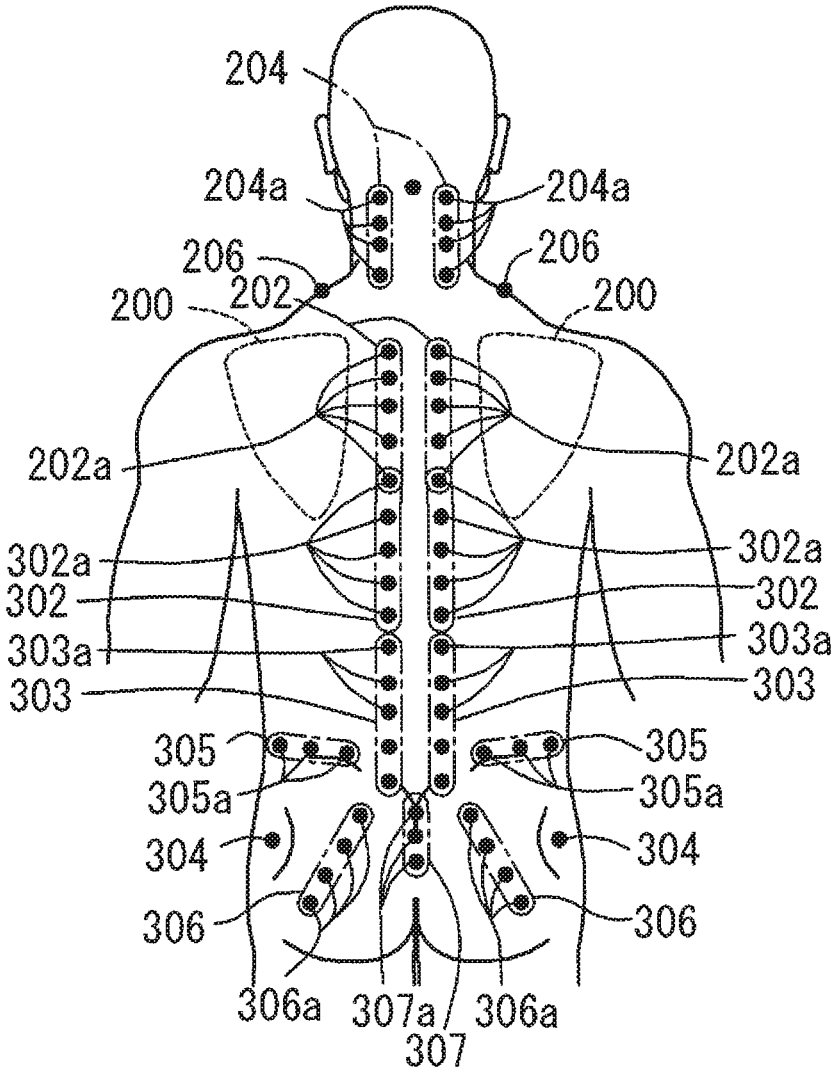
FIG. 54 is an explanatory view illustrating acupressure pressure points conventionally known.

On the other hand, as illustrated in FIG. 53, the user, lying on his/her side, places his/her head region and shoulder regions on the first acupressure tool 1 and one of the shoulder acupressure tools 401, his/her lower abdominal region on one of the lateral acupressure tools 405, and his/her lumbar region on the other of the lateral acupressure tools 405. Furthermore, the user places his/her wrist regions on the acupressure tool 36' (or 37'), and his/her leg region on the acupressure tools 32 and 404 (or 36", 37"). Then, pressure is applied to the pressure points of the head region by the first acupressure tool 1, the pressure points of the left and right shoulder regions by the left and right shoulder acupressure tools 401, the pressure points of the lower abdominal region by one of the lateral acupressure tools 405, and the pressure points of the lumbar regions by the other of the lateral acupressure tools 405. Furthermore, pressure is applied to the pressure points of the wrist region by the acupressure tool 36', and the pressure points of the leg regions by the acupressure tools 32 and 404. Accordingly, pressure is firmly applied to the user's heart's content with the user lying on his/her back and his/her side, entering a restful sleep. That is, the combination of the first acupressure tool 1 and the left and right lateral acupressure tools 405 can be used as a pillow for restful and sound sleep for a long period of time. It should be noted that applying pressure to the lower abdominal region by one of the lateral acupressure tools 405 directly stimulates the bowels, promotes bowel movement, and prevents constipation.

From the above, according to the acupressure tool set 403 of this example, the third acupressure tool comprises the left and right lateral acupressure tools 405, and the lateral acupressure tools 405 are arranged so that the axial center of the core rod 405*a* of the lateral acupressure tools 405 lies obliquely to the axial center of the core rod 2 of the first acupressure tool 1. With this arrangement, pressure is applied to the lumbar region and/or the gluteal region (in particular, the lumbar region and the sacrum region including the acupressure points of the Jinyu 407 and the Shishitsu 408, and the lumbar region including the Namikoshi pressure point 304) of the body by the left and right lateral acupressure tools 405. This makes it possible to more reliably prevent lumbar pain and posture deterioration (that is, lumbar curvature). Further, the combination of the first acupressure tool 1 and the left and right lateral acupressure tools 405 can be used for a long period of time for restful and sound sleep.

Furthermore, according to the acupressure tool set 403 of this example, the third acupressure tool comprises the center acupressure tool 404, and the center acupressure tool 404 is arranged so that the axial center of the core rod 404*a* of the center acupressure tools 404 is parallel to the axial center of the core rod 2 of the first acupressure tool 1. With this arrangement, shifts of the lumbar region and/or gluteal region are prevented by the center acupressure tool 404. This makes it possible to remove fatigue and stiffness from the lumbar region and/or the gluteal region by the left and right lateral acupressure tools 405 and the center acupressure tool 404 in a stable manner.

It should be noted that the embodiment, examples, modifications, and the like described above may be used in combination in accordance with a purpose and usage.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and examples, the present invention is not intended to be limited to the particulars disclosed herein; rather, the present invention extends to all functionally equivalent structures, methods and uses, such as are within the scope of the appended claims.

The present invention is not limited to the embodiment described above, and various modifications and changes are possible within the scope of the claims of the present invention.

INDUSTRIAL APPLICABILITY

The present invention is broadly used as an acupressure tool that applies pressure to a local area of the body.

What is claimed is:

1. An acupressure tool comprising:

a core rod, and a pair of long elastic bodies attached to the core rod, each of the elastic bodies being attached to the core rod by being arranged intersecting an axial direction of the core rod and bent along an outer face of the core rod;

wherein the elastic bodies each comprise a first pressure part arranged on an upper face side of the core rod; and a first tapered face is formed on a rear face side of the first pressure part, the first tapered face lying obliquely to a direction of extension of the first pressure part, abutting the outer face of the core rod, and forming a convex curved surface part on a front face side of the first pressure part to apply pressure to a local area of a user;

wherein the first pressure part further comprises a rib that extends in the direction of extension of the first pressure part on the rear face side of the first pressure part, the first tapered face being formed by a lower face of the rib;

wherein the first pressure part includes a thick portion and a thin portion which is connected to the thick portion in the direction of extension of the first pressure part; and wherein the rib is provided on the thin portion so that the height thereof gradually decreases as going away from the thick portion in the direction of extension of the first pressure part.

2. The acupressure tool according to claim 1, wherein the elastic bodies each further comprise a second pressure part arranged near one end side in a long direction of the elastic body, the second pressure part having a front face edge in a vertical cross section along a longitudinal direction of the elastic body that is substantially curved in shape.

3. The acupressure tool according to claim 2, wherein the elastic bodies each further comprise a third pressure part arranged between the first pressure part and the second pressure part, the third pressure part having a front face edge in a vertical cross section that is substantially linear in shape.

4. The acupressure tool according to claim 1, wherein the elastic bodies each further comprise a support part that supports an outer face of the core rod in an upright state, and a second tapered face is formed on a rear face side of the support part, the second tapered face lying obliquely to a direction of extension of the support part and abutting the outer face of the core rod.

5. The acupressure tool according to claim 4, wherein the elastic bodies each further comprise another pressure part arranged on the upper face side of the core rod between the first pressure part and the support part, the another pressure part having a thickness of 2 to 5 mm.

6. The acupressure tool according to claim 1, wherein the thin portion comprises a concave part that is indented toward an upper face side and formed on a lower face side of each of the elastic bodies.

7. The acupressure tool according to claim 1, wherein the rib is disposed at an intermediate portion in a lateral width direction of the first pressure part.

8. The acupressure tool according to claim 1, wherein each one of the pair of long elastic bodies is coupled to the core rod via a string inserted into at least one groove formed into each one of the pair of long elastic bodies.

9. An acupressure tool set comprising:

a first acupressure tool for applying pressure to a head region and/or shoulder regions of a body, the acupressure tool including a core rod, and a pair of long elastic bodies attached to the core rod, each of the elastic bodies being attached to the core rod by being arranged intersecting an axial direction of the core rod and bent along an outer face of the core rod;

wherein the elastic bodies each comprise a first pressure part arranged on an upper face side of the core rod; and a first tapered face is formed on a rear face side of the first pressure part, the first tapered face lying obliquely to a direction of extension of the first pressure part and abutting the outer face of the core rod, and forming a convex curved surface part on a front face side of the first pressure part to apply pressure to a local area near a mastoid of a head region of a use; and another acupressure tool for applying pressure to a section of the body different from the section having pressure applied thereto by the first acupressure tool;

wherein the another acupressure tool comprises a core rod, and a pair of long elastic bodies attached to the core rod, the elastic bodies being attached to the core rod by being arranged intersecting an axial direction of the core rod and bent along an outer face of the core rod, and an upper face of each of the elastic bodies being formed into a convex curved surface that is upwardly convex in a horizontal cross section to apply pressure to a pressure point of the body of a user;

wherein the first pressure part further comprises a rib that extends in the direction of extension of the first pressure part on the rear face side of the first pressure part, the first tapered face being formed by a lower face of the rib;

wherein the first pressure part includes a thick portion and a thin portion which is connected to the thick portion in the direction of extension of the first pressure part; and wherein the rib is provided on the thin portion so that the height thereof gradually decreases as going away from the thick portion in the direction of extension of the first pressure part.

10. The acupressure tool set according to claim 9, wherein the another acupressure tool further comprises a second acupressure tool for applying pressure to muscles along the spine of the body.

11. The acupressure tool set according to claim 10, wherein the another acupressure tool further comprises a third acupressure tool for applying pressure to a lumbar region and/or a gluteal region of the body.

12. The acupressure tool set according to claim 11, wherein the third acupressure tool comprises left and right lateral acupressure tools, the lateral acupressure tools having an axial center of the core rod arranged obliquely to an axial center of the core rod of the first acupressure tool.

13. The acupressure tool set according to claim 12, wherein the third acupressure tool comprises a center acupressure tool, the center acupressure tool having an axial center of the core rod being arranged parallel to the axial center of the core rod of the first acupressure tool.

14. The acupressure tool set according to claim 11, wherein the another acupressure tool comprises a fourth acupressure tool for applying pressure to a calf region of a leg region of the body, and a fifth acupressure tool for applying pressure to an Achilles tendon region of the leg region of the body.

15. The acupressure tool set according to claim 14, wherein the other acupressure tool comprises a sixth acupressure tool for applying pressure to a left arm region of the body, and a seventh acupressure tool for applying pressure to a right arm region of the body.

16. The acupressure tool set according to claim 9, wherein the another acupressure tool comprises left and right shoulder acupressure tools for applying pressure to shoulder regions of the body, the shoulder acupressure tools each having an axial center of the core rod arranged obliquely to the axial center of the core rod of the first acupressure tool.

17. A method for arranging an acupressure tool set, the acupressure tool set including a first acupressure tool for applying pressure to a head region and/or shoulder regions of a body, comprising a core rod and a pair of long elastic bodies attached to the core rod, each of the elastic bodies being attached to the core rod by being arranged intersecting an axial direction of the core rod and bent along an outer face of the core rod; wherein the elastic bodies each comprise a first pressure part arranged on an upper face side of the core rod; and a first tapered face is formed on a rear face side of the first pressure part, the first tapered face lying obliquely to a direction of extension of the first pressure part and abutting the outer face of the core rod and another acupressure tool for applying pressure to a section of the body different from the section having pressure applied thereto by the first acupressure tool; wherein the another acupressure tool comprises a core rod and a pair of long elastic bodies attached to the core rod, the elastic bodies being attached to the core rod by being arranged intersecting an axial direction of the core rod and bent along an outer face of the core rod, and an upper face of each of the elastic bodies being formed into a convex curved surface that is upwardly convex in a horizontal cross section, the method comprising the steps of:

arranging the first acupressure tool in a first predetermined position on an installation surface so that the head region and/or the shoulder regions of the body are placed thereon, and wherein the tapered face forms a convex curved surface part on a front face side of the first pressure part to apply pressure to a local area near a mastoid of a head region of a user;

arranging the other acupressure tool in another predetermined position on the installation surface so that a section of the body different from the section having pressure applied thereto by the first acupressure tool is placed thereon, and wherein the convex curved surface of the upper face of each of the elastic bodies of the other acupressure tool applies pressure to a pressure point of the body of a user;

wherein the first pressure part further comprises a rib that extends in the direction of extension of the first pressure part on the rear face side of the first pressure part, the first tapered face being formed by a lower face of the rib;

wherein the first pressure part includes a thick portion and a thin portion which is connected to the thick portion in the direction of extension of the first pressure part; and wherein the rib is provided on the thin portion so that the height thereof gradually decreases as going away from the thick portion in the direction of extension of the first pressure part.

* * * * *